US008262088B2

(12) United States Patent
Uji et al.

(10) Patent No.: US 8,262,088 B2
(45) Date of Patent: Sep. 11, 2012

(54) MEDIUM CONVEYING APPARATUS AND IMAGE FORMING APPARATUS

(75) Inventors: Nobutaka Uji, Tokyo (JP); Yasuhiro Yamazaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 485 days.

(21) Appl. No.: 12/547,801

(22) Filed: Aug. 26, 2009

(65) Prior Publication Data

US 2010/0183351 A1 Jul. 22, 2010

(30) Foreign Application Priority Data

Jan. 22, 2009 (JP) ..... P2009-012178

(51) Int. Cl.
*B65H 7/02* (2006.01)

(52) U.S. Cl. ..... 271/265.01

(58) Field of Classification Search ..... 271/264, 271/265.01, 265.04, 242; 198/810.03, 780–791
See application file for complete search history.

(56) References Cited

U.S. PATENT DOCUMENTS

| | | | | |
|---|---|---|---|---|
| 5,875,380 | A | 2/1999 | Iwata et al. | |
| 5,983,066 | A | 11/1999 | Abe et al. | |
| 6,868,244 | B2 * | 3/2005 | Koide | 399/167 |
| 7,131,529 | B2 * | 11/2006 | Meade | 198/810.03 |
| 7,880,756 | B2 * | 2/2011 | Joichi et al. | 347/234 |
| 2004/0189783 | A1 | 9/2004 | Mogi | |
| 2006/0177253 | A1 | 8/2006 | Aiko | |
| 2007/0041762 | A1 | 2/2007 | Ishida et al. | |
| 2008/0285992 | A1 * | 11/2008 | Joichi et al. | 399/51 |
| 2011/0064496 | A1 * | 3/2011 | Ashikawa | 399/361 |
| 2012/0056369 | A1 * | 3/2012 | Lin | 271/110 |

FOREIGN PATENT DOCUMENTS

| | | |
|---|---|---|
| JP | 8-101618 | 4/1996 |
| JP | 10-288898 | 10/1998 |
| JP | 11-174757 | 7/1999 |
| JP | 11-202576 | 7/1999 |
| JP | 2004-291450 | 10/2004 |
| JP | 2005-208340 | 8/2005 |
| JP | 2006-201724 | 8/2006 |
| JP | 2006-248644 | 9/2006 |
| JP | 2007-86726 | 4/2007 |
| JP | 2007-286357 | 11/2007 |

* cited by examiner

*Primary Examiner* — Kaitlin Joerger
*Assistant Examiner* — Patrick Cicchino
(74) *Attorney, Agent, or Firm* — Sughrue Mion, PLLC

(57) ABSTRACT

A medium conveying apparatus includes: a medium conveying member that conveys a medium; a rotation start position detecting unit as defined herein; a driving start timing determining unit that determines whether a time reaches a driving start timing when rotation driving by the medium conveying member is started or not; and a medium conveying member controlling unit that controls the rotation driving of the medium conveying member, and that, in case the driving start timing determining unit determines that the time reaches the driving start timing and the rotation driving is started from one of the rotation start positions, the rotation driving is stopped at another one of the rotation start positions that is different from the rotation start position where the rotation driving is started, based on a result of the detection by the rotation start position detecting unit.

16 Claims, 41 Drawing Sheets

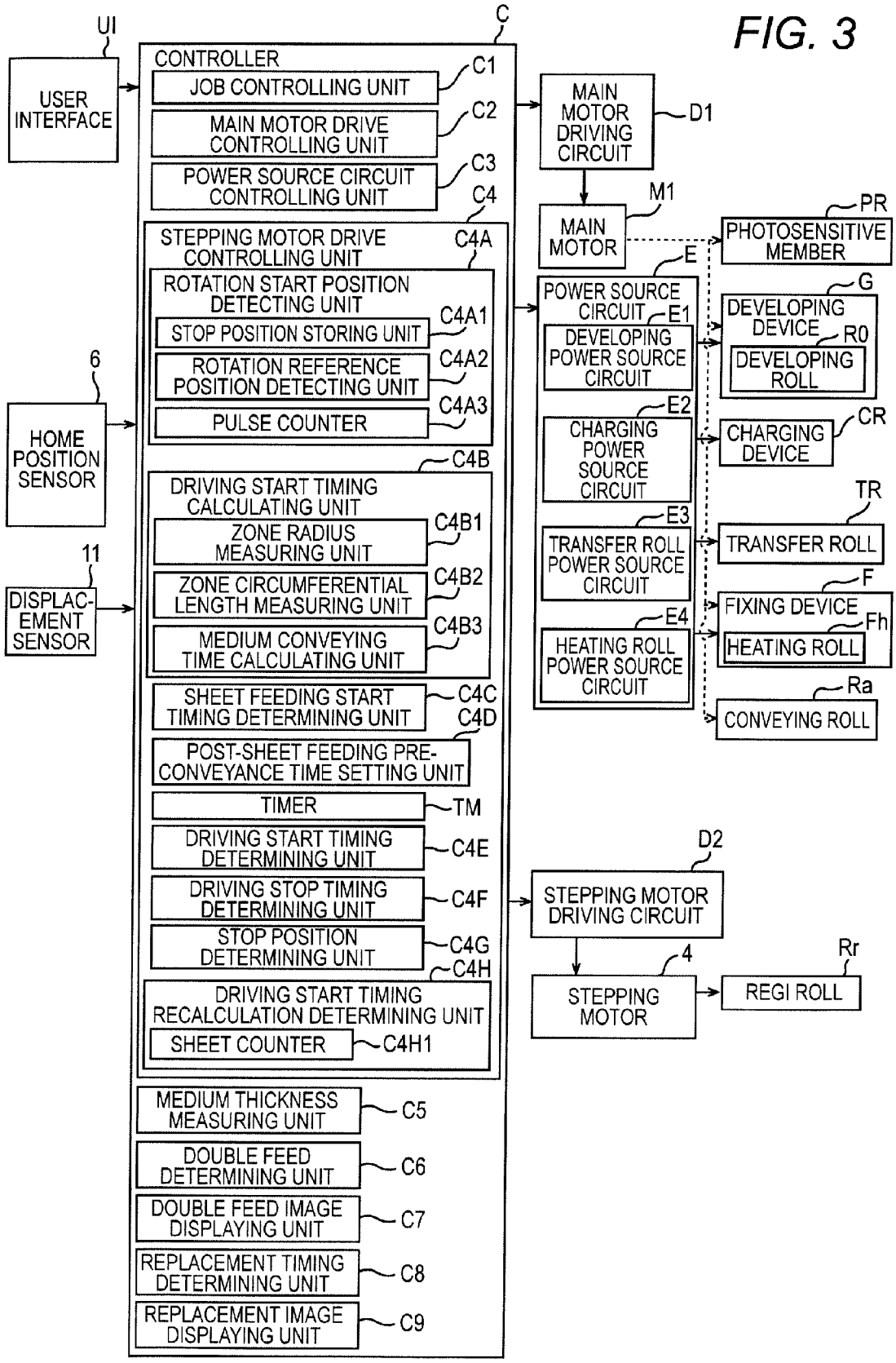
FIG. 3
UI
USER INTERFACE
C
CONTROLLER
JOB CONTROLLING UNIT
C1
MAIN MOTOR DRIVE CONTROLLING UNIT
C2
POWER SOURCE CIRCUIT CONTROLLING UNIT
C3
C4
STEPPING MOTOR DRIVE CONTROLLING UNIT
C4A
ROTATION START POSITION DETECTING UNIT
STOP POSITION STORING UNIT
C4A1
ROTATION REFERENCE POSITION DETECTING UNIT
C4A2
PULSE COUNTER
C4A3
6
HOME POSITION SENSOR
C4B
DRIVING START TIMING CALCULATING UNIT
ZONE RADIUS MEASURING UNIT
C4B1
ZONE CIRCUMFERENTIAL LENGTH MEASURING UNIT
C4B2
MEDIUM CONVEYING TIME CALCULATING UNIT
C4B3
11
DISPLACEMENT SENSOR
SHEET FEEDING START TIMING DETERMINING UNIT
C4C
C4D
POST-SHEET FEEDING PRE-CONVEYANCE TIME SETTING UNIT
TIMER
TM
DRIVING START TIMING DETERMINING UNIT
C4E
DRIVING STOP TIMING DETERMINING UNIT
C4F
STOP POSITION DETERMINING UNIT
C4G
C4H
DRIVING START TIMING RECALCULATION DETERMINING UNIT
SHEET COUNTER
C4H1
MEDIUM THICKNESS MEASURING UNIT
C5
DOUBLE FEED DETERMINING UNIT
C6
DOUBLE FEED IMAGE DISPLAYING UNIT
C7
REPLACEMENT TIMING DETERMINING UNIT
C8
REPLACEMENT IMAGE DISPLAYING UNIT
C9
MAIN MOTOR DRIVING CIRCUIT
D1
M1
MAIN MOTOR
PR
PHOTOSENSITIVE MEMBER
E
POWER SOURCE CIRCUIT
E1
DEVELOPING POWER SOURCE CIRCUIT
G
DEVELOPING DEVICE
R0
DEVELOPING ROLL
E2
CHARGING POWER SOURCE CIRCUIT
CHARGING DEVICE
CR
E3
TRANSFER ROLL POWER SOURCE CIRCUIT
TR
TRANSFER ROLL
F
FIXING DEVICE
Fh
E4
HEATING ROLL POWER SOURCE CIRCUIT
HEATING ROLL
Ra
CONVEYING ROLL
D2
STEPPING MOTOR DRIVING CIRCUIT
4
STEPPING MOTOR
Rr
REGI ROLL

FIG. 5

DIAMETER OF ROLL IS DESIGNED TO $\phi$20

DESIGNED VALUES OF ZONE RADII

| | AVERAGE r | ZONE CIRCUMFERENTIAL LENGTH |
|---|---|---|
| Pa-Pb | 10 | 15.71 |
| Pb-Pc | 10 | 15.71 |
| Pc-Pd | 10 | 15.71 |
| Pd-Pa | 10 | 15.71 |
| ONE ROUND | | 62.83 |

RESULTS OF MEASUREMENT OF ECCENTRICITY

| | AVERAGE r | ZONE CIRCUMFERENTIAL LENGTH |
|---|---|---|
| Pa-Pb | 10.5 | 16.49 |
| Pb-Pc | 9.2 | 14.45 |
| Pc-Pd | 10 | 15.71 |
| Pd-Pa | 10 | 15.71 |
| ONE ROUND | 9.9 | 62.36 |

DESIGNED VALUES OF ZONE RADII

| | REMAINING LENGTH $\Delta L$ (mm) AFTER 1.5 ROTATIONS | REMAINING ANGLE $\Delta\theta$ (deg) | MEDIUM CONVEYING TIME TM1a (ms) |
|---|---|---|---|
| WHEN STARTED FROM Pa | 5.75 | 33.0 | 159.2 |
| WHEN STARTED FROM Pb | 5.75 | 33.0 | 159.2 |
| WHEN STARTED FROM Pc | 5.75 | 33.0 | 159.2 |
| WHEN STARTED FROM Pd | 5.75 | 33.0 | 159.2 |

ECCENTRICITY IS CONSIDERED

| | REMAINING LENGTH $\Delta L$ (mm) AFTER 1.5 ROTATIONS | REMAINING ANGLE $\Delta\theta$ (deg) | MEDIUM CONVEYING TIME TM1a (ms) | TIME DIFFERENCE (ms) FROM DESIGNED VALUE |
|---|---|---|---|---|
| WHEN STARTED FROM Pa | 6.69 | 38.4 | 160.7 | 1.5 |
| WHEN STARTED FROM Pb | 7.48 | 42.9 | 161.9 | 2.8 |
| WHEN STARTED FROM Pc | 6.22 | 34.0 | 159.4 | 0.3 |
| WHEN STARTED FROM Pd | 5.44 | 33.9 | 159.4 | 0.3 |

POST-SHEET FEEDING PRE-CONVEYANCE TIME TABLE

| | THICK SHEET (MS) | ORDINARY SHEET (MS) |
|---|---|---|
| DESIGN REFERENCE VALUE | 1000. 0 | 1001. 0 |
| STARTED FROM Pa | 998. 5 | 999. 5 |
| STARTED FROM Pb | 997. 3 | 998. 3 |
| STARTED FROM Pc | 999. 7 | 1000. 7 |
| STARTED FROM Pd | 999. 7 | 1000. 7 |

FLOWCHART OF DRIVING START TIMING CALCULATION PROCESS
(SUBROUTINE OF ST1 AND ST16)

FLOWCHART OF ZONE CIRCUMFERENTIAL LENGTH MEASUREMENT PROCESS (SUBROUTINE OF ST21)

r : SET VALUE OF RADIUS OF DRIVING ROLLER Rr1 IN PRODUCT SHIPMENT r' : AVERAGE OF RADII OF DRIVING ROLLER Rr1 WHICH IS WORN AFTER OPERATION $$\begin{cases} \frac{\pi}{2} r = d \\ r' \ (Rta) = d \\ r\,(Rt) = d \end{cases}$$

$$\frac{r'}{r} \cdot \frac{ta}{t} = 1$$

$$r' = r \cdot \frac{t}{ta}$$

$$L_{ab} \fallingdotseq \frac{\pi}{2} \cdot r' = \frac{\pi}{2} \cdot r \frac{t}{ta} = d \frac{t}{ta}$$

FLOWCHART OF DRIVING START TIMING CALCULATION PROCESS (SUBROUTINE OF ST16')

FIG. 19

DIAMETER OF ROLL IS DESIGNED TO $\phi$20

DESIGNED VALUES OF ZONE RADII

| | AVERAGE r | ZONE CIRCUMFERENTIAL LENGTH |
|---|---|---|
| Pa-Pb | 10 | 15.71 |
| Pb-Pc | 10 | 15.71 |
| Pc-Pd | 10 | 15.71 |
| Pd-Pa | 10 | 15.71 |
| ONE ROUND | | 62.83 |

RESULTS OF MEASUREMENT OF ECCENTRICITY

| | AVERAGE r | ZONE CIRCUMFERENTIAL LENGTH |
|---|---|---|
| Pa-Pb | 10 | 15.71 |
| Pb-Pc | 8.7 | 13.67 |
| Pc-Pd | 9.5 | 14.92 |
| Pd-Pa | 9.5 | 14.92 |
| ONE ROUND | 9.4 | 59.22 |

ROTATIONAL SPEED V OF ROLL

DESIGNED VALUES R=10rps

| | REMAINING LENGTH $\Delta$L (mm) AFTER 1.5 ROTATIONS | REMAINING ANGLE $\Delta\theta$ (deg) | MEDIUM CONVEYING TIME TM1a (ms) |
|---|---|---|---|
| WHEN STARTED FROM Pa | 5.75 | 33.0 | 159.2 |
| WHEN STARTED FROM Pb | 5.75 | 33.0 | 159.2 |
| WHEN STARTED FROM Pc | 5.75 | 33.0 | 159.2 |
| WHEN STARTED FROM Pd | 5.75 | 33.0 | 159.2 |

AFTER CHANGE R' = 10.6 rps

ECCENTRICITY IS CONSIDERED

| | REMAINING LENGTH $\Delta$L (mm) AFTER 1.5 ROTATIONS | REMAINING ANGLE $\Delta\theta$ (deg) | MEDIUM CONVEYING TIME TM1a (ms) | TIME DIFFERENCE (ms) FROM DESIGNED VALUE |
|---|---|---|---|---|
| WHEN STARTED FROM Pa | 11.41 | 68.8 | 159.4 | 0.2 |
| WHEN STARTED FROM Pb | 12.19 | 73.5 | 160.6 | 1.5 |
| WHEN STARTED FROM Pc | 10.94 | 62.7 | 157.6 | 1.4 |
| WHEN STARTED FROM Pd | 10.15 | 66.8 | 158.9 | 0.3 |

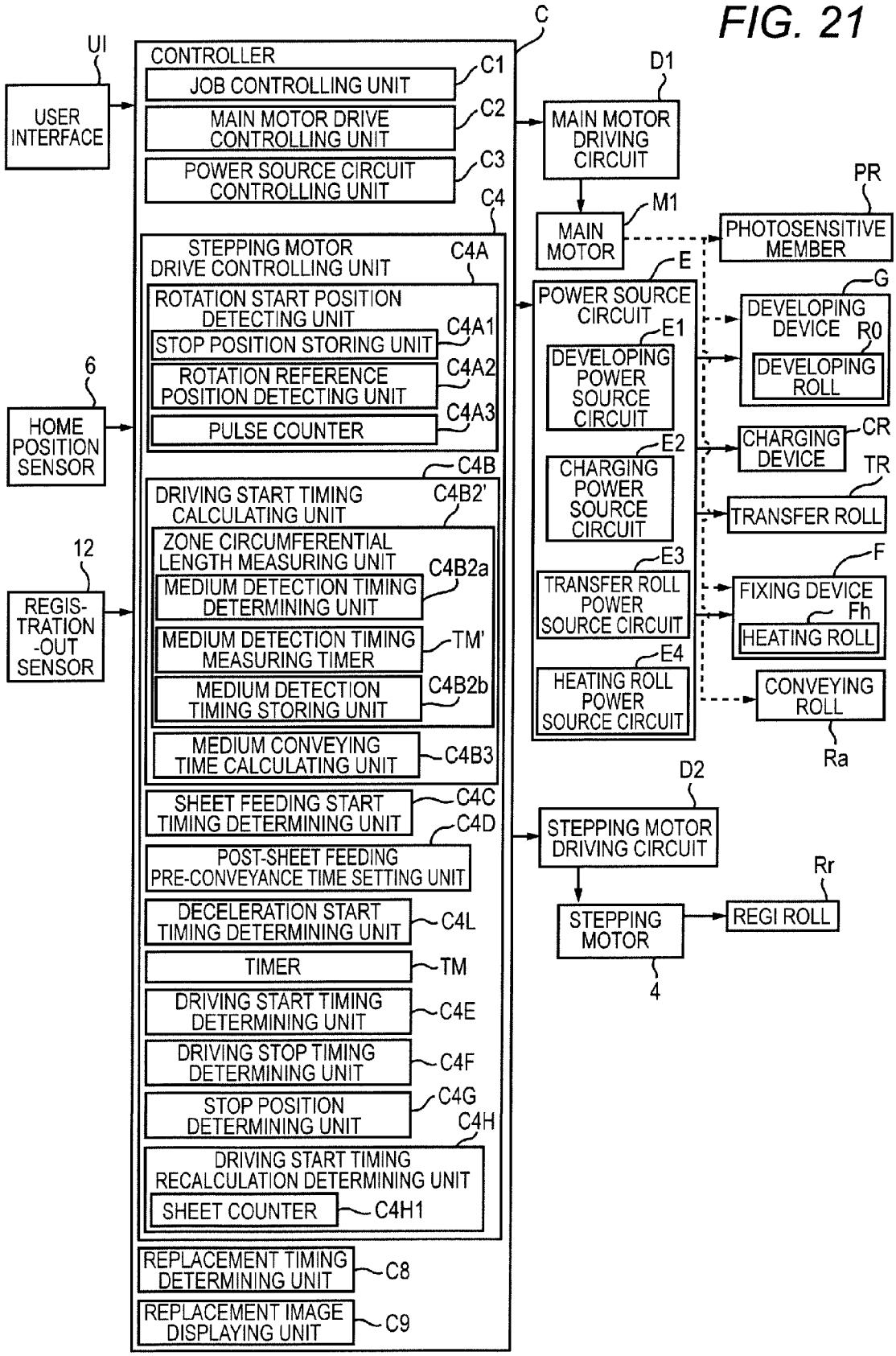
FIG. 21
C
UI
USER INTERFACE
CONTROLLER
JOB CONTROLLING UNIT
C1
MAIN MOTOR DRIVE CONTROLLING UNIT
C2
POWER SOURCE CIRCUIT CONTROLLING UNIT
C3
C4
STEPPING MOTOR DRIVE CONTROLLING UNIT
C4A
ROTATION START POSITION DETECTING UNIT
STOP POSITION STORING UNIT
C4A1
ROTATION REFERENCE POSITION DETECTING UNIT
C4A2
PULSE COUNTER
C4A3
6
HOME POSITION SENSOR
C4B
DRIVING START TIMING CALCULATING UNIT
C4B2'
ZONE CIRCUMFERENTIAL LENGTH MEASURING UNIT
MEDIUM DETECTION TIMING DETERMINING UNIT
C4B2a
MEDIUM DETECTION TIMING MEASURING TIMER
TM'
MEDIUM DETECTION TIMING STORING UNIT
C4B2b
MEDIUM CONVEYING TIME CALCULATING UNIT
C4B3
12
REGIS-TRATION -OUT SENSOR
SHEET FEEDING START TIMING DETERMINING UNIT
C4C
POST-SHEET FEEDING PRE-CONVEYANCE TIME SETTING UNIT
C4D
DECELERATION START TIMING DETERMINING UNIT
C4L
TIMER
TM
DRIVING START TIMING DETERMINING UNIT
C4E
DRIVING STOP TIMING DETERMINING UNIT
C4F
STOP POSITION DETERMINING UNIT
C4G
C4H
DRIVING START TIMING RECALCULATION DETERMINING UNIT
SHEET COUNTER
C4H1
REPLACEMENT TIMING DETERMINING UNIT
C8
REPLACEMENT IMAGE DISPLAYING UNIT
C9
D1
MAIN MOTOR DRIVING CIRCUIT
M1
MAIN MOTOR
PR
PHOTOSENSITIVE MEMBER
E
POWER SOURCE CIRCUIT
E1
DEVELOPING POWER SOURCE CIRCUIT
E2
CHARGING POWER SOURCE CIRCUIT
E3
TRANSFER ROLL POWER SOURCE CIRCUIT
E4
HEATING ROLL POWER SOURCE CIRCUIT
G
DEVELOPING DEVICE
R0
DEVELOPING ROLL
CR
CHARGING DEVICE
TR
TRANSFER ROLL
F
FIXING DEVICE
Fh
HEATING ROLL
CONVEYING ROLL
Ra
D2
STEPPING MOTOR DRIVING CIRCUIT
Rr
STEPPING MOTOR
REGI ROLL
4

FIG. 23

DIAMETER OF ROLL IS DESIGNED TO $\phi$20

DESIGNED VALUES OF ZONE RADII

| | AVERAGE r | ZONE CIRCUMFERENTIAL LENGTH |
|---|---|---|
| Pa-Pb | 10 | 15.71 |
| Pb-Pc | 10 | 15.71 |
| Pc-Pd | 10 | 15.71 |
| Pd-Pa | 10 | 15.71 |
| ONE ROUND | | 62.83 |

RESULTS OF MEASUREMENT OF ECCENTRICITY

| | AVERAGE r | ZONE CIRCUMFERENTIAL LENGTH |
|---|---|---|
| Pa-Pb | 10.5 | 16.49 |
| Pb-Pc | 9.2 | 14.45 |
| Pc-Pd | 10 | 15.71 |
| Pd-Pa | 10 | 15.71 |
| ONE ROUND | 9.9 | 62.36 |

DESIGNED VALUES OF ZONE RADII

| | REMAINING LENGTH $\Delta L$ (mm) AFTER 1.5 ROTATIONS | REMAINING ANGLE $\Delta\theta$ (deg) | MEDIUM CONVEYING TIME TM1a (ms) |
|---|---|---|---|
| WHEN STARTED FROM Pa | 5.75 | 33.0 | 109.2 |
| WHEN STARTED FROM Pb | 5.75 | 33.0 | 109.2 |
| WHEN STARTED FROM Pc | 5.75 | 33.0 | 109.2 |
| WHEN STARTED FROM Pd | 5.75 | 33.0 | 109.2 |

ECCENTRICITY IS CONSIDERED

| | REMAINING LENGTH $\Delta L$ (mm) AFTER 1.5 ROTATIONS | REMAINING ANGLE $\Delta\theta$ (deg) | MEDIUM CONVEYING TIME TM1a (ms) | TIME DIFFERENCE (ms) FROM DESIGNED VALUE |
|---|---|---|---|---|
| WHEN STARTED FROM Pa | 6.69 | 38.4 | 110.7 | 1.5 |
| WHEN STARTED FROM Pb | 7.48 | 42.9 | 111.9 | 2.8 |
| WHEN STARTED FROM Pc | 6.22 | 34.0 | 109.4 | 0.3 |
| WHEN STARTED FROM Pd | 5.44 | 33.9 | 109.4 | 0.3 |

DESIGNED VALUES (FOR REFERENCE) OF ZONE RADII

| | MEDIUM DETECTION TIME TM3a (ms) |
|---|---|
| WHEN STARTED FROM Pa | 25.01 |
| WHEN STARTED FROM Pb | 25.01 |
| WHEN STARTED FROM Pc | 25.01 |
| WHEN STARTED FROM Pd | 25.01 |

ECCENTRICITY IS CONSIDERED (FOR REFERENCE)

| | MEDIUM DETECTION TIME TM3a (ms) |
|---|---|
| WHEN STARTED FROM Pa | 26.37 |
| WHEN STARTED FROM Pb | 23.01 |
| WHEN STARTED FROM Pc | 25.01 |
| WHEN STARTED FROM Pd | 25.01 |

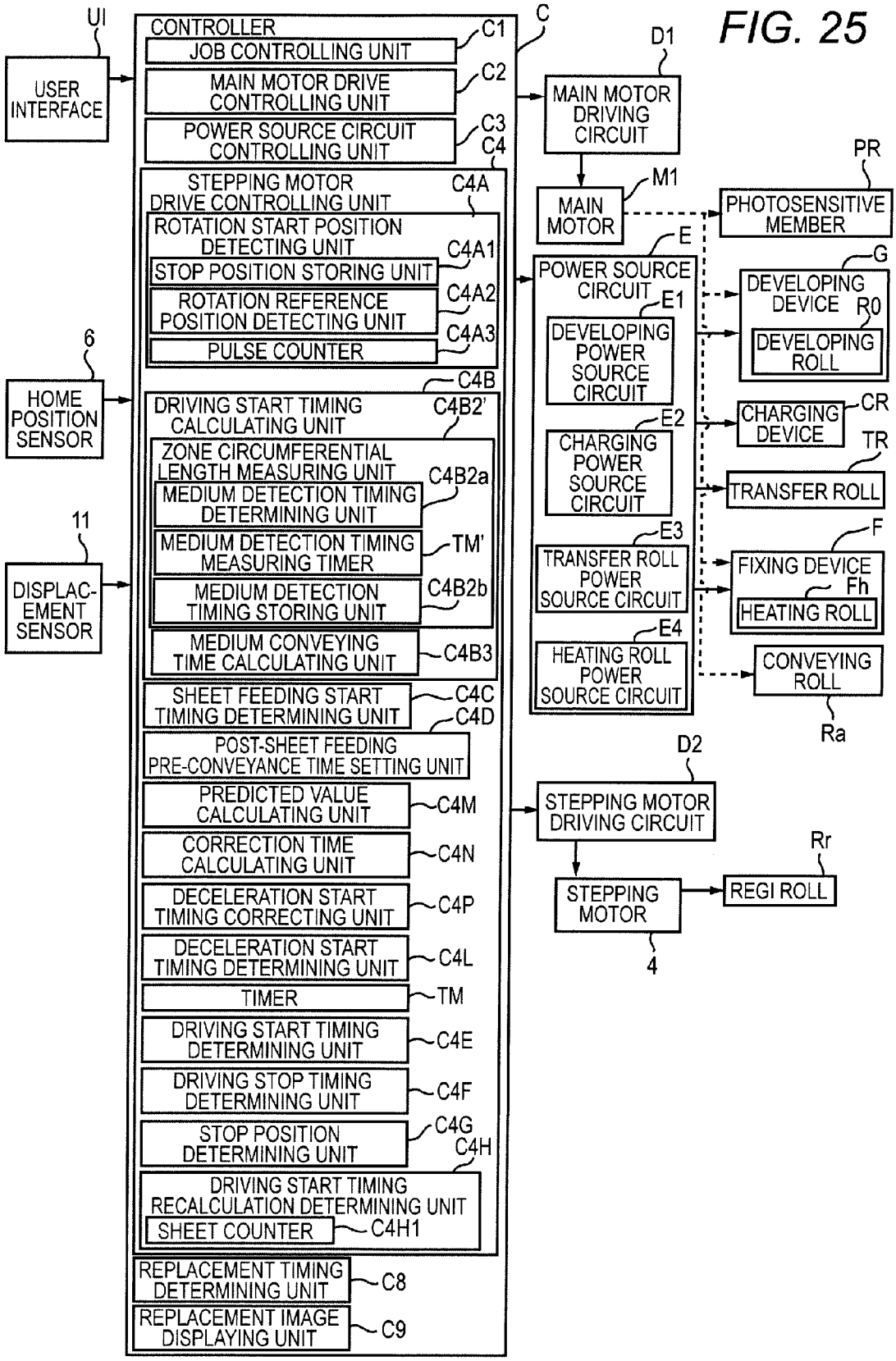
FIG. 25
UI
USER INTERFACE
CONTROLLER
C1
JOB CONTROLLING UNIT
C2
MAIN MOTOR DRIVE CONTROLLING UNIT
C3
POWER SOURCE CIRCUIT CONTROLLING UNIT
C4
STEPPING MOTOR DRIVE CONTROLLING UNIT
C4A
ROTATION START POSITION DETECTING UNIT
C4A1
STOP POSITION STORING UNIT
C4A2
ROTATION REFERENCE POSITION DETECTING UNIT
C4A3
PULSE COUNTER
6
HOME POSITION SENSOR
C4B
DRIVING START TIMING CALCULATING UNIT
C4B2'
ZONE CIRCUMFERENTIAL LENGTH MEASURING UNIT
C4B2a
MEDIUM DETECTION TIMING DETERMINING UNIT
TM'
MEDIUM DETECTION TIMING MEASURING TIMER
C4B2b
MEDIUM DETECTION TIMING STORING UNIT
11
DISPLACEMENT SENSOR
C4B3
MEDIUM CONVEYING TIME CALCULATING UNIT
C4C
SHEET FEEDING START TIMING DETERMINING UNIT
C4D
POST-SHEET FEEDING PRE-CONVEYANCE TIME SETTING UNIT
C4M
PREDICTED VALUE CALCULATING UNIT
C4N
CORRECTION TIME CALCULATING UNIT
C4P
DECELERATION START TIMING CORRECTING UNIT
C4L
DECELERATION START TIMING DETERMINING UNIT
TM
TIMER
C4E
DRIVING START TIMING DETERMINING UNIT
C4F
DRIVING STOP TIMING DETERMINING UNIT
C4G
STOP POSITION DETERMINING UNIT
C4H
DRIVING START TIMING RECALCULATION DETERMINING UNIT
C4H1
SHEET COUNTER
C8
REPLACEMENT TIMING DETERMINING UNIT
C9
REPLACEMENT IMAGE DISPLAYING UNIT
C
D1
MAIN MOTOR DRIVING CIRCUIT
M1
MAIN MOTOR
PR
PHOTOSENSITIVE MEMBER
E
POWER SOURCE CIRCUIT
E1
DEVELOPING POWER SOURCE CIRCUIT
E2
CHARGING POWER SOURCE CIRCUIT
E3
TRANSFER ROLL POWER SOURCE CIRCUIT
E4
HEATING ROLL POWER SOURCE CIRCUIT
G
DEVELOPING DEVICE
R0
DEVELOPING ROLL
CR
CHARGING DEVICE
TR
TRANSFER ROLL
F
FIXING DEVICE
Fh
HEATING ROLL
CONVEYING ROLL
Ra
D2
STEPPING MOTOR DRIVING CIRCUIT
STEPPING MOTOR
4
Rr
REGI ROLL

FIG. 28

[ms]

| | MEDIUM DETECTION TIME | | DIFFERENCE x | DECELERATION START TIMING T5' |
|---|---|---|---|---|
| | PREDICTED VALUE TM3a | MEASURED VALUE T | | |
| DESIGNED VALUE | 25.01 | — | — | 50 |
| STARTED FROM Pa | 26.37 | T | T−26.37 | 50+x |
| STARTED FROM Pb | 23.01 | T | T−23.01 | 50+x |
| STARTED FROM Pc | 25.01 | T | T−25.01 | 50+x |
| STARTED FROM Pd | 25.01 | T | T−25.01 | 50+x |

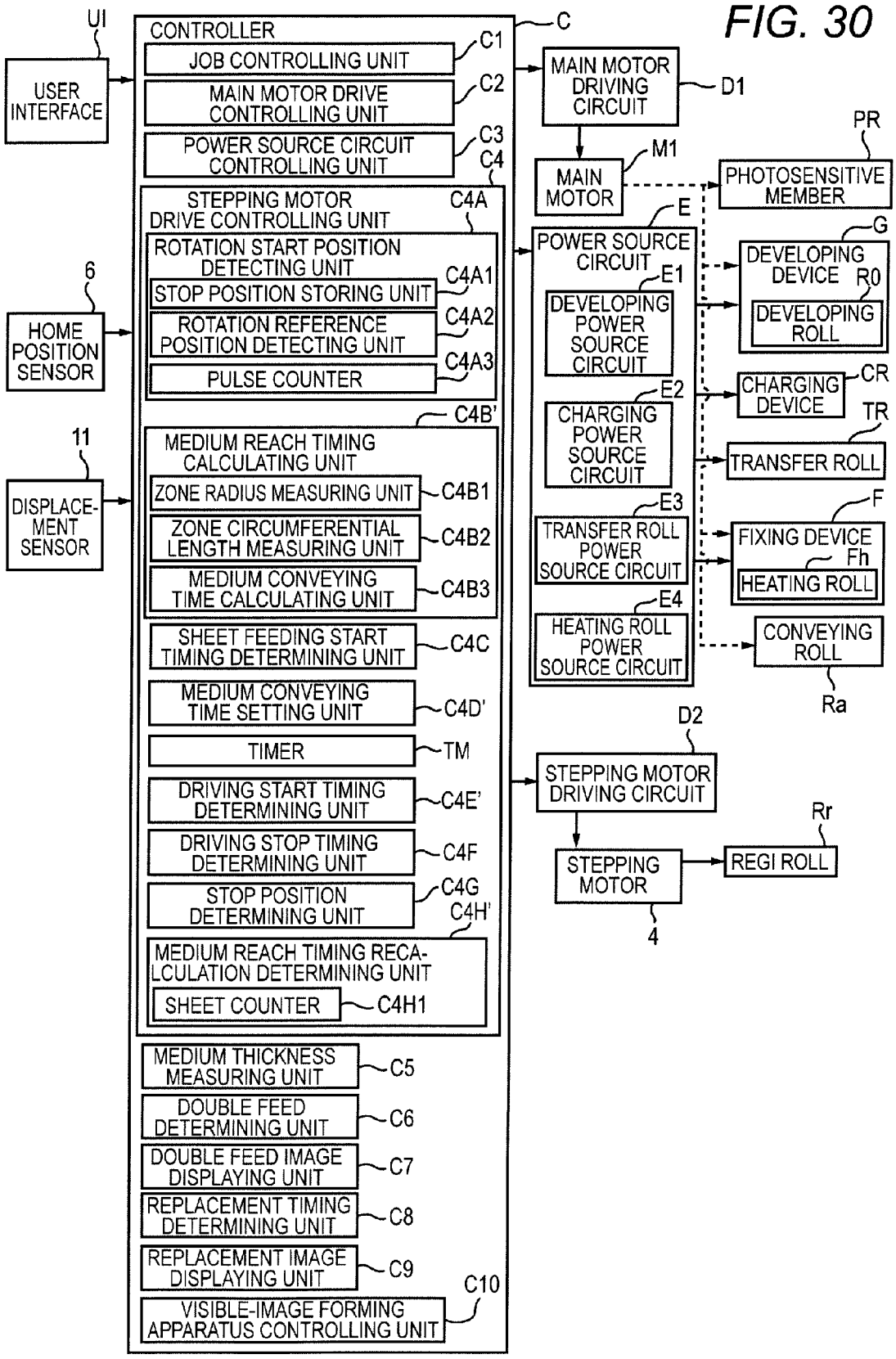
FIG. 30
UI
USER INTERFACE
CONTROLLER
C
JOB CONTROLLING UNIT
C1
MAIN MOTOR DRIVE CONTROLLING UNIT
C2
POWER SOURCE CIRCUIT CONTROLLING UNIT
C3
C4
STEPPING MOTOR DRIVE CONTROLLING UNIT
C4A
ROTATION START POSITION DETECTING UNIT
STOP POSITION STORING UNIT
C4A1
ROTATION REFERENCE POSITION DETECTING UNIT
C4A2
PULSE COUNTER
C4A3
6
HOME POSITION SENSOR
11
DISPLACE-MENT SENSOR
C4B'
MEDIUM REACH TIMING CALCULATING UNIT
ZONE RADIUS MEASURING UNIT
C4B1
ZONE CIRCUMFERENTIAL LENGTH MEASURING UNIT
C4B2
MEDIUM CONVEYING TIME CALCULATING UNIT
C4B3
SHEET FEEDING START TIMING DETERMINING UNIT
C4C
MEDIUM CONVEYING TIME SETTING UNIT
C4D'
TIMER
TM
DRIVING START TIMING DETERMINING UNIT
C4E'
DRIVING STOP TIMING DETERMINING UNIT
C4F
STOP POSITION DETERMINING UNIT
C4G
C4H'
MEDIUM REACH TIMING RECA-LCULATION DETERMINING UNIT
SHEET COUNTER
C4H1
MEDIUM THICKNESS MEASURING UNIT
C5
DOUBLE FEED DETERMINING UNIT
C6
DOUBLE FEED IMAGE DISPLAYING UNIT
C7
REPLACEMENT TIMING DETERMINING UNIT
C8
REPLACEMENT IMAGE DISPLAYING UNIT
C9
C10
VISIBLE-IMAGE FORMING APPARATUS CONTROLLING UNIT
MAIN MOTOR DRIVING CIRCUIT
D1
M1
MAIN MOTOR
PR
PHOTOSENSITIVE MEMBER
E
POWER SOURCE CIRCUIT
E1
DEVELOPING POWER SOURCE CIRCUIT
E2
CHARGING POWER SOURCE CIRCUIT
E3
TRANSFER ROLL POWER SOURCE CIRCUIT
E4
HEATING ROLL POWER SOURCE CIRCUIT
G
DEVELOPING DEVICE
R0
DEVELOPING ROLL
CHARGING DEVICE
CR
TR
TRANSFER ROLL
F
FIXING DEVICE
Fh
HEATING ROLL
CONVEYING ROLL
Ra
D2
STEPPING MOTOR DRIVING CIRCUIT
Rr
STEPPING MOTOR
REGI ROLL
4

FIG. 31

SHEET FEEDING CONVEYANCE TIME TABLE

| | THICK SHEET (ms) | ORDINARY SHEET (ms) |
|---|---|---|
| DESIGN REFERENCE VALUE | 160. 2 | 159. 2 |
| STARTED FROM Pa | 161. 7 | 160. 7 |
| STARTED FROM Pb | 162. 9 | 161. 9 |
| STARTED FROM Pc | 160. 4 | 159. 4 |
| STARTED FROM Pd | 160. 4 | 159. 4 |

FLOWCHART OF MEDIUM REACH TIMING CALCULATION PROCESS
(SUBROUTINE OF ST1' AND ST16")

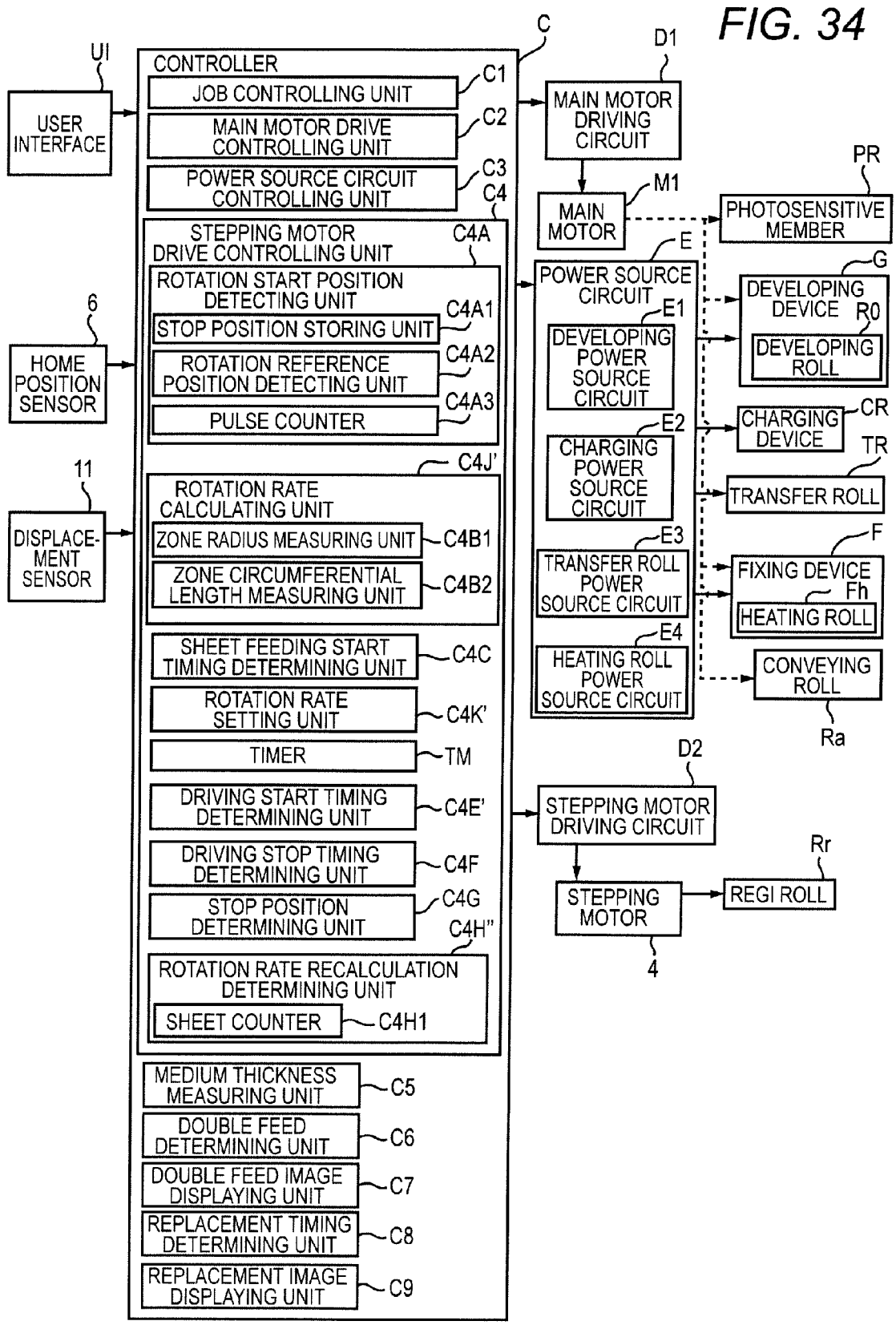
FIG. 34
C
UI
USER INTERFACE
CONTROLLER
JOB CONTROLLING UNIT
C1
MAIN MOTOR DRIVE CONTROLLING UNIT
C2
POWER SOURCE CIRCUIT CONTROLLING UNIT
C3
C4
STEPPING MOTOR DRIVE CONTROLLING UNIT
C4A
ROTATION START POSITION DETECTING UNIT
C4A1
STOP POSITION STORING UNIT
C4A2
ROTATION REFERENCE POSITION DETECTING UNIT
C4A3
PULSE COUNTER
6
HOME POSITION SENSOR
11
DISPLACE-MENT SENSOR
C4J'
ROTATION RATE CALCULATING UNIT
ZONE RADIUS MEASURING UNIT
C4B1
ZONE CIRCUMFERENTIAL LENGTH MEASURING UNIT
C4B2
SHEET FEEDING START TIMING DETERMINING UNIT
C4C
ROTATION RATE SETTING UNIT
C4K'
TIMER
TM
DRIVING START TIMING DETERMINING UNIT
C4E'
DRIVING STOP TIMING DETERMINING UNIT
C4F
STOP POSITION DETERMINING UNIT
C4G
C4H"
ROTATION RATE RECALCULATION DETERMINING UNIT
SHEET COUNTER
C4H1
MEDIUM THICKNESS MEASURING UNIT
C5
DOUBLE FEED DETERMINING UNIT
C6
DOUBLE FEED IMAGE DISPLAYING UNIT
C7
REPLACEMENT TIMING DETERMINING UNIT
C8
REPLACEMENT IMAGE DISPLAYING UNIT
C9
D1
MAIN MOTOR DRIVING CIRCUIT
M1
MAIN MOTOR
PR
PHOTOSENSITIVE MEMBER
E
POWER SOURCE CIRCUIT
E1
DEVELOPING POWER SOURCE CIRCUIT
E2
CHARGING POWER SOURCE CIRCUIT
E3
TRANSFER ROLL POWER SOURCE CIRCUIT
E4
HEATING ROLL POWER SOURCE CIRCUIT
G
DEVELOPING DEVICE
R0
DEVELOPING ROLL
CR
CHARGING DEVICE
TR
TRANSFER ROLL
F
FIXING DEVICE
Fh
HEATING ROLL
CONVEYING ROLL
Ra
D2
STEPPING MOTOR DRIVING CIRCUIT
Rr
STEPPING MOTOR
REGI ROLL
4

FIG. 35

DIAMETER OF ROLL IS DESIGNED TO $\phi$20

DESIGNED VALUES OF ZONE RADII

| | AVERAGE r | ZONE CIRCUMFERENTIAL LENGTH |
|---|---|---|
| Pa-Pb | 10 | 15.71 |
| Pb-Pc | 10 | 15.71 |
| Pc-Pd | 10 | 15.71 |
| Pd-Pa | 10 | 15.71 |
| ONE ROUND | | 62.83 |

RESULTS OF MEASUREMENT OF ECCENTRICITY

| | AVERAGE r | ZONE CIRCUMFERENTIAL LENGTH |
|---|---|---|
| Pa-Pb | 10.5 | 16.49 |
| Pb-Pc | 9.2 | 14.45 |
| Pc-Pd | 10 | 15.71 |
| Pd-Pa | 10 | 15.71 |
| ONE ROUND | 9.9 | 62.36 |

DESIGNED VALUES OF ZONE RADII

| | REMAINING LENGTH $\Delta L$ (mm) AFTER 1.5 ROTATIONS | REMAINING ANGLE $\Delta\theta$ (deg) | MEDIUM CONVEYING TIME TM1a (ms) |
|---|---|---|---|
| WHEN STARTED FROM Pa | 5.75 | 33.0 | 159.2 |
| WHEN STARTED FROM Pb | 5.75 | 33.0 | 159.2 |
| WHEN STARTED FROM Pc | 5.75 | 33.0 | 159.2 |
| WHEN STARTED FROM Pd | 5.75 | 33.0 | 159.2 |

ECCENTRICITY IS CONSIDERED

| | REMAINING LENGTH $\Delta L$ (mm) AFTER 1.5 ROTATIONS | REMAINING ANGLE $\Delta\theta$ (deg) | ROTATION RATE R" (rps) |
|---|---|---|---|
| WHEN STARTED FROM Pa | 6.69 | 38.4 | 10.09 |
| WHEN STARTED FROM Pb | 7.48 | 42.9 | 10.17 |
| WHEN STARTED FROM Pc | 6.22 | 34.0 | 10.02 |
| WHEN STARTED FROM Pd | 5.44 | 33.9 | 10.01 |

FLOWCHART OF ROTATION RATE CALCULATION PROCESS
(SUBROUTINE OF ST1" AND ST105)

$$\frac{540+\Delta\theta}{360} = TM4' \times R2 + \frac{1}{2} \times TM6 \times (R2+R1) + \{TM1a-(TM4'+TM6)\} \times R1$$

$$= TM4' \times (R2-R1) + TM6 \times \left(\frac{R2}{2} + \frac{R1}{2} - R1\right) + TM1a \times R1$$

$$TM4' = \frac{540+\Delta\theta}{360} \times \frac{1}{R2-R1} - TM1a \times \frac{R1}{R2-R1} - TM6 \times \frac{1}{2}$$

FIG. 40

DIAMETER OF ROLL IS DESIGNED TO $\phi$20

DESIGNED VALUES OF ZONE RADII

| | AVERAGE r | ZONE CIRCUMFERENTIAL LENGTH |
|---|---|---|
| Pa-Pb | 10 | 15.71 |
| Pb-Pc | 10 | 15.71 |
| Pc-Pd | 10 | 15.71 |
| Pd-Pa | 10 | 15.71 |
| ONE ROUND | | 62.83 |

RESULTS OF MEASUREMENT OF ECCENTRICITY

| | AVERAGE r | ZONE CIRCUMFERENTIAL LENGTH |
|---|---|---|
| Pa-Pb | 10.5 | 16.49 |
| Pb-Pc | 9.2 | 14.45 |
| Pc-Pd | 10 | 15.71 |
| Pd-Pa | 10 | 15.71 |
| ONE ROUND | 9.9 | 62.36 |

DESIGNED VALUES OF ZONE RADII

| | REMAINING LENGTH $\Delta L$ (mm) AFTER 1.5 ROTATIONS | REMAINING ANGLE $\Delta\theta$ (deg) | MEDIUM CONVEYING TIME TM1a (ms) |
|---|---|---|---|
| WHEN STARTED FROM Pa | 5.75 | 33.0 | 159.2 |
| WHEN STARTED FROM Pb | 5.75 | 33.0 | 159.2 |
| WHEN STARTED FROM Pc | 5.75 | 33.0 | 159.2 |
| WHEN STARTED FROM Pd | 5.75 | 33.0 | 159.2 |

ECCENTRICITY IS CONSIDERED

| | REMAINING LENGTH $\Delta L$ (mm) AFTER 1.5 ROTATIONS | REMAINING ANGLE $\Delta\theta$ (deg) | HIGH-SPEED ROTATION TIME TM4' (ms) |
|---|---|---|---|
| WHEN STARTED FROM Pa | 6.69 | 38.4 | 51.47 |
| WHEN STARTED FROM Pb | 7.48 | 42.9 | 52.72 |
| WHEN STARTED FROM Pc | 6.22 | 34.0 | 50.24 |
| WHEN STARTED FROM Pd | 5.44 | 33.9 | 50.22 |

FIG. 41

HIGH-SPEED ROTATION TIME TABLE

| | THICK SHEET (ms) | ORDINARY SHEET (ms) |
|---|---|---|
| DESIGN REFERENCE VALUE | 50.50 | 50.00 |
| STARTED FROM Pa | 51.97 | 51.47 |
| STARTED FROM Pb | 53.22 | 52.72 |
| STARTED FROM Pc | 50.74 | 50.24 |
| STARTED FROM Pd | 50.72 | 50.22 |

MEDIUM CONVEYING APPARATUS AND IMAGE FORMING APPARATUS

CROSS-REFERENCE TO RELATED APPLICATIONS

This application is based on and claims priority under 35 USC 119 from Japanese Patent Application No. 2009-012178 filed on Jan. 22, 2009.

BACKGROUND

1. Technical Field

The present invention relates to a medium conveying apparatus and an image forming apparatus.

2. Related Art

In an image forming apparatus such as a copier and printer of the electrophotographic system, conventionally, a member is placed which is a so-called registration roll (hereinafter, often referred to as a regi roll), and which, when a medium is to be conveyed to an image recording region where an image is recorded, adjusts the timing when the medium is conveyed, the position where an image is recorded onto the medium, and the like.

SUMMARY

According to an aspect of the invention, there is provided a medium conveying apparatus including: a medium conveying member which conveys a medium; a rotation start position detecting unit which detects a plurality of rotation start positions that are preset in accordance with a central angle of the medium conveying member which is equally divided along a rotational direction of the medium conveying member;

a driving start timing determining unit which determines whether a time reaches a driving start timing when rotation driving by the medium conveying member is started or not; and a medium conveying member controlling unit which controls the rotation driving of the medium conveying member, and which, if it is determined that the time reaches the driving start timing and the rotation driving is started from one of the rotation start positions, the rotation driving is stopped at another one of the rotation start positions that is different from the rotation start position where the rotation driving is started, based on a result of the detection by the rotation start position detecting unit.

BRIEF DESCRIPTION OF THE DRAWINGS

Exemplary embodiments of the present invention will be described in detail based on the following figures, wherein:

FIG. 2A is a diagram of main portions of the regi roll and a transferring region, and FIG. 2B is a perspective diagram of a gear train for the regi roll;

FIG. 3 is a view showing functions of a controller of the image forming apparatus of Example 1 of the invention, in the form of a block diagram;

FIG. 5 is a view showing an example of medium conveying times in Example 1 of the invention, at respective rotation start positions in shipment of a product, and those at respective rotation start positions after operation;

FIG. 19 is a view showing an example of medium conveying times in Example 3 of the invention, at respective rotation start positions in shipment of a product, and those at respective rotation start positions after operation, and corresponding to FIG. 5 of Example 1;

FIG. 21 is a view showing functions of a controller of an image forming apparatus of Example 4 of the invention, in the form of a block diagram, and corresponding to FIG. 14 of Example 2;

FIG. 22A is a view in which the ordinate indicates a sheet conveying length, and the abscissa indicates the time, and which is an example of a graph showing the front end of the initial sheet in the medium conveying direction, the rear end of the initial sheet in the medium conveying direction, the front end of the next sheet in the medium conveying direction, and the rear end of the next sheet in the medium conveying direction, and FIG. 22B is an enlarged view of a graph showing the front end of the initial sheet in the medium conveying direction in the view of FIG. 22A illustrating the stepping motor driving control process;

FIG. 23 is a view showing an example of medium conveying times in Example 4 of the invention, at respective rotation start positions in shipment of a product, and those at respective rotation start positions after operation, and corresponding to FIG. 5 of Example 1;

FIG. 25 is a view showing functions of a controller of an image forming apparatus of Example 5 of the invention, in the form of a block diagram, and corresponding to FIG. 21 of Example 4;

FIG. 28 is a view illustrating correction of the deceleration start timing for each rotation start position;

FIG. 30 is a view showing functions of a controller of an image forming apparatus of Example 6 of the invention, in the form of a block diagram, and corresponding to FIG. 3 of Example 1;

FIG. 31 is a view showing a sheet feeding conveyance time table in Example 6 of the invention, and corresponding to FIG. 6 of Example 1;

FIG. 34 is a view showing functions of a controller of an image forming apparatus of Example 7 of the invention, in the form of a block diagram, and corresponding to FIG. 3 of Example 1;

FIG. 35 is a view showing an example of medium conveying times in Example 7 of the invention, at respective rotation start positions in shipment of a product, and rotation rates at respective rotation start positions after operation, and corresponding to FIG. 5 of Example 1;

FIG. 40 is a view showing an example of medium conveying times in Example 8 of the invention, at respective rotation start positions in shipment of a product, and high-speed rotation times at respective rotation start positions after operation, and corresponding to FIG. 23 of Example 4;

FIG. 41 is a view showing a high-speed rotation time table in Example 8 of the invention, and corresponding to FIG. 40;

DESCRIPTION OF REFERENCE NUMERALS AND SIGNS

Figure 1:
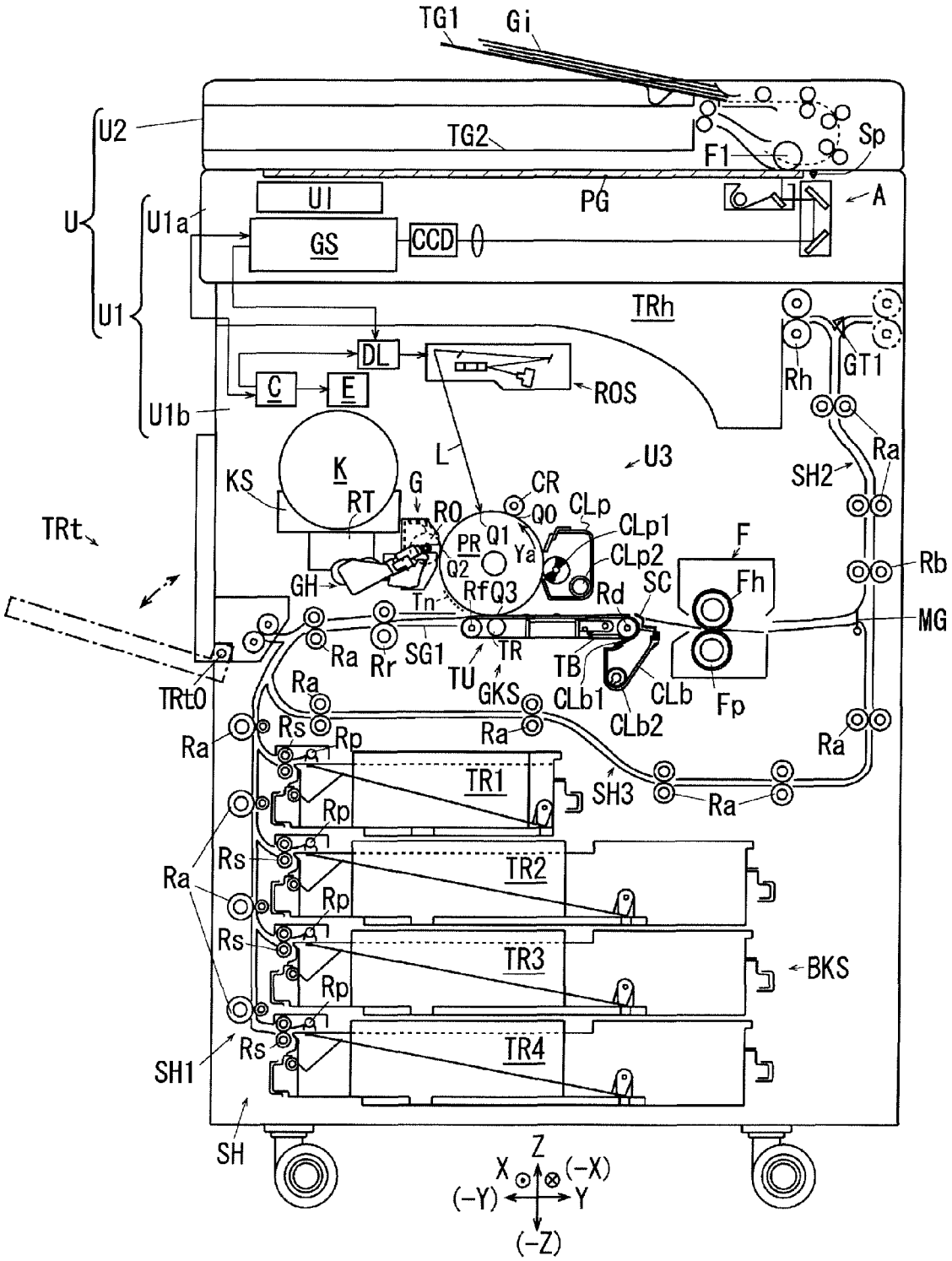
FIG. 1 is a diagram of the whole of an image forming apparatus of Example 1 of the invention.

4 . . . driving source, 5 . . . driving transmission system, 11 . . . displacement amount detecting member, 12 . . . medium detecting member, 102 . . . replacement image, 101 . . . double feed image, ave(Lab) to ave(Lda) . . . average of zone circumferential lengths in product shipment, {ave(Lab)−Lab} to {ave(Lda)−Lda} . . . difference of zone circumferential lengths, C4 . . . medium conveying member controlling unit, C4A . . . rotation start position detecting unit, C4B . . . driving start timing calculating unit, C4B' . . . medium reach timing calculating unit, C4B1 . . . zone radius measuring unit, C4B2, C4B2' . . . zone circumferential length measuring unit, C4B3 . . . medium conveying time calculating unit, C4E, C4E' . . . driving start timing determining unit, C4J, C4J' . . . rotation rate calculating unit, C4M . . . predicted value calculating unit, C4N . . . correction time calculating unit, C4P . . . deceleration start timing correcting unit, C4P' . . . deceleration start timing calculating unit, C5 . . . medium thickness measuring unit, C6 . . . double feed determining unit, C7 . . . double feed image displaying unit, C8 . . . replacement timing determining unit, C9 . . . replacement image displaying unit, d . . . thickness of medium, F . . . fixing device, GKS . . . image recording apparatus, i . . . input number of rectangular waves, L . . . medium conveying length, Lab to Lda . . . zone circumferential length, P3 . . . medium detection position, Pa to Pd . . . rotation start position, Q3 . . . conveyance destination, r . . . zone radius, R . . . rotation rate, R1 . . . normal rotation rate, R2 . . . high-speed rotation rate, Rr . . . medium conveying member, Rr1 . . . driving roller, Rr2 . . . driven roller, S . . . medium, Sd . . . threshold of medium thickness, SH . . . medium conveying apparatus, SL . . . threshold of difference of zone circumferential lengths, T1 . . . driving start timing, T2 . . . medium reach timing, T5, T5', T5" . . . deceleration start timing, ta to td, T . . . measured value of medium detection time, ta' to td' . . . predicted value of medium detection time, TM1 . . . medium conveying time, TM5 . . . correction time, U . . . image forming apparatus, x . . . difference between measured and predicted values of medium detection time.

DETAILED DESCRIPTION

Next, examples which are specific examples of an exemplary embodiment of the invention will be described with reference to the accompanying drawings. However, the invention is not restricted to the following examples.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "○" indicates the arrow which is directed from the rear of the sheet to the front, and that in which "×" is written in "○" indicates the arrow which is directed from the front of the sheet to the rear.

In the following description with reference to the drawings, illustrations of members other than those which are necessary in description are suitably omitted for the sake of easy understanding.

EXAMPLE 1

FIG. 1 is a diagram of the whole of an image forming apparatus of Example 1 of the invention.

Referring to FIG. 1, the image forming apparatus U includes a copier U1 which is an image forming apparatus body having a transparent original table PG on the upper face, and an automatic original conveying apparatus U2 which is detachably mounted on the original table PG.

The automatic original conveying apparatus U2 has an original feeding portion TG1 which stackingly houses a plurality of originals G1 to be copied, and which feeds the originals to a copy position. The plural originals G1 housed in the original feeding portion TG1 are sequentially passed over the copy position on the original table PG, and then discharged to an original discharging portion TG2.

The copier U1 has: a user interface UI that is an example of an operating portion into which the operator inputs instructions; an image reading portion U1*a* and image recording portion U1*b* which are sequentially arranged below the original table PG; and an image processing portion GS which is disposed in the image reading portion U1*a* or the image recording portion U1*b*.

The image reading portion U1*a* which is an original reading apparatus placed below the transparent original table PG on the upper face of the copier U1 has a platen range sensor Sp which is an example a reading position detecting member placed at an image reading position, and an exposing optical system A.

The movement and stopping of the exposing optical system A are controlled by a detection signal of the platen range sensor Sp, and the exposing optical system is normally stopped at a reference position.

In an automatic original conveying work in which a copying operation is performed by using the automatic original conveying apparatus U2, the exposing optical system A exposes the originals G1 which are sequentially passed over the copy position F1 on the original table PG, in a state where the system is stopped at the reference position.

In an original-table reading work in which the copying operation is performed while the operator manually places the original G1 on the original table PG, the exposing optical system A exposure-scans the original on the original table PG while being moved.

The reflected light from the exposed original G1 is passed through the exposing optical system A and then converged on a solid-state imaging device CCD. The solid-state imaging device CCD converts the original-reflection light converged on the imaging plane of the device, to an electric signal.

The image processing portion GS converts a read image signal supplied from the solid-state imaging device CCD of the image reading portion U1*a*, to a digital image writing signal, and supplies the signal to a laser driving signal outputting device DL of the image recording portion U1*b*.

The laser driving signal outputting device DL supplies a laser driving signal corresponding the supplied image information, to an exposing device ROS which is an example of an image writing apparatus.

A photosensitive member PR which is placed below the exposing device is rotated in the direction of the arrow Ya. The surface of the photosensitive member PR is charged in a charging region Q0 by a charging device CR, and then exposure-scanned at a latent-image writing position Q1 by a laser beam L which is an example of latent-image writing light of the exposing device ROS, thereby forming an electrostatic latent image. The surface of the photosensitive member PR on which the electrostatic latent image is formed is rotated to be sequentially passed through a developing region Q2 and a transferring region Q3 which is an example of a conveyance destination.

In a developing device G which develops the electrostatic latent image in the developing region Q2, a developer containing a toner and a carrier is conveyed to the developing region Q2 by a developing roll R0 which is an example of a developing member, and the electrostatic latent image which is passed through the developing region Q2 is developed to a toner image which is an example of an visible image. The toner image on the surface of the photosensitive member PR is conveyed to the transferring region Q3. The photosensitive member PR, the charging device CR, the exposing device ROS, the developing device G, and the like constitute a visible-image forming apparatus U3 which formed a visible image.

A developer cartridge K which is an example of a developer replenishing container for replenishing the developer that is consumed in the developing device G is detachably mounted on a cartridge mounting member KS. The developer in the developer cartridge K is conveyed while being stirred in a developer housing container RT, and conveyed to the developing device G by a developer conveying device GH which is placed in the developer housing container RT. In the developing device G in Example 1, a two-component developer consisting of a toner and a carrier is used, the developer consisting of a toner and a carrier is replenished from the developer cartridge K to the developing device G, and a deteriorated developer is gradually discharged. A developing device which gradually discharges a deteriorated developer while a new developer is replenished is conventionally known, and hence its detailed description is omitted.

A transfer unit TU which is opposed to the photosensitive member PR in the transferring region Q3 has: a transfer belt TB which is rotatably supported by belt supporting members Rd, Rf having a driving roll Rd and a driven roll Rf, and which is an example of a transferring/conveying member; a transfer roll TR which is an example of a transferring device; a separating claw SC; a belt cleaner CLb which is an example of a developer recovering device; etc. The transfer roll TR is a member which transfers the toner image on the surface of the photosensitive member PR to a sheet S that is an example of a medium, and a transfer voltage the polarity of which is opposite to that of the developing toner used in the developing device G is supplied to the roll from a power source circuit E. The power source circuit E is controlled by a controller C.

The photosensitive member PR, the developing device G, the transfer roll TR, and the like constitute an image recording apparatus GKS in Example 1.

The sheet S housed in one of sheet supplying containers TR1 to TR4 which are an example of a medium housing container is conveyed to the transferring region Q3 through a sheet feeding path SH1. Namely, the sheet S housed in one of the sheet supplying containers TR1 to TR4 is picked up by a pickup roll Rp which is an example of a medium picking up member, separated one by one by a separating roll Rs which is an example of a separating member, and conveyed to a regi roll Rr which is an example of a medium conveying member, by conveying rolls Ra which are examples of a plurality of conveying members.

The pickup roll Rp and the separating roll Rs constitute a medium supplying member (Rp+Rs) in Example 1.

The sheet supplying containers TR1 to TR4 and the medium supplying member (Rp+Rs) constitute a medium supplying apparatus BKS in Example 1.

On the left side of the cartridge mounting member KS and the developer housing container RT, a manual sheet feeding unit TRt which is an example of a medium supplying device, and which is an example of a manual sheet feeding member is disposed, and also the sheet S which is fed from the manual sheet feeding unit TRt is conveyed to the transferring region Q3.

In the image forming apparatus U of Example 1, the manual sheet feeding unit TRt is supported so as to be swingable about the swing center TRt0. Namely, the manual sheet feeding unit TRt in Example 1 is supported so as to be swingable between a housed position indicated by the solid line in FIG. 1 and an opened position indicated by the dash-dot line in FIG. 1.

The sheet S which is conveyed to the regi roll Rr is conveyed from a pre-transfer sheet guide SG1 which is an example of a guiding member, to the transfer belt TB of the transfer unit TU, in timing with the movement of the toner image on the photosensitive member PR to the transferring region Q3. The transfer belt TB conveys the conveyed sheet S to the transferring region Q3.

In the transferring region Q3, the toner image Tn which is developed on the surface of the photosensitive member PR is transferred to the sheet S by the transfer roll TR. After the transfer, the surface of the photosensitive member PR is cleaned by a cleaning brush CLp1 which is an example of a developer removing member of a photosensitive member cleaner CLp that is an example of a developer recovery container, so that a residual toner is removed. The residual toner which is removed by the cleaning brush CLp1 is conveyed by a photosensitive member toner conveying member CLp2 which is an example of a developer conveying member. The surface of the photosensitive member PR which is cleaned is again charged by the charging device CR.

The sheet S onto which the toner image is transferred by the transfer roll TR in the transferring region Q3 is separated from the surface of the transfer belt TB by the separating claw SC which is downstream from the transferring region Q3. The surface of the transfer belt TB from which the sheet S is separated is cleaned by a cleaning blade CLb1 which is an example of a developer removing member of the belt cleaner CLb. The toner, paper dust, discharge products, and the like which are removed by the cleaning blade CLb1 are conveyed by a belt toner conveying member CLb2 which is an example of the developer conveying member.

The separated sheet S undergoes thermal fixation in which the toner image is fixed by a fixing device F having a heating roll Fh that is an example of a heating member, and a pressure roll Fp that is an example of a pressuring member, and then is conveyed through a conveying path switching member MG made of an elastic sheet, to a conveying member Rb which is forwardly and reversely rotatable in a discharging path SH2. The conveying path switching member MG is elastically deformed so that the sheet S which is passed through the fixing device F is directed toward the discharging path SH2.

The sheet S to be discharged to a discharging portion TRh is conveyed in the discharging path SH2 in which the forward/reverse rotatable conveying member Rb and a plurality of conveying rolls Ra are placed. A post-processing switching member GT1 is placed in a downstream end portion of the discharging path SH2. In the case where a post-processing device which is not shown is connected to the image forming apparatus U, the post-processing switching member GT1 is switched so that the conveyed sheet S is discharged through a discharging roll Rh which is an example of a discharging member to either of the discharging unit TRh or the post-processing device which is not shown. In a state where a post-processing device is not mounted, the post-processing switching member GT1 causes the sheet S conveyed to the downstream end portion of the discharging path SH2, to be discharged to the discharging unit TRh through the discharging roll Rh.

In the case where a sheet in which recording has been conducted on one face (hereinafter, referred to one-face recorded sheet), and which is to be subjected to double-sided printing is conveyed, the forward/reverse rotatable conveying member Rb is reversely rotated immediately before the rear end of the one-face recorded sheet S is passed over the conveying member Rb, so that the one-face recorded sheet S is conveyed in a direction opposite to that in which the sheet has been conveyed, or a so-called switch back is performed. The conveying path switching member MG causes the sheet S which is switched back by the conveying member Rb, to be directed to a circulation conveying path SH3. The one-face recorded sheet S which is conveyed to the circulation conveying path SH3 is again conveyed to the transferring region Q3 in a state where the sheet is inverted. In the one-face recorded sheet S which is again conveyed to the transferring region Q3, a toner image is transferred onto the second face.

The components denoted by the reference numerals SH1 to SH3, Rp, Rs, Rr, Ra, Rb, Rh, GT1, MG, and the like constitute the medium conveying apparatus SH. (Description of regi roll Rr in Example 1)

Figure 2A:
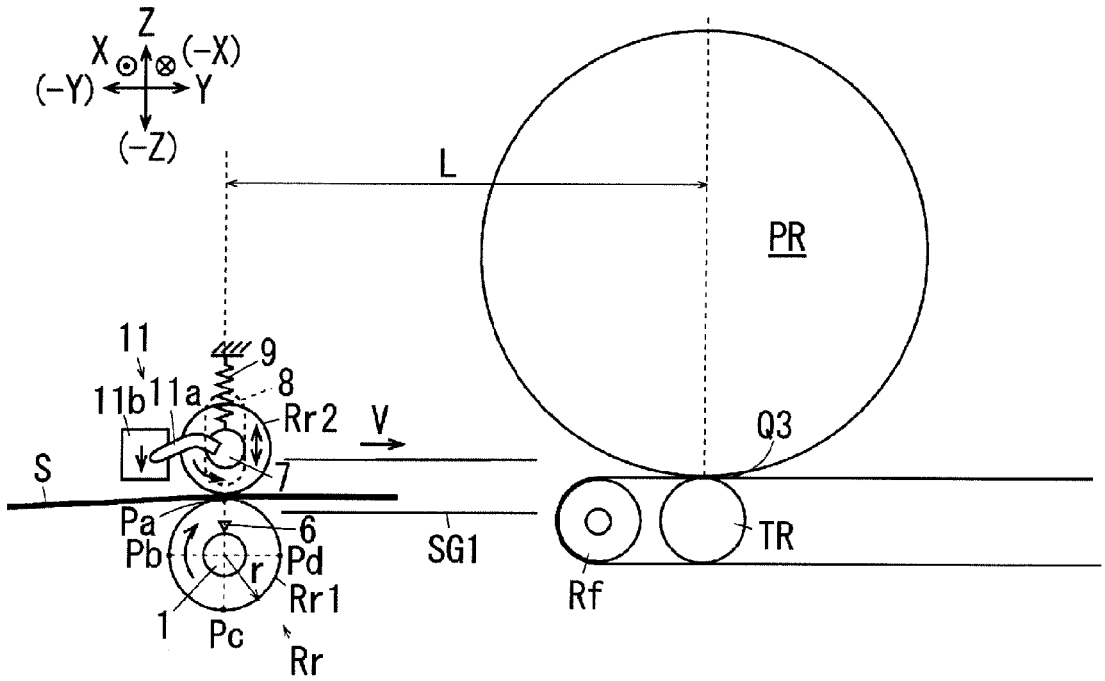
FIGS. 2A and 2B are enlarged diagrams of a regi roll in Example 1 of the invention.
Figure 2B:
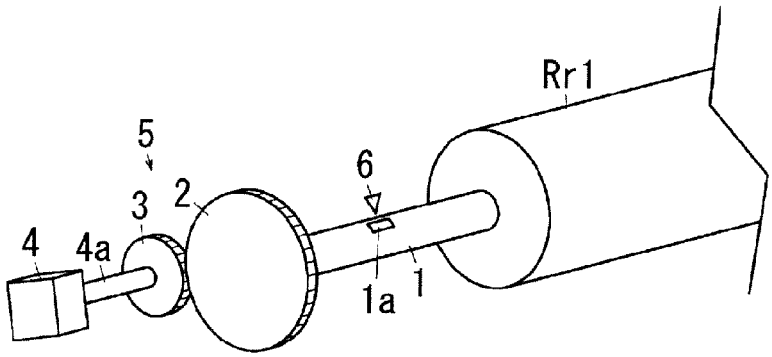

FIGS. 2A and 2B are enlarged diagrams of the regi roll in Example 1 of the invention, FIG. 2A is a diagram of main portions of the regi roll and the transferring region, and FIG. 2B is a perspective diagram of a gear train for the regi roll.

Referring to FIGS. 2A and 2B, the regi roll Rr in Example 1 has a driving roller Rr1 which rotatingly drives, and a driven roller Rr2 which is opposed to and contacted with the driving roller Rr1 to be followingly driven, and the rollers Rr1, Rr2 convey the sheet S to the transferring region Q3 while nipping the sheet.

In Example 1, the driving roller Rr1 is previously designed so as to have an outer diameter of $\phi$=20 [mm]. Namely, the driving roller Rr1 is previously designed so that the radius is 10 [mm] and the circumferential length is $2\times\pi\times19\cong62.83$ [mm]. In Example 1, furthermore, the driving roller Rr1 is preset so that the rotation rate R of the regi roll Rr per unit time is 10 [rps: revolutions per second], and the medium conveying length L from the regi roll Rr to the transferring region Q3 is 100 [mm]. Namely, the regi roll Rr in Example 1 is preset so that the rotational speed V is 628.32 [mm/s].

Referring to FIG. 2B, a roller gear 2 which is an example of a driving roller gear is fixedly supported by a driving rotation shaft 1 which is an example of the rotation center of the driving roller Rr1 in Example 1, and a motor gear 3 which is an example of a driving source gear meshes with the roller gear 2. The motor gear 3 is supported by a driving source rotation shaft 4*a* of a stepping motor 4 which is an example of a driving source. Namely, the stepping motor 4 rotates the driving roller Rr1 through the gears 2, 3.

The gears 2, 3 which are interposed between the driving roller Rr1 and the stepping motor 4 constitute a driving gear train 5 which is an example of a driving transmission system.

In Example 1, the tooth number ratio of the roller gear 2 to the motor gear 3 is preset to n:1 where n is a preset integer of 1 or more. Namely, the driving gear train 5 in Example 1 is configured so as to cause the driving roller Rr1 to make one rotation in accordance with n rotations of the stepping motor 4.

Referring to FIG. 2B, in the driving rotation shaft 1, a to-be-detected groove la is formed at a position corresponding to a preset rotation reference position Pa which is shown in FIG. 2A. A home position sensor 6 which is an example of a rotation reference position detecting member for detecting the to-be-detected groove 1*a* is placed above the driving rotation shaft 1.

Referring to FIG. 2A, a driven rotation shaft 7 which is an example of the rotation center of the driven roller Rr2 in Example 1 is supported by a guiding groove 8 which vertically extends, and which is indicated by the dotted line in FIG. 2A, so as to be movable in the vertical direction along which the shaft approaches or separates from the driving roller Rr1, and pressed downward or toward the driving roller Rr1 by an elastic spring 9 in which the upper end is supported by a frame of the copier U1, and which is an example of an elastic member.

A displacement sensor 11 which is an example of a displacement amount detecting member is connected to the driven rotation shaft 7. The displacement sensor 11 in Example 1 has an interlocked portion 11*a* which is moved integrally with the driven rotation shaft 7, and a detecting portion 11*b* which detects the vertical position of the interlocked portion 11*a*. In the displacement sensor 11, the detecting portion 11*b* detects the vertical position of the interlocked portion 11*a*, thereby detecting the vertical moving distance, i.e., the displacement amount of the driven rotation shaft 7 indicated by the dotted line in FIG. 2A and due to distortion caused by eccentricity, uneven wear, and the like of the driving roller Rr1.

(Description of Controller C in Example 1)

FIG. 3 is a view showing functions of the controller of the image forming apparatus of Example 1 of the invention, in the form of a block diagram.

Referring to FIG. 3, the controller C is configured by a computer which is an example of a computer having: an input/output interface, or a so-called I/O that is an example of an input/output signal adjusting portion through which signals are input from and output to the outside, and which adjusts levels of input/output signals; a read-only memory, or a so-called ROM which stores programs and data for performing necessary processes; a random access memory, or a so-called RAM which temporarily stores required data; a central processing unit, or a so-called CPU which performs processes according to the programs stored in the ROM; a clock oscillator; and the like. When the programs stored in the ROM are executed, it is possible to realize various functions.

(Signal Output Elements Connected to Controller C)

Output signals of the following signal output elements UI, 6, 11, and the like are supplied to the controller C.

UI: User interface

A user interface UI detects an input to a copy start key which is an example of a print start button, a copy sheet number set key which is an example of a print sheet number set button, a ten-key pad which is an example of a numeric input button, a display device, or the like, and supplies a signal indicative of the detection to the controller C.

6: Home Position Sensor

The home position sensor 6 detects the to-be-detected groove 1*a* of the driving rotation shaft 1 of the driving roller Rr1 of the regi roll Rr, and supplies a detection signal to the controller C.

11: Displacement Sensor

The displacement sensor 11 senses the displacement amount of the driven rotation shaft 7 of the driven roller Rr2 of the regi roll Rr, and supplies a sense signal to the controller C.

(Controlled Elements Connected to Controller C)

The controller C outputs control signals for the following controlled elements D1, D2, E.

D1: Main Motor Driving Circuit

A main motor driving circuit D1 which is an example of a main driving source driving circuit drives the main motor M1 which is an example of a main driving source, to rotate the photosensitive member PR, the developing roll R0 of the developing device G, the heating roll Fh of the fixing device F, the conveying rolls Ra, and the like via gears which are examples of a driving force transmitting member.

D2: Stepping Motor Driving Circuit

A stepping motor driving circuit D2 which is an example of a driving source driving circuit supplies pulse waves which are an example of a rectangular wave that is a signal wave having a rectangular shape, to the stepping motor 4 to rotatingly drive it, thereby rotating the regi roll Rr.

E: Power Source Circuit

The power source circuit E has a developing power source circuit E1, a charging power source circuit E2, a transfer roll power source circuit E3, and a heating roll power source circuit E4.

E1: Developing Power Source Circuit

The developing power source circuit E1 applies a developing voltage to the developing roll R0 of the developing device G.

E2: Charging Power Source Circuit

The charging power source circuit E2 applies a charging voltage to the charging device CR.

E3: Transfer Roll Power Source Circuit

The transfer roll power source circuit E3 applies a transfer voltage to the transfer roll TR.

E4: Heating Roll Power Source Circuit

The heating roll power source circuit E4 supplies a heating electric power to a heater which is an example of a heating member of the heating roll Fh of the fixing device F.

(Function of Controller C)

The controller C has the following function realizing units by means of programs for controlling operations of the controlled elements D1, D2, E in accordance with output signals of the signal output elements UI, 6, 11.

C1: Job Controlling Unit

A job controlling unit C1 which is an example of an image forming operation controlling unit controls the operations of the exposing device ROS, the charging device CR, the image recording apparatus GKS, the fixing device F, the medium conveying apparatus SH, and the like in accordance with an input to the copy start key, thereby executing a job which is an example of an image forming operation.

C2: Main Motor Drive Controlling Unit

A main motor drive controlling unit C2 which is an example of a main driving source drive controlling unit controls rotation of the main motor M1, via the main motor driving circuit D1, thereby controlling rotation driving of the photosensitive member PR, the developing roll R0 of the developing device G, the heating roll Fh of the fixing device F, the conveying rolls Ra, and the like.

C3: Power Source Circuit Controlling Unit

A power source circuit controlling unit C3 controls the operation of the power source circuit E to control voltage and current supplies to the developing roll R0, the charger device CR, the transfer roll TR, the heater of the heating roll Fh of the fixing device F, etc.

C4: Stepping Motor Drive Controlling Unit

A stepping motor drive controlling unit C4 which is an example of a medium conveying member controlling unit has a rotation start position detecting unit C4A, a driving start timing calculating unit C4B, a sheet feeding start timing determining unit C4C, a post-sheet feeding pre-conveyance time setting unit C4D, a timer TM, a driving start timing determining unit C4E, a driving stop timing determining unit C4F, a stop position determining unit C4G, and a driving start timing recalculation determining unit C4H. The stepping motor drive controlling unit controls the number of the pulse waves per unit time which are input to the stepping motor 4 to control the rotation driving of the regi roll Rr.

C4A: Rotation Start Position Detecting Unit

The rotation start position detecting unit C4A has a stop position storing unit C4A1, a rotation reference position detecting unit C4A2, and a pulse counter C4A3, and detects a plurality of rotation start positions which are preset in accordance with the central angle that is equally divided along the rotational direction of the driving roller Rr1 of the regi roll Rr. In Example 1, as shown in FIG. 2A, the rotation reference position Pa is set at a first rotation start position Pa, and positions which are obtained by equally dividing the circumference into quarters toward the downstream side from the first rotation start position Pa along the rotational direction are set as a second rotation start position Pb, a third rotation start position Pc, and a fourth rotation start position Pd, respectively.

C4A1: Stop Position Storing Unit

The stop position storing unit C4A1 stores the next one of the rotation start positions Pa to Pd which is the stop position when the rotation driving of the stepping motor 4 is stopped.

C4A2: Rotation Reference Position Detecting Unit

On the basis of the sense signal of the home position sensor 6, the rotation reference position detecting unit C4A2 detects the to-be-detected groove 1*a* of the driving rotation shaft 1, to detect that the driving roller Rr1 of the regi roll Rr is rotated to the rotation reference position Pa.

C4A3: Pulse Counter

The pulse counter C4A3 which is an example of a rectangular wave counting unit counts the total input number i of pulse waves to the stepping motor 4 from the rotation start positions Pa to Pd where the rotation driving is started, and the rotation reference position Pa detected by the rotation reference position detecting unit C4A2.

Therefore, the rotation start position detecting unit C4A in Example 1 detects the rotation start positions Pa to Pd where the rotation driving is started, by means of the stop position storing unit C4A1 and the rotation reference position detecting unit C4A2. In the rotation start position detecting unit C4A, the total input number i of pulse waves to the stepping motor 4 from the rotation start positions Pa to Pd is counted by the pulse counter C4A3, and, on the basis of the rotation angle calculated from the total input number i, the rotation start positions Pa to Pd are detected.

Figure 4:
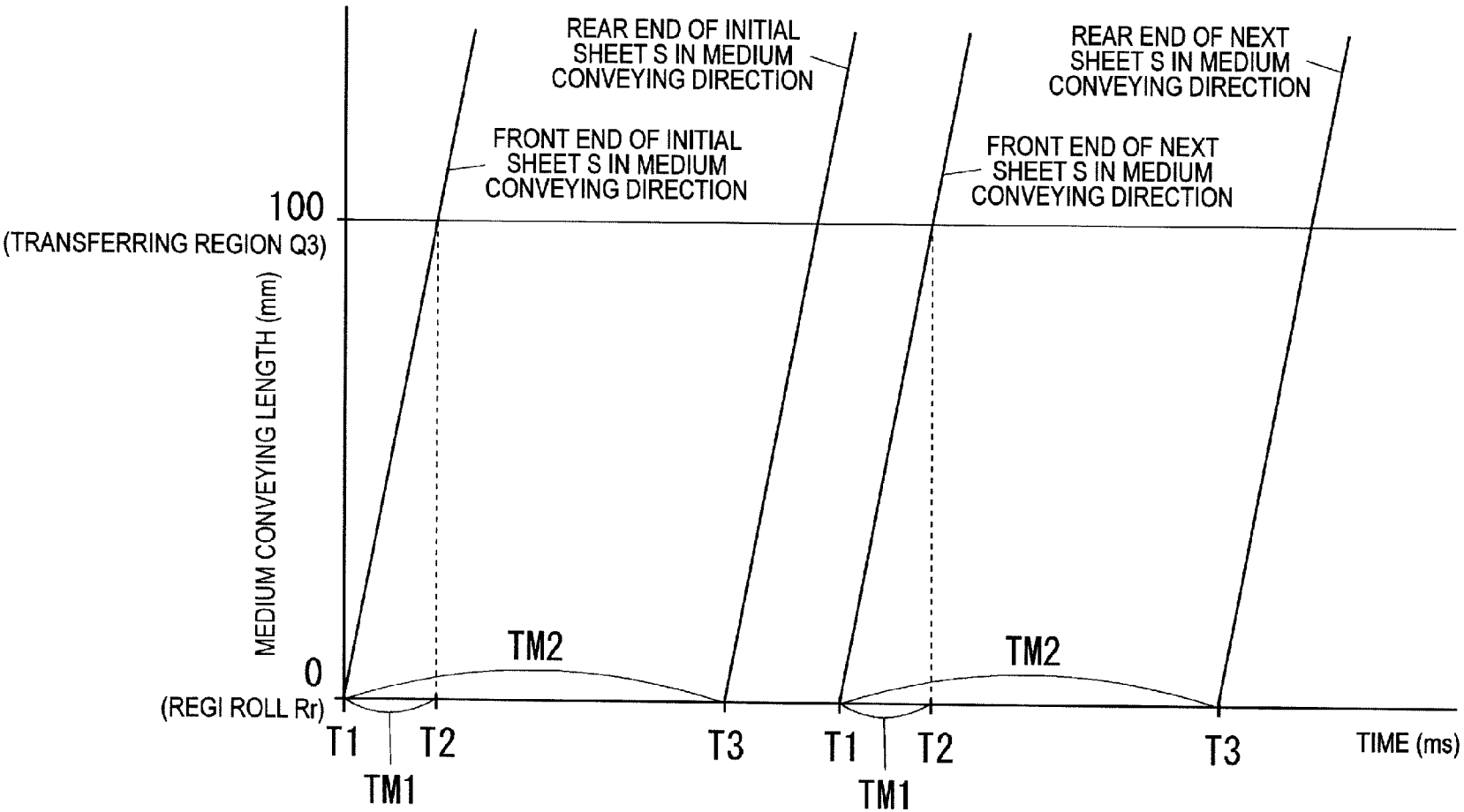
FIG. 4 is a view of a stepping motor driving control process in Example 1 of the invention, in which the ordinate indicates a medium conveying length, and the abscissa indicates the time, and which is an example of a graph showing the front end of the initial sheet in the medium conveying direction, the rear end of the initial sheet in the medium conveying direction, the front end of the next sheet in the medium conveying direction, and the rear end of the next sheet in the medium conveying direction.

FIG. 4 is a view of a stepping motor driving control process in Example 1 of the invention, in which the ordinate indicates the medium conveying length, and the abscissa indicates the time, and which is an example of a graph showing the front end of the initial sheet in the medium conveying direction, the rear end of the initial sheet in the medium conveying direction, the front end of the next sheet in the medium conveying direction, and the rear end of the next sheet in the medium conveying direction.

C4B: Driving Start Timing Calculating Unit

The driving start timing calculating unit C4B has a zone radius measuring unit C4B1, a zone circumferential length measuring unit C4B2, and a medium conveying time calculating unit C4B3, and as shown in FIG. 4, calculates a driving start timing T1 when the rotation driving of the stepping motor 4 is started for causing the sheet S to reach the transferring region Q3 at a preset medium reach timing T2. As the medium reach timing T2 in Example 1, the timing when the toner image on the surface of the photosensitive member PR reaches the transferring region Q3 is preset.

C4B1: Zone Radius Measuring Unit

The zone radius measuring unit C4B1 measures zone radii r corresponding to the rotation start positions Pa to Pd of the driving roller Rr1 shown in FIG. 2A, on the basis of the preset radius of the driving roller Rr1 in the product shipment, the preset rotation rate R of the driving roller Rr1 per unit time, and the detection result of the displacement sensor 11. In Example 1, the zone radius measuring unit C4B1 measures zone radii r in which the displacement amount of the driven rotation shaft 7 is set as the difference of the radii, for each of zones which are obtained by equally dividing the central angle of the driving roller Rr1 by 10°. Namely, the zone radius measuring unit C4B1 in Example 1 measures the zone radius r each time when the driving roller Rr1 is rotated by 10°, or performs sampling of the radius. In accordance with one rotation of the stepping motor 4, therefore, the zone radii r of 36 zones including the rotation start positions Pa to Pd are measured.

C4B2: Zone Circumferential Length Measuring Unit

The zone circumferential length measuring unit C4B2 measures the zone circumferential lengths between adjacent ones of the rotation start positions Pa to Pd. In Example 1, on the basis of the zone radii r measured by the zone radius measuring unit C4B1, the zone circumferential length measuring unit C4B2 measures: a first zone circumferential length Lab from the first rotation start position Pa to the second rotation start position Pb; a second zone circumferential length Lbc from the second rotation start position Pb to the third rotation start position Pc; a third zone circumferential length Lcd from the third rotation start position Pc to the fourth rotation start position Pd; and a fourth zone circumferential length Lda from the fourth rotation start position Pd to the first rotation start position Pa. Specifically, in the case where the values of the zone radii r of the 36 zones from the first rotation start position Pa are indicated by r0 to r35, respectively, the first zone circumferential length Lab is measured by calculating $(1/4)\times 2\pi\times\{(r0+r1+\ldots+r9)/10\}$. With respect to the other zone circumferential lengths Lbc to Lda, similarly, the second zone circumferential length Lbc is calculated by (¼)×2π×{(r9+r10+ . . . +r18)/10}, the third zone circumferential length Lcd is calculated by (¼)×2π×{(r18+r19+ . . . +r27)/10}, and the fourth zone circumferential length Lda is calculated by (¼)×2π×{(r27+r28+ . . . +r35+r0)/10}.

C4B3: Medium Conveying Time Calculating Unit

The medium conveying time calculating unit C4B3 measures a medium conveying time TM1 which is shown in FIG. 4, and during which the sheet S is conveyed from the regi roll Rr to the transferring region Q3, on the basis of the preset rotation rate R of the regi roll Rr per unit time, the preset medium conveying length L, and the zone circumferential lengths Lab to Lda measured by the zone circumferential length measuring unit C4B2. As shown in following expressions (1-1) to (1-4), first, the medium conveying time calculating unit C4B3 in Example 1 calculates the remaining medium conveying length ΔL after 1.5 rotations from each of the rotation start positions Pa to Pd where the rotation driving is started, with respect to the medium conveying length L.

In the case of the first rotation start position Pa:

$$\Delta L = L - (Lab + Lbc + Lcd + Lda + Lab + Lbc) \tag{1-1}$$

In the case of the second rotation start position Pb:

$$\Delta L = L - (Lbc + Lcd + Lda + Lab + Lbc + Lcd) \tag{1-2}$$

In the case of the third rotation start position Pc:

$$\Delta L = L - (Lcd + Lda + Lab + Lbc + Lcd + Lda) \tag{1-3}$$

In the case of the fourth rotation start position Pd:

$$\Delta L = L - (Lda + Lab + Lbc + Lcd + Lda + Lab) \tag{1-4}$$

As shown in following expressions (2-1) to (2-4), next, the remaining rotation angle Δθ after 1.5 rotations is calculated from the remaining medium conveying length ΔL for each of the rotation start positions Pa to Pd.

In the case of the first rotation start position Pa:

$$\begin{aligned}\Delta\theta &= 90° \times \Delta L / Lcd \\ &= 90° \times \{L - (Lab + Lbc + Lcd + Lda + Lab + Lbc)\} / Lcd\end{aligned} \tag{2-1}$$

In the case of the second rotation start position Pb:

$$\begin{aligned}\Delta\theta &= 90° \times \Delta L / Lda \\ &= 90° \times \{L - (Lbc + Lcd + Lda + Lab + Lbc + Lcd)\} / Lda\end{aligned} \tag{2-2}$$

In the case of the third rotation start position Pc:

$$\begin{aligned}\Delta\theta &= 90° \times \Delta L / Lab \\ &= 90° \times \{L - (Lcd + Lda + Lab + Lbc + Lcd + Lda)\} / Lab\end{aligned} \tag{2-3}$$

In the case of the fourth rotation start position Pd:

$$\begin{aligned}\Delta\theta &= 90° \times \Delta L / Lbc \\ &= 90° \times \{L - (Lda + Lab + Lbc + Lcd + Lda + Lab)\} / Lbc\end{aligned} \tag{2-4}$$

As shown in following expressions (3-1) to (3-4), then, the time [ms] for making a rotation of an angle which is obtained by addition of 1.5 rotations, i.e., 540° and a remaining rotation angle is calculated as the medium conveying time TM1 for each of the rotation start positions Pa to Pd.

In the case of the first rotation start position Pa:

$$\begin{aligned}TM1 &= \{(540° + \Delta\theta) / (360° \times R)\} \times 10^3 \\ &= 10^3 \times (540° + 90° \times \Delta L / Lcd) / (360° \times R) \\ &= 10^3 \times [540° + 90° \times \{L - (Lab + \ldots + Lbc\} / Lcd] / \\ &\quad (360° \times R)\end{aligned} \tag{3-1}$$

In the case of the second rotation start position Pb:

$$\begin{aligned}TM1 &= \{(540° + \Delta\theta) / (360° \times R)\} \times 10^3 \\ &= 10^3 \times (540° + 90° \times \Delta L / Lda) / (360° \times R) \\ &= 10^3 \times [540° + 90° \times \{L - (Lbc + \ldots + Lcd\} / Lda\} / \\ &\quad (360° \times R)\end{aligned} \tag{3-2}$$

In the case of the third rotation start position Pc:

$$\begin{aligned}TM1 &= \{(540° + \Delta\theta) / (360° \times R)\} \times 10^3 \\ &= 10^3 \times (540° + 90° \times \Delta L / Lab) / (360° \times R) \\ &= 10^3 \times [540° + 90° \times \{L - (Lcd + \ldots + Lda\} / Lab] / \\ &\quad (360° \times R)\end{aligned} \tag{3-3}$$

In the case of the fourth rotation start position Pd:

$$\begin{aligned}TM1 &= \{(540° + \Delta\theta) / (360° \times R)\} \times 10^3 \\ &= 10^3 \times (540° + 90° \times \Delta L / Lbc) / (360° \times R) \\ &= 10^3 \times [540° + 90° \times \{L - (Lda + \ldots + Lab\} / Lbc] / \\ &\quad (360° \times R)\end{aligned} \tag{3-4}$$

FIG. 5 is a view showing an example of medium conveying times in Example 1 of the invention, at respective rotation start positions in shipment of a product, and those at respective rotation start positions after operation.

As shown in FIG. 5, in the driving roller Rr1 in the product shipment, the zone radii r and the zone circumferential lengths Lab to Lda are 10 [mm] and 15.71 [mm] at all the rotation start positions Pa to Pd. For all the rotation start positions Pa to Pd where the rotation driving is started, therefore, the remaining medium conveying length ΔL, the remaining rotation angle Δθ, and the medium conveying time TM1*a* in the product shipment are 5.75 [mm], 33.0°, and 159.2 [ms], respectively.

For example, the case will be considered where the driving roller Rr1 is used, and, in zones (Pa to Pb), (Pb to Pc), (Pc to Pd), and (Pd to Pa) from the first rotation start position Pa to the second rotation start position Pb, from the second rotation start position Pb to the third rotation start position Pc, from the third rotation start position Pc to the fourth rotation start position Pd, and from the fourth rotation start position Pd to the first rotation start position Pa, the average values (r0+ . . . r9)/10, (r9+ . . . +r18)/10, (r18+ . . . +r27)/10, and (r27+ . . . +r35+r0)/10 of the zone radii r are 10 [mm], 9.2 [mm], 10 [mm], and 10 [mm], respectively. At this time, the zone circumferential lengths Lab to Lda of the zones (Pa to Pb), (Pb to Pc), (Pc to Pd), and (Pd to Pa) are 16.49 [mm], 14.45 [mm], 15.71 [mm], and 15.71 [mm], respectively.

In this case, the remaining medium conveying lengths ΔL for the rotation start positions Pa to Pd and calculated by expressions (1-1) to (1-4) above are 6.69 [mm], 7.48 [mm], 5.75 [mm], and 5.75 [mm], respectively. The remaining rotation angles Δθ for the rotation start positions Pa to Pd and calculated by expressions (2-1) to (2-4) above are 38.4°, 42.9°, 34.0°, and 33.9°, respectively, and the medium conveying times TM1 for the rotation start positions Pa to Pd and calculated by expressions (3-1) to (3-4) above are 160.7 [ms], 161.9 [ms], 159.4 [ms], and 159.4 [ms], respectively.

Therefore, the total circumferential length of the driving roller Rr1 after operation of this example is 16.49+14.45+15.71+15.71=62.36 [mm], and hence shorter than that of 62.83 [mm] in the product shipment. Consequently, it is seen that the medium conveying time TM1 for each of the rotation start positions Pa to Pd is longer than the medium conveying time TM1*a* in the product shipment. Namely, it is seen that the time differences between the medium conveying times TM1 from the rotation start positions Pa to Pd and the medium conveying time TM1*a*=159.2 [ms] in the product shipment are +1.5 [ms], +2.8 [ms], +0.3 [ms], and +0.3 [ms], respectively. In the driving roller Rr1 after operation of the example, it is seen that, because of the time differences, particularly, the medium conveying times TM1 from the first rotation start position Pa and the second rotation start position Pb in which the shortest second zone circumferential length Lbc is passed two times before the sheet S reaches from the regi roll Rr to the transferring region Q3 are prolonged.

It is seen that, because the longest first zone circumferential length Lab is passed two times, the medium conveying time TM1 from the first rotation start position Pa is shorter than the medium conveying time TM1 from the second rotation start position Pb.

As a result, it is seen that, in the driving roller Rr1 after operation, the medium conveying time TM1 is changed in accordance with the circumferential length of one of the rotation start positions Pa to Pd where the rotation driving is started.

For each of the rotation start positions Pa to Pd where the rotation driving is started, the driving start timing calculating unit C4B in Example 1 calculates the timing before elapse of the medium conveying time TM1 from the preset medium reach timing T2, as the driving start timing T1. Namely, the driving start timing T1 which goes back from the medium reach timing T2 by the medium conveying time TM1 is calculated for each of the rotation start positions Pa to Pd.

C4C: Sheet Feeding Start Timing Determining Unit

The sheet feeding start timing determining unit C4C which is an example of a sheet feeding start signal receiving unit determines whether a sheet feeding start signal indicating that the sheet S is fed from the medium supplying apparatus BKS is received or not, thereby determining whether the time reaches a sheet feeding start timing T0 when the feeding of the sheet S is started or not.

Figures 6, 7:
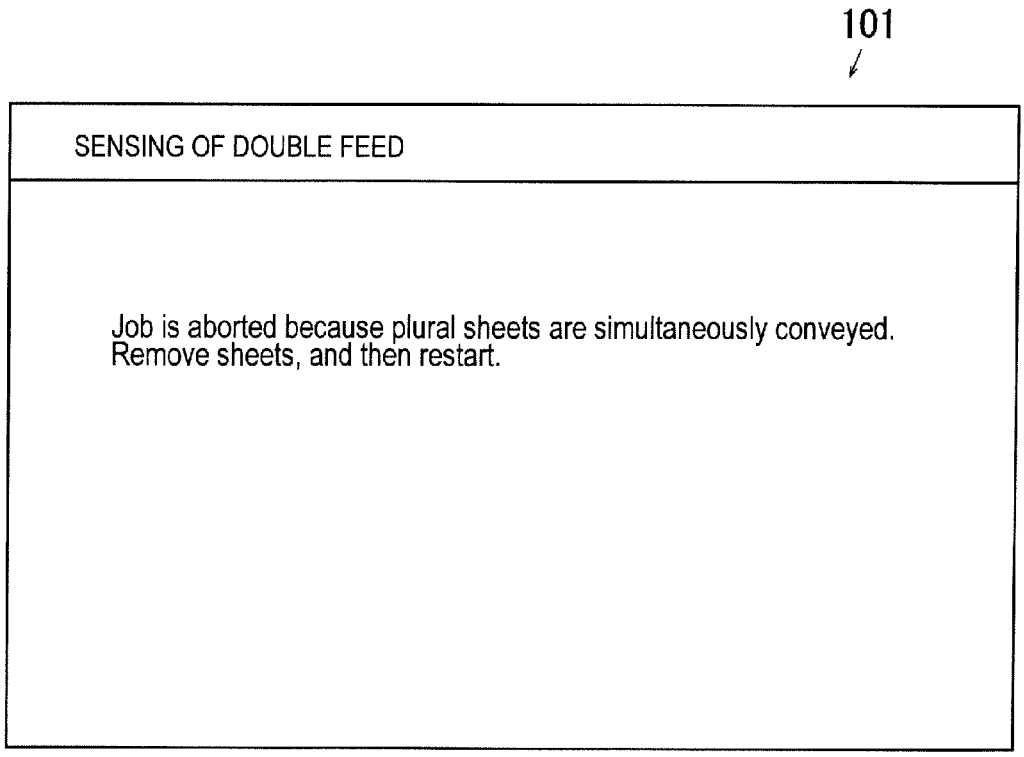
FIG. 6 is a view showing a post-sheet feeding pre-conveyance time table in Example 1 of the invention, and corresponding to FIG. 5.
FIG. 7 is a view of a double feed image in Example 1 of the invention.

FIG. 6 is a view showing a post-sheet feeding pre-conveyance time table in Example 1 of the invention, and corresponding to FIG. 5.

C4D: Post-Sheet Feeding Pre-Conveyance Time Setting Unit

The post-sheet feeding pre-conveyance time setting unit C4D sets a post-sheet feeding pre-conveyance time TM0 which extends from the sheet feeding start timing T0 determined by the sheet feeding start timing determining unit C4C to the driving start timing T1 calculated by the driving start timing calculating unit C4B, and which is after the timing when feeding of the sheet S is started, the sheet reaches the regi roll Rr, and skew correction is performed, and before the conveyance of the sheet S to the transferring region Q3 is started. In Example 1, the post-sheet feeding pre-conveyance time setting unit C4D sets the post-sheet feeding pre-conveyance time table shown in FIG. 6.

Referring to FIG. 6, in the post-sheet feeding pre-conveyance time table in Example 1, 1,000.0 [ms] is preset in the case of "thick sheet", and 1,001.0 [ms] is set in the case of "ordinary sheet", as the post-sheet feeding pre-conveyance time TM0 in the product shipment which is a set reference value. In the case where the zone circumferential lengths Lab to Lda shown in FIG. 5 are measured, in the post-sheet feeding pre-conveyance time setting unit C4D in Example 1, therefore, times in which the set reference value is subtracted by +1.5 [ms], +2.8 [ms], +0.3 [ms], and +0.3 [ms] that are the time differences between the medium conveying times TM1 from the rotation start positions Pa to Pd in operation and the medium conveying time TM1*a* in the product shipment are set as the post-sheet feeding pre-conveyance times TM0 at the rotation start positions Pa to Pd.

Namely, the post-sheet feeding pre-conveyance time TM0 in the case where the rotation driving is started from the first rotation start position Pa is set to 998.5 [ms] in the case of "thick sheet", and to 999.5 [ms] in the case of "ordinary sheet". Moreover, the post-sheet feeding pre-conveyance time TM0 in the case where the rotation driving is started from the second rotation start position Pb is set to 997.3 [ms] in the case of "thick sheet", and to 998.3 [ms] in the case of "ordinary sheet". Furthermore, the post-sheet feeding pre-conveyance time TM0 in the case where the rotation driving is started from the rotation start positions Pc, Pd is set to 999.7 [ms] in the case of "thick sheet", and to 1,000.7 [ms] in the case of "ordinary sheet".

TM: Timer

The timer TM which is an example of a time measuring unit measures the time from the sheet feeding start timing T0.

C4E: Driving Start Timing Determining Unit

The driving start timing determining unit C4E determines whether the time reaches the driving start timing T1 calculated by the driving start timing calculating unit C4B or not. In the driving start timing determining unit C4E in Example 1, the determining whether the time reaches the driving start timing T1 or not is performed by determining whether, after the sheet feeding start timing determining unit C4C determines that the time reaches the sheet feeding start timing T0, the timer TM completes the counting of the post-sheet feeding pre-conveyance time TM0 or not, i.e., the time is up or not. In the driving start timing determining unit C4E, the post-sheet feeding pre-conveyance time TM0 to be set in the timer TM is previously selected from the post-sheet feeding pre-conveyance time table which is set in the post-sheet feeding pre-conveyance time setting unit C4D, in accordance with medium kind information included in the received sheet feeding start signal and indicating that the fed sheet S is "thick sheet" or "ordinary sheet", and the present one of the rotation start positions Pa to Pd which is the stop position stored in the stop position storing unit C4A1.

C4F: Driving Stop Timing Determining Unit

The driving stop timing determining unit C4F determines whether the time reaches a driving stop timing T3 shown in FIG. 4 when the sheet S is conveyed from the regi roll Rr and the driving of the stepping motor 4 is stopped, or not. In the driving stop timing determining unit C4F in Example 1, the determining whether the time reaches the driving stop timing T3 or not is performed by determining whether, after the driving start timing determining unit C4E determines that the time reaches the driving start timing T1, the timer TM completes the counting of a medium conveying time TM2 shown in FIG. 4 or not, i.e., the time is up or not.

In the driving stop timing determining unit C4F, the medium conveying time TM2 which is set in the timer TM is preset on the basis of the medium kind information included in the received sheet feeding start signal and indicating the size of the sheet S, and the medium conveying time TM1. When the size is "A4 size", for example, the length of the long side is 297.0 [mm], and hence the medium conveying time TM2 is preset to TM2=(297/L)×TM1=2.97×TM1. When the regi roll Rr can be stooped at next one of the rotation start positions Pa to Pd which is the stop position, until the next sheet S is conveyed to the regi roll Rr, the medium conveying time TM2 is not restricted to this. For example, a grace time α may be added to the medium conveying time, so that the medium conveying time may be set to TM2=2.97×TM1+α.

C4G: Stop Position Determining Unit

In the case where the driving stop timing determining unit C4F determines that the time reaches the driving stop timing T3, the stop position determining unit C4G determines the stop position where the rotation driving of the regi roll Rr is stopped. The stop position determining unit C4G in Example 1 determines the previous stop position stored in the stop position storing unit C4A1, i.e., the rotation start position Pb to Pa which is adjacent to the present one of the rotation start positions Pa to Pd on the downstream side in the rotational direction, as the present stop position.

C4H: Driving Start Timing Recalculation Determining Unit

The driving start timing recalculation determining unit C4H has a sheet counter C4H1 which is an example of a recorded medium counting unit for counting the sheet number Nj of the sheets S on which the image forming process is performed and an image is recorded, and determines whether the value of the sheet number Nj exceeds a preset recalculation determination value $N_{max}$ or not, thereby determining whether the driving start timing T1 is to be recalculated or not.

C5: Medium Thickness Measuring Unit

A medium thickness measuring unit C5 measures a sheet thickness ds which is the thickness of the sheet S, on the basis of the detection result of the displacement sensor 11 before the sheet S is conveyed from the regi roll Rr, and that of the displacement sensor 11 when the sheet S is conveyed from the regi roll Rr. The medium thickness measuring unit C5 in Example 1 measures the sheet thickness ds which is the difference between the displacement amount of the displacement sensor 11 before the conveyance, and that of the displacement sensor 11 during the conveyance.

C6: Double Feed Determining Unit

A double feed determining unit C6 determines whether the sheet thickness ds measured by the medium thickness measuring unit C5 exceeds a preset threshold Sd or not, thereby determining whether a plurality of sheets are simultaneously conveyed or not, i.e., whether double feed occurs or not. In the double feed determining unit C6 in Example 1, the threshold Sd is preset on the basis of the medium kind information, and it is determined whether the sheet thickness ds exceeds the threshold Sd corresponding on the kind of the sheet S such as "thick sheet" or "ordinary sheet", thereby determining whether double feed occurs or not.

FIG. 7 is a view of a double feed image in Example 1 of the invention.

C7: Double Feed Image Displaying Unit

In the case where the double feed determining unit C6 determines that double feed occurs, a double feed image displaying unit C7 displays a double feed image 101 shown in FIG. 7 and informing that double feed occurs.

C8: Replacement Timing Determining Unit

A replacement timing determining unit C8 determines whether, when the averages of the zone circumferential lengths Lab to Lda in the product shipment are indicated as ave(Lab) to ave(Lda), the differences {ave(Lab)−Lab} to {ave(Lda)−Lda} between the averages ave(Lab) to ave(Lda) and the zone circumferential lengths Lab to Lda measured by the zone circumferential length measuring unit C4B2 exceed a preset threshold SL or not, thereby determining whether a replacement timing when the regi roll Rr is to be replaced with a new one because of wear or the like of the regi roll Rr reaches or not. If one of the differences {ave(Lab)−Lab} to {ave(Lda)−Lda} is larger than the threshold SL, the replacement timing determining unit C8 in Example 1 determines that the replacement timing reaches.

Figure 8:
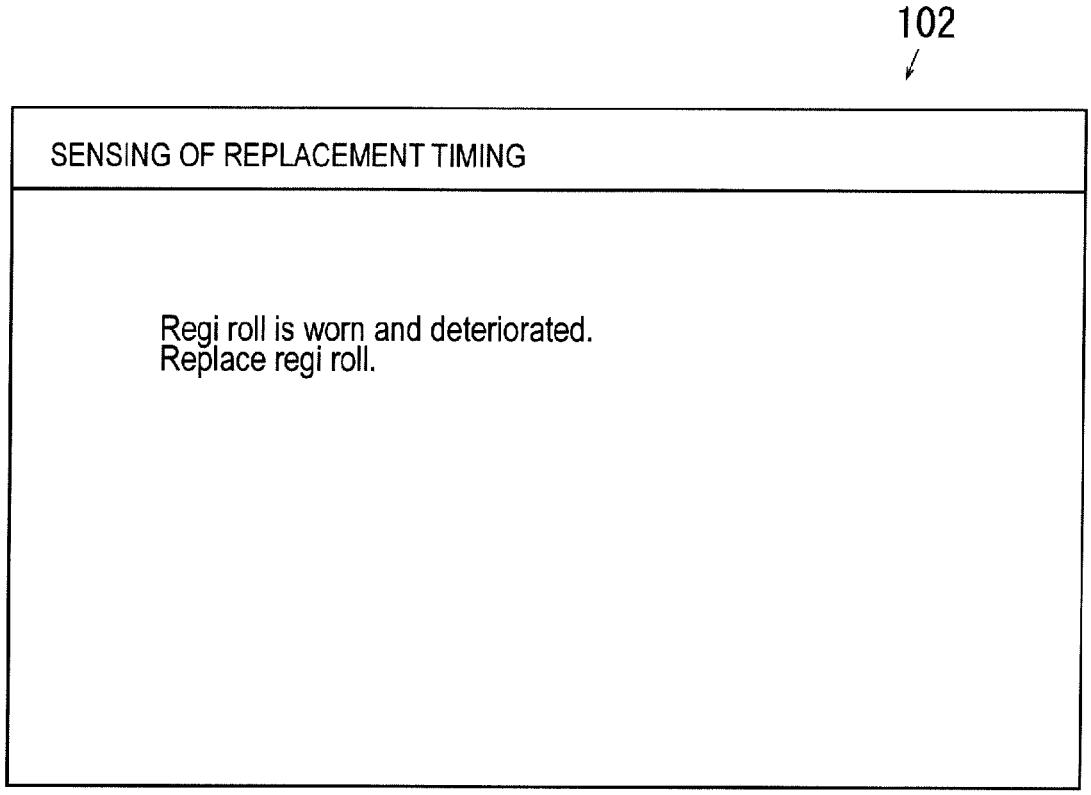
FIG. 8 is a view of a replacement image in Example 1 of the invention.

FIG. 8 is a view of a replacement image in Example 1 of the invention.

C9: Replacement Image Displaying Unit

If the replacement timing determining unit C8 determines that the replacement timing reaches, a replacement image displaying unit C9 displays a replacement image 102 shown in FIG. 8 and informing that the replacement timing reaches.

(Description of Flowchart of Example 1)

Next, the flow of the process of the image forming apparatus U of Example 1 of the invention will be described with reference to flowcharts.

(Description of Flowchart of Stepping Motor Driving Control Process in Example 1)

Figure 9:
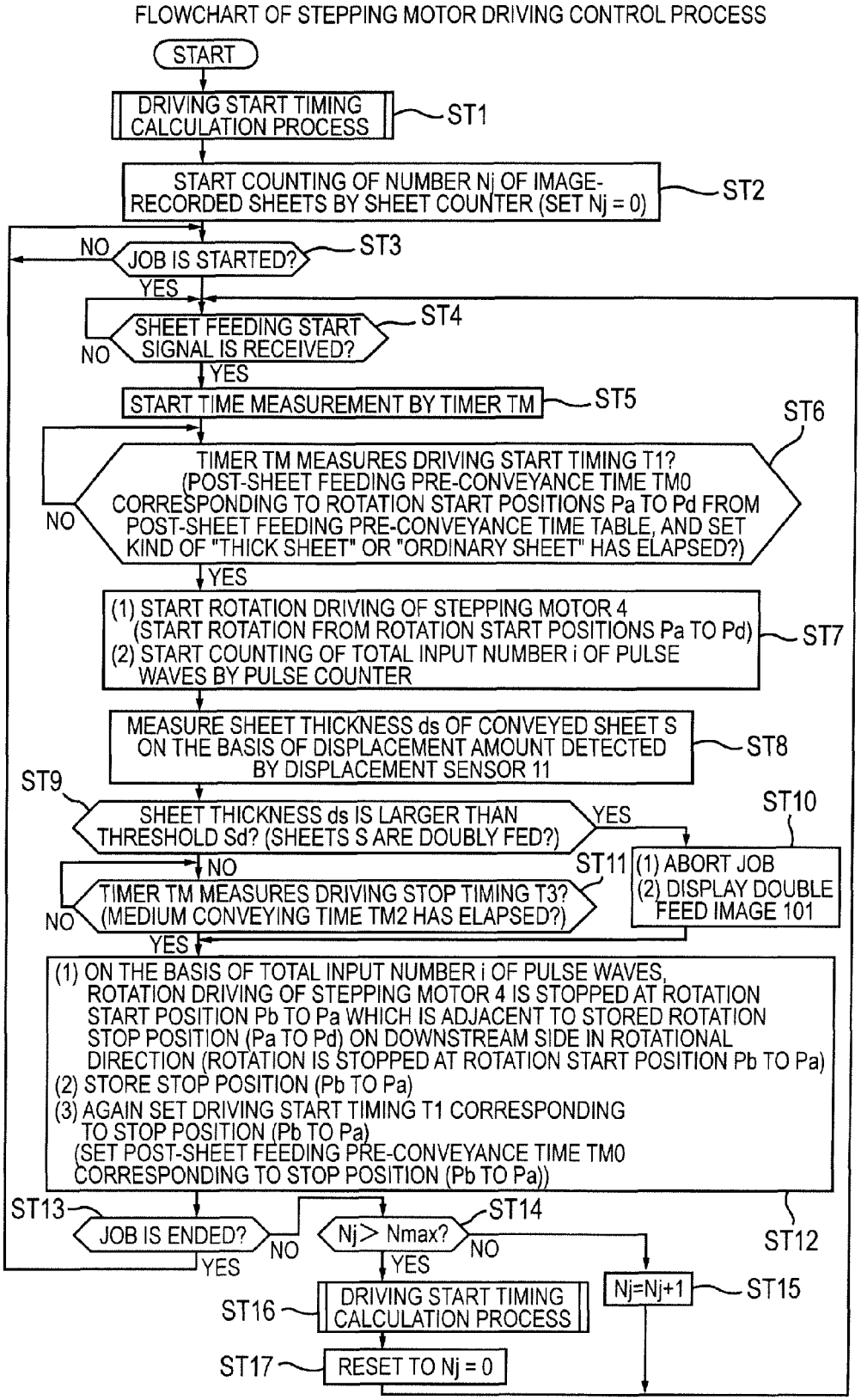
FIG. 9 is a flowchart of the stepping motor driving control process in Example 1 of the invention.

FIG. 9 is a flowchart of the stepping motor driving control process in Example 1 of the invention.

The process of each step ST in the flowchart of FIG. 9 is performed in accordance with the programs stored in the controller C of the image forming apparatus U. The process is performed in a parallel process with other various processes of the image forming apparatus U.

The flowchart shown in FIG. 9 is started by turning on a power source of the image forming apparatus U.

Figure 10:
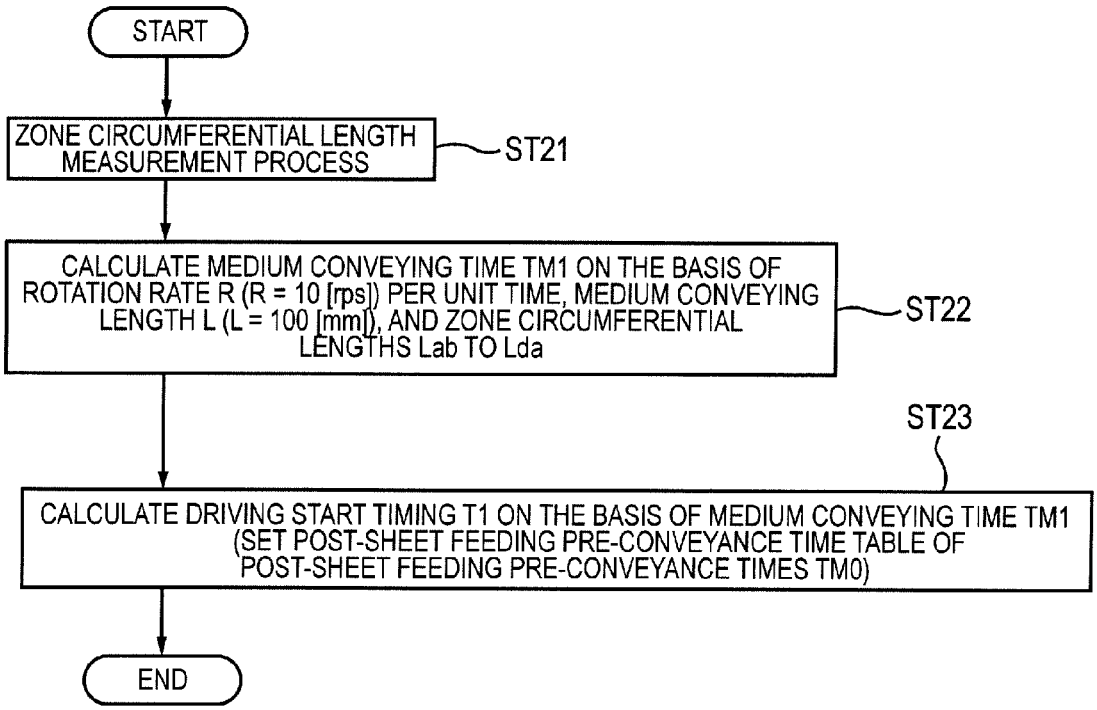
FIG. 10 is a flowchart of a driving start timing calculation process in Example 1 of the invention, and illustrating a subroutine of ST1 and ST16 of FIG. 9.

In ST1 of FIG. 9, a driving start timing calculation process which is shown in FIG. 10 that will be described later is performed. Then, the process proceeds to ST2.

In ST2, the sheet counter starts the counting of the number Nj of the sheets on which the image forming process is performed. Then, the process proceeds to ST3.

In ST3, it is determined whether the job is started or not. If yes (Y), the process transfers to ST4, and, if no (N), ST3 is repeated.

In ST4, it is determined whether the sheet feeding start signal indicating that the sheet S is fed from the medium supplying apparatus BKS is received or not, or namely it is determined whether the time reaches the sheet feeding start timing T0 when the feeding of the sheet S is started or not. If yes (Y), the process transfers to ST5, and, if no (N), ST4 is repeated.

In ST5, the time measurement by the timer TM is started. Then, the process proceeds to ST6.

In ST6, it is determined, in accordance with the rotation starting positions Pa to Pd whether or not the post-sheet feeding pre-conveyance time TM0 which is previously selected from the post-sheet feeding pre-conveyance time table in accordance with medium kind information included in the received sheet feeding start signal and indicating that the fed sheet S is "thick sheet" or "ordinary sheet" has elapsed from the start of the time measurement by the timer TM. Namely, it is determined whether the timer TN measures the driving start timing T1 shown in FIG. 4 or not. If yes (Y), the process transfers to ST7, and, if no (N), ST6 is repeated.

In ST7, processes of following (1) and (2) are performed, and the process transfers to ST8.

(1) The rotation driving of the stepping motor 4 is started. Namely, the rotation of the regi roll Rr is started from the present one of the rotation start positions Pa to Pd which is the stop position.

(2) The counting of the total input number i of pulse waves by the pulse counter is started.

In ST8, on the basis of the displacement amount detected by the displacement sensor 11, the sheet thickness ds of the conveyed sheet S is measured. Then, the process proceeds to ST9.

In ST9, it is determined whether the sheet thickness ds is larger than the threshold Sd which is preset in accordance with the kind of the sheet S such as "thick sheet" or "ordinary sheet" or not. Namely, it is determined whether double feed occurs or not. If yes (Y), the process transfers to ST10, and, if no (N), the process transfers to ST11.

In ST10, processes of following (1) and (2) are performed, and the process transfers to ST12.

(1) The job is aborted.

(2) The double feed image 101 shown in FIG. 7 is displayed.

In ST11, it is determined whether the medium conveying time TM2 shown in FIG. 4 has elapsed from the measurement of the driving start timing T1 by the timer TM or not. Namely, it is determined whether the timer TM measures the driving stop timing T3 shown in FIG. 4 or not. If yes (Y), the process transfers to ST12, and, if no (N), ST11 is repeated.

In ST12, processes of following (1) to (3) are performed, and the process transfers to ST13.

(1) On the basis of the total input number i of pulse waves which is the value of the pulse counter, the rotation driving of the stepping motor 4 is stopped at the stored stop position, i.e., the rotation start position Pb to Pa which is adjacent to the present one of the rotation start positions Pa to Pd on the downstream side in the rotational direction.

(2) The next one of the rotation start positions Pb to Pa which is the stop position is stored.

(3) The post-sheet feeding pre-conveyance time TM0 corresponding to the stop position (Pb to Pa) is again set. Namely, the driving start timing T1 corresponding to the stop position (Pb to Pa) is again set.

In ST13, it is determined whether a signal for ending the job is input or not. If no (N), the process transfers to ST14, and, if yes (Y), the process returns to ST3.

In ST14, it is determined whether the number Nj of the sheets S on which the image forming process is performed, and indicating the value of the sheet counter exceeds the preset recalculation determination value $N_{max}$ or not. Namely, it is determined whether $Nj>N_{max}$ is held or not. If no (N), the process transfers to ST15, and, if yes (Y), the process transfers to ST16.

In ST15, +1 is added to the value Nj of the sheet counter. Namely, Nj=Nj+1 is executed. Then, the process returns to ST4.

In ST16, the driving start timing calculation process is performed, and the process transfers to ST17.

In ST17, the number Nj of the image-recorded sheets counted by the sheet counter is reset to 0. Then, the process returns to ST4.

(Description of Flowchart of Driving Start Timing Calculation Process in Example 1)

FIG. 10 is a flowchart of the driving start timing calculation process in Example 1 of the invention, and illustrating a subroutine of ST1 and ST16 of FIG. 9.

In ST21 of FIG. 10, a zone circumferential length measurement process of FIG. 11 which will be described later is performed. Then, the process proceeds to ST22.

In ST22, the medium conveying time TM1 which is shown in FIG. 4 is calculated on the basis of above-described expressions (1-1) to (1-4), (2-1) to (2-4), and (3-1) to (3-4), the rotation rate R per unit time, the medium conveying length L, and the zone circumferential lengths Lab to Lda. Then, the process proceeds to ST23.

In ST23, the driving start timing T1 is calculated on the basis of the calculated medium conveying time TM1. Namely, the post-sheet feeding pre-conveyance time table of the post-sheet feeding pre-conveyance times TM0 shown in FIG. 6 is set. Then, the driving start timing calculation process is ended, and the process returns to ST1 or ST16 of FIG. 9.

(Description of Flowchart of Zone Circumferential Length Measurement Process in Example 1)

Figure 11:
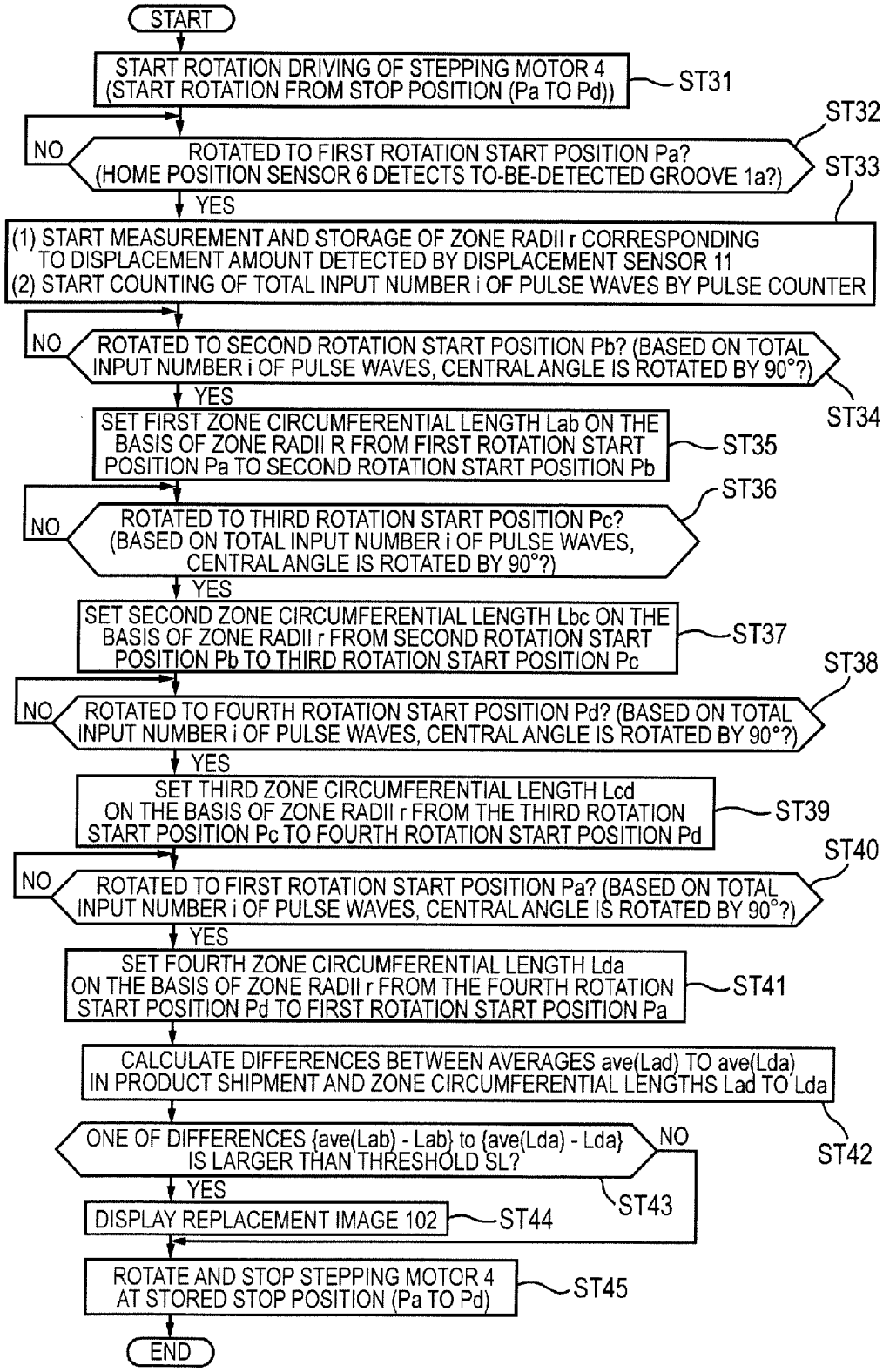
FIG. 11 is a flowchart of a zone circumferential length measurement process in Example 1 of the invention, and illustrating a subroutine of ST21 of FIG. 10.

FIG. 11 is a flowchart of the zone circumferential length measurement process in Example 1 of the invention, and illustrating a subroutine of ST21 of FIG. 10.

In ST31 of FIG. 11, the rotation driving of the stepping motor 4 is started. Namely, the rotation of the regi roll Rr is started from the stored previous stop position.

In ST32, it is determined whether the home position sensor 6 shown in FIG. 2A detects the to-be-detected groove 1*a* or not, thereby determining whether the regi roll has been rotated to the first rotation start position Pa or not. If yes (Y), the process transfers to ST33, and, if no (N), the process repeats ST32.

In ST33, processes of following (1) and (2) are performed, and the process transfers to ST34.

(1) The measurement and storage of the zone radii r corresponding to the displacement amount detected by the displacement sensor 11 are started.

(2) The counting of the total input number i of pulse waves by the pulse counter is started.

In ST34, on the basis of the total input number i of pulse waves which is the value of the pulse counter, it is determined whether the central angle of the driving roller Rr1 has been rotated by 90° or not, thereby determining whether the regi roll has been rotated to the second rotation start position Pb or not. If yes (Y), the process transfers to ST35, and, if no (N), the process repeats ST34.

In ST35, the first zone circumferential length Lab is set on the basis of the zone radii r from the first rotation start position Pa to the second rotation start position Pb. Namely, the first zone circumferential length Lab is measured by calculating $(1/4)\times 2\pi\times\{(r0+r1+\ldots+r9)/10\}$. Then, the process transfers to ST36.

In ST36, on the basis of the total input number i of pulse waves which is the value of the pulse counter, it is determined whether the central angle of the driving roller Rr1 has been rotated by 90° or not, thereby determining whether the regi roll has been rotated to the third rotation start position Pc or not. If yes (Y), the process transfers to ST37, and, if no (N), the process repeats ST36.

In ST37, the second zone circumferential length Lbc is set on the basis of the zone radii r from the second rotation start position Pb to the third rotation start position Pc. Namely, the second zone circumferential length Lbc is measured by calculating $(1/4)\times 2\pi\times\{(r9+r10+\ldots+r18)/10\}$. Then, the process transfers to ST38.

In ST38, on the basis of the total input number i of pulse waves which is the value of the pulse counter, it is determined whether the central angle of the driving roller Rr1 has been rotated by 90° or not, thereby determining whether the regi roll has been rotated to the fourth rotation start position Pd or not. If yes (Y), the process transfers to ST39, and, if no (N), the process repeats ST38.

In ST39, the third zone circumferential length Lcd is set on the basis of the zone radii r from the third rotation start position Pc to the fourth rotation start position Pd. Namely, the third zone circumferential length Lcd is measured by calculating $(1/4)\times 2\pi\times\{(r18+r19+\ldots+r27)/10\}$. Then, the process transfers to ST40.

In ST40, on the basis of the total input number i of pulse waves which is the value of the pulse counter, it is determined whether the central angle of the driving roller Rr1 has been rotated by 90° or not, thereby determining whether the regi roll has been rotated to the first rotation start position Pa or not. If yes (Y), the process transfers to ST41, and, if no (N), the process repeats ST40.

In ST41, the fourth zone circumferential length Lda is set on the basis of the zone radii r from the fourth rotation start position Pd to the first rotation start position Pa. Namely, the fourth zone circumferential length Lda is measured by calculating $(1/4)\times 2\pi\times\{(r27+r28+\ldots+r35+r0)/10\}$. Then, the process transfers to ST42.

In ST42, the differences {ave(Lab)−Lab} to {ave(Lda)−Lda} between the averages ave(Lab) to ave(Lda) of the zone circumferential lengths Lab to Lda in the product shipment and the measured zone circumferential lengths Lab to Lda are calculated. Then, the process transfers to ST43.

In ST43, it is determined whether one of the differences {ave(Lab)−Lab} to {ave(Lda)−Lda} is larger than the preset threshold SL or not. Namely, it is determined whether a replacement timing when the regi roll Rr is to be replaced with a new one because of wear or the like of the regi roll Rr reaches or not. If yes (Y), the process transfers to ST44, and, if no (N), the process proceeds to ST45.

In ST44, the replacement image 102 shown in FIG. 8 is displayed. Then, the process transfers to ST45.

In ST45, the stepping motor 4 is rotated to and stopped at the present one of the rotation start positions Pa to Pd which is the stored stop position. Then, the zone circumferential length measurement process is ended, and the process returns to ST21 of FIG. 10.

(Function of Example 1)

In the thus configured image forming apparatus U of Example 1, as shown in ST3 of FIG. 9, when the job is executed, the sheet S housed in one of the sheet supplying containers TR1 to TR4 is conveyed through the sheet feeding path SH1 via the pickup roll Rp, the separating roll Rs, and the plural conveying rolls Ra, to reach the regi roll Rr, and then skew correction is performed. As shown in ST4 to (1) of ST7 in FIG. 9, in the case where the driving start timing T1 shown in FIG. 4 is measured from the sheet feeding start timing T0 when the sheet feeding start signal is received from the medium supplying apparatus BKS, the rotation driving of the stepping motor 4 is started, and the rotation the regi roll Rr is started.

Here, the rotation of the regi roll Rr in Example 1 is started from the above-described rotation start position Pa to Pd which is the stored previous stop position shown in FIG. 2A.

As shown in ST11 and (1) of ST12 in FIG. 9, in the case where the driving stop timing T3 shown in FIG. 4 is measured from the driving start timing T1, on the basis of the total input number i of pulse waves, the rotation driving of the stepping motor 4 is stopped at the rotation start position Pb to Pa which is adjacent to the present one of the rotation start positions Pa to Pd on the downstream side in the rotational direction. As shown in ST4 to (1) of ST7 in FIG. 9, in the case where the driving start timing T1 is measured from the next sheet feeding start timing T0, the rotation driving of the stepping motor 4 is restarted, and the rotation of the regi roll Rr is restarted from the rotation start position Pb to Pa which is the stored previous stop position.

In the image forming apparatus U of Example 1, therefore, the sheet S is conveyed to the transferring region Q3 while the rotation start position Pa to Pd of the regi roll Rr is updated in the sequence of the first rotation start position Pa which is the previous rotation reference position Pa, the second rotation start position Pb, the third rotation start position Pc, the fourth rotation start position Pd, the first rotation start position Pa, the second rotation start position Pb, . . . . As a result, as compared with the case where the rotation of the regi roll Rr is always started from the same rotation reference position, for example, it is possible to reduce a phenomenon that the sheet S is butted against the regi roll in skew correction and so-called uneven wear in which only the vicinity of the rotation reference position Pa or the stop position is unevenly worn occurs. Furthermore, for example, it is possible to reduce another phenomenon in which the same rotation reference position Pa is continued to be pressed by, particularly, the driven roller Rr2 to cause the driving roller Rr1 to be eccentric or deformed.

In the thus configured image forming apparatus U of Example 1, as shown in ST1 of FIG. 9 and ST21 to ST23 of FIG. 10, the driving start timing calculation process of calculating the driving start timing T1 when the rotation of the regi roll Rr is started is executed before a job is started.

In the driving start timing calculation process in Example 1, as shown in ST21 of FIG. 10 and ST31 to ST45 of FIG. 11, the zone circumferential length measurement process of measuring the zone circumferential lengths Lab to Lda between adjacent ones of the rotation start positions Pa to Pd is performed. In ST22 of FIG. 10, the medium conveying time TM1 during which the sheet S is conveyed from the regi roll Rr to the transferring region Q3, and which is shown in FIG. 4 is calculated by the rotation rate R=10 [rps] per unit time of the stepping motor 4, the preset medium conveying length L=100 [mm], the measured zone circumferential lengths Lab to Lda, and expressions (1-1) to (1-4), (2-1) to (2-4), and (3-1) to (3-4) above.

As shown in ST23 of FIG. 10, for each of the rotation start positions Pa to Pd, the driving start timing T1 which goes back from the medium reach timing T2 shown FIG. 4 by the medium conveying time TM1 is calculated. As shown in FIG. 5, in the case where uneven wear, eccentricity, or the like occurs in the driving roller Rr1 and the rotation angle which is required for the driving roller Rr1 to cause the sheet S to reach from the regi roll Rr to the transferring region Q3 is different depending on the rotation start positions Pa to Pd, namely, the medium conveying time TM1 corresponding to the rotation angle is calculated for each of the rotation start positions Pa to Pd.

As shown in ST5 and (1) of ST6 of FIG. 9, if it is determined that the time reaches the calculated driving start timing T1 for each of the rotation start positions Pa to Pd, the rotation driving of the stepping motor 4 is started, and the rotation of the regi roll Rr is started from the rotation start position Pa to Pd.

As a result, in the image forming apparatus U of Example 1, as compared with the case where the same driving start timing t1 is preset for all of the rotation start positions Pa to Pd, the accuracy of causing the sheet S to reach the transferring region Q3 at the preset medium reach timing T2 is improved.

Figure 12:
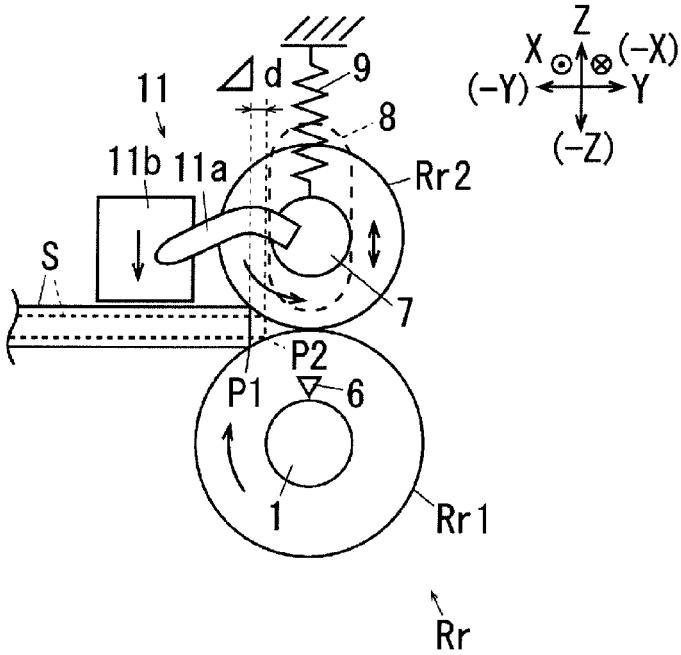
FIG. 12 is a functional diagram of Example 1 in which the case where a sheet butted against the regi roll in skew correction is a thick sheet is indicated by the solid line, and the case where the sheet is an ordinary sheet is indicated by the broken line.

FIG. 12 is a functional diagram of Example 1 in which the case where a sheet butted against the regi roll in skew correction is a thick sheet is indicated by the solid line, and the case where the sheet is an ordinary sheet is indicated by the broken line.

Referring to FIG. 12, when the sheet S is butted against the regi roll Rr in skew correction, the sheet S is stopped in an upstream end portion of the regi roll Rr in the medium conveying direction. At this time, as indicated by the solid and broken lines in FIG. 12, a thick-sheet position P1 where the front end of the sheet S in the medium conveying direction is stopped in the case where the sheet S is "thick sheet" is placed upstream in the medium conveying direction from an ordinary-sheet position P2 where the front end of the sheet S in the medium conveying direction is stopped in the case where the sheet S is "ordinary sheet". In the case where the sheet S is "thick sheet", therefore, the medium conveying length L is prolonged by the gap Δd shown in FIG. 12 between the thick-sheet position P1 and the ordinary-sheet position P2, and also the medium conveying time TM1 is prolonged as compared with the case where the sheet S is "ordinary sheet". Namely, L=100+Δd [mm] is held, and also the medium conveying time TM1 is prolonged by the degree corresponding to the gap Δd from expressions (3-1) to (3-4) above.

In Example 1, by the post-sheet feeding pre-conveyance time table shown in FIG. 6, the post-sheet feeding pre-conveyance time TM0 which extends from the sheet feeding start timing T0 when the feeding of the sheet S is started, to the driving start timing T1 is preset in accordance with the kind of the fed sheet S such as "thick sheet" or "ordinary sheet". In Example 1, namely, the post-sheet feeding pre-conveyance time TM0 in the case where the sheet S is "thick sheet" is set to be shorter by the time corresponding to the gap Δd than that in the case where the sheet S is "ordinary sheet", so that the medium conveying time TM1 in the case where the sheet S is "thick sheet" is prolonged.

As a result, in the image forming apparatus U of Example 1, the accuracy of causing the sheet S to reach the transferring region Q3 at the medium reach timing T2 is further improved as compared with the case where the post-sheet feeding pre-conveyance time TM0 is not set depending on the kinds of the sheet S.

In the zone circumferential length measurement process in Example 1, as shown in ST31 to ST41 of FIG. 11, while one rotation is made with starting from the first rotation start position Pa which is the rotation reference position Pa where the home position sensor 6 shown in FIG. 2 detects the to-be-detected groove 1*a*, and in the sequence of the second rotation start position Pb, the third rotation start position Pc, the fourth rotation start position Pd, and the first rotation start position Pa, the values r0 to r35 of the zone radii r of all of the 36 zones are measured in accordance with the displacement amount detected by the displacement sensor 11 shown in FIG. 2. As shown in ST35, ST37, ST39, and ST41, $(1/4)\times 2\pi\times\{(r0+r1+\ldots+r9)/10\}$, $(1/4)\times 2\pi\times\{(r9+r10+\ldots+r18)/10\}$, $(1/4)\times 2\pi\times\{(r18+r19+\ldots+r27)/10\}$, and $(1/4)\times 2\pi\times\{(r27+r28+\ldots+r35+r0)/10\}$ are calculated, whereby the zone circumferential lengths Lab to Lda are measured. As a result, in the image forming apparatus U of Example 1, the zone circumferential lengths Lab to Lda are measured by the displacement amount which is the detection result of the displacement sensor 11.

In the zone circumferential length measurement process in Example 1, as shown in ST42 and ST43 of FIG. 11, the replacement image 102 shown in FIG. 8 is displayed in the case where one of the differences {ave(Lab)−Lab} to {ave(Lda)−Lda} between the averages ave(Lab) to ave(Lda) of the zone circumferential lengths in the product shipment and the measured zone circumferential lengths Lad to Lda is larger than the preset threshold SL. As a result, in the image forming apparatus U of Example 1, temporal deterioration due to wear of the regi roll Rr or the like is determined based on the displacement amount detected by the displacement sensor 11. If the replacement timing reaches, replacement timing is informed to the user to promote replacement of the regi roll Rr.

In the thus configured image forming apparatus U of Example 1, as shown in ST8 of FIG. 9, when the zone circumferential length measurement process is to be performed, the sheet thickness ds which is the thickness of the sheet S is measured on the basis of the detection result of the displacement sensor 11 before the regi roll Rr conveys the sheet S, and that of the displacement sensor 11 when the sheet S is conveyed from the regi roll Rr. When the sheet thickness ds is larger than the threshold Sd which is preset in accordance with the kind of the sheet S such as "thick sheet" or "ordinary sheet", as shown in ST9 and ST10 of FIG. 9, it is determined that double feed occurs, the job is aborted, and the double feed image 101 shown in FIG. 7 is displayed. As a result, in the image forming apparatus U of Example 1, double feed is determined based on the displacement amount detected by the displacement sensor 11, and, in the case of double feed, the job is aborted, and double feed is informed to the user to promote removal of the doubly fed sheets S.

In the image forming apparatus U of Example 1, therefore, the displacement sensor 11 can sense three items or the zone circumferential lengths Lab to Lda, the replacement timing due to wear or the like, and double feed. Consequently, sharing of functions, and reduction of the number of components can be realized.

In the driving gear train 5 in Example 1, as shown in FIG. 2B, the tooth number ratio of the roller gear 2 to the motor gear 3 is preset to n:1. Therefore, the driving gear train is configured so as to cause the driving roller Rr1 to make one rotation in accordance with n rotations of the stepping motor 4. Even in the case where a periodic speed change due to eccentricity of the roller gear 2 or the like, i.e., so-called speed unevenness, and speed unevenness of the motor gear 3 occur, therefore, the period of each speed unevenness is settled to an integer multiple during one rotation of the driving roller Rr1.

As a result, in the image forming apparatus U of Example 1, as compared with the case where the tooth number ratio of the gears 2 and 3 is not set to n:1, the history of the speed change during one rotation of the regi roll Rr, i.e., the so-called speed profile is identical for each rotation, and the change of the speed profile is reduced. Therefore, the accuracy of causing the sheet S to reach the transferring region Q3 at the medium reach timing T2 is further improved.

In the thus configured image forming apparatus U of Example 1, as shown in ST14 to ST17 of FIG. 9, if the number Nj of the sheets S on which an image is recorded, and counted by the sheet counter exceeds the preset recalculation determination value $N_{max}$, the driving start timing calculation process is again performed. In the case where, for example, $N_{max}$=1,000 (sheets) is set, therefore, the driving start timing calculation process is performed every 1,000 sheets, and hence the driving start timing T1 for each of the rotation start positions Pa to Pd is again set in accordance with temporal deterioration due to wear of the regi roll Rr or the like.

EXAMPLE 2

Next, Example 2 of the invention will be described. In the description of Example 2, components corresponding to those of Example 1 described above are denoted by the same reference numerals, and their detailed description is omitted.

Example 2 is different from Example 1 in the following points, but configured in a similar manner as Example 1 in the other points.

(Description of Regi Roll Rr in Example 2)

Figure 13:
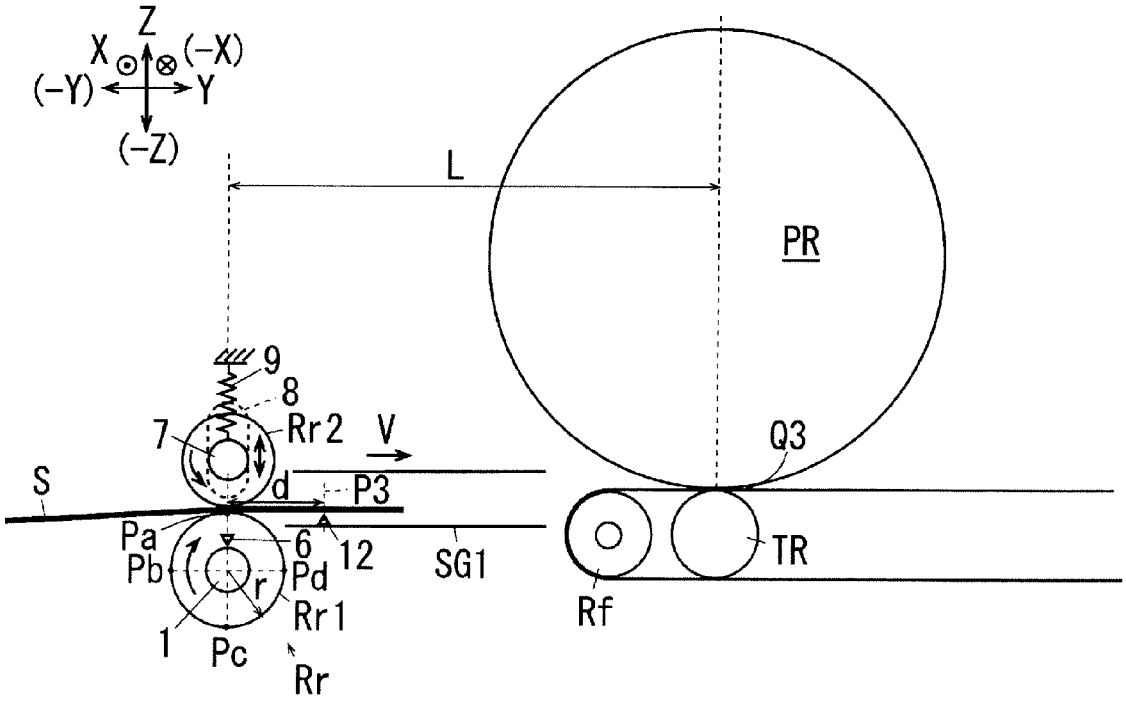
FIG. 13 is an enlarged diagram of a regi roll in Example 2 of the invention, corresponding to FIG. 2A of Example 1, and illustrating main portions of the regi roll and a transferring region.

FIG. 13 is an enlarged diagram of a regi roll in Example 2 of the invention, corresponding to FIG. 2A of Example 1, and illustrating main portions of the regi roll and a transferring region.

Referring to FIG. 13, in the image forming apparatus U of in Example 2, the displacement sensor 11 in Example 1 is omitted, and a registration-out sensor 12 which is an example of the medium detecting member for detecting the sheet S is placed at a medium detection position P3 which is preset between the regi roll Rr and the transferring region Q3.

In Example 2, the pre-transfer sheet guide SG1 which extends from the linearly elongating regi roll Rr to the transferring region Q3 is horizontally linearly extended, and the medium detection position P3 in Example 2 is set below the pre-transfer sheet guide SG1 which linearly elongates. In Example 2, the medium detection length d from the regi roll Rr to the medium detection position P3 is preset so as to be equal to the averages ave(Lad) to ave(Lda) of the zone circumferential lengths Lad to Lda in the product shipment, i.e., 15.71 [mm].

(Description of Controller C in Example 2)

Figure 14:
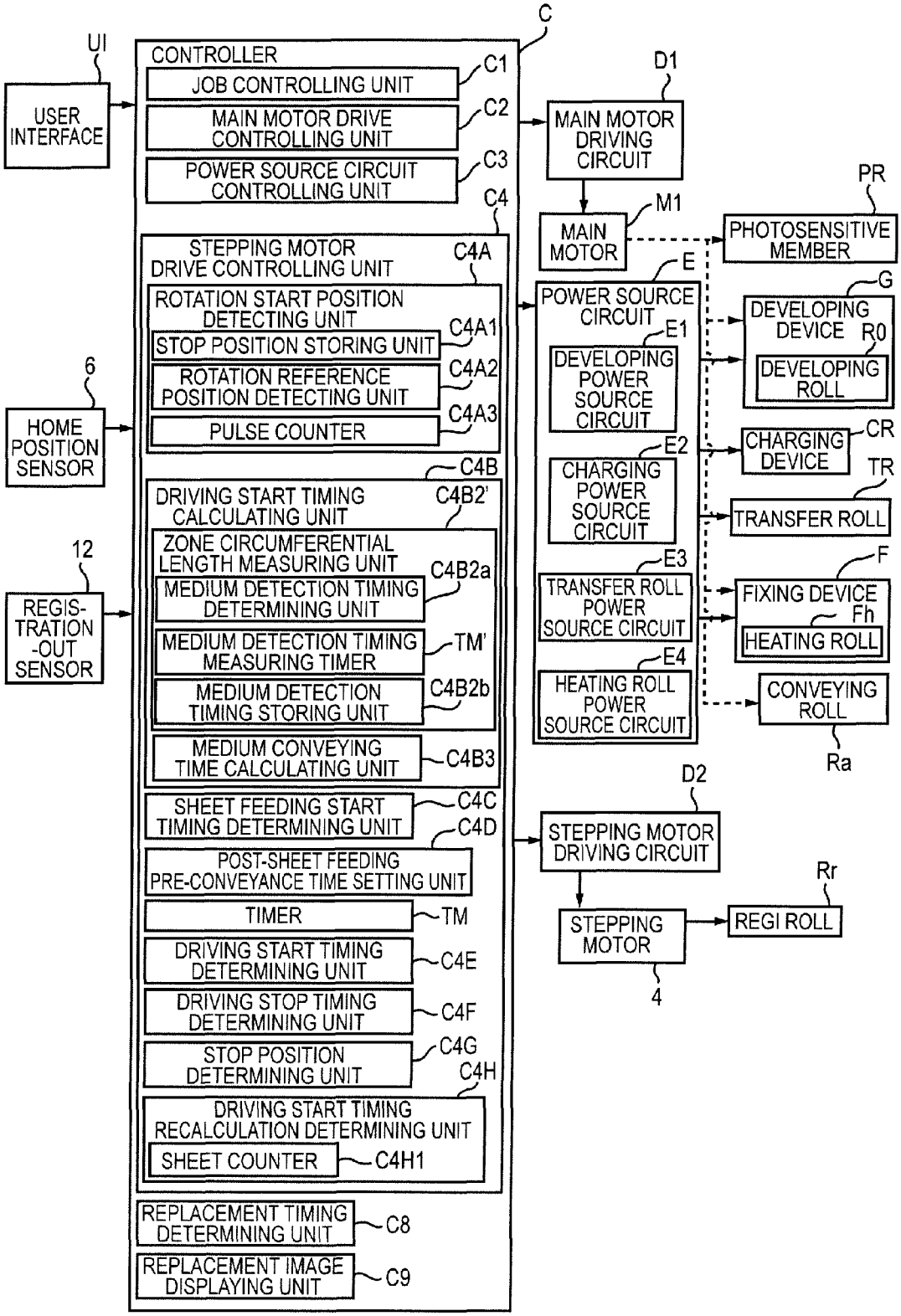
FIG. 14 is a view showing functions of a controller of an image forming apparatus of Example 2 of the invention, in the form of a block diagram, and corresponding to FIG. 3 of Example 1.

FIG. 14 is a view showing functions of a controller of the image forming apparatus of Example 2 of the invention, in the form of a block diagram, and corresponding to FIG. 3 of Example 1.

(Signal Output Elements Connected to Controller C)

Referring to FIG. 14, output signals of signal output elements such as the registration-out sensor 12 are supplied to the controller C in Example 2.

12: Registration-Out Sensor

The registration-out sensor 12 senses the presence of the sheet S which is conveyed to the medium detection position P3, and supplies the sense signal to the controller C.

(Function of Controller C)

In the controller C in Example 2, the zone radius measuring unit C4B1, the medium thickness measuring unit C5, the double feed determining unit C6, and the double feed image displaying unit C7 in Example 1 are omitted. The driving start timing calculating unit C4B in Example 2 has a zone circumferential length measuring unit C4B2' in place of the zone circumferential length measuring unit C4B2. C4B2': Zone circumferential length measuring unit The zone circumferential length measuring unit C4B2' measures the circumferential lengths Lab to Lda on the basis of the rotation rate R of the stepping motor 4 per unit time, the medium detection length d, and a medium detection time TM3 which extends from the driving start timing T1 to a medium detection timing T4 when the front end of the sheet S in the medium conveying direction reaches to the medium detection position P3 and the registration-out sensor 12 detects the sheet S.

Figure 15:
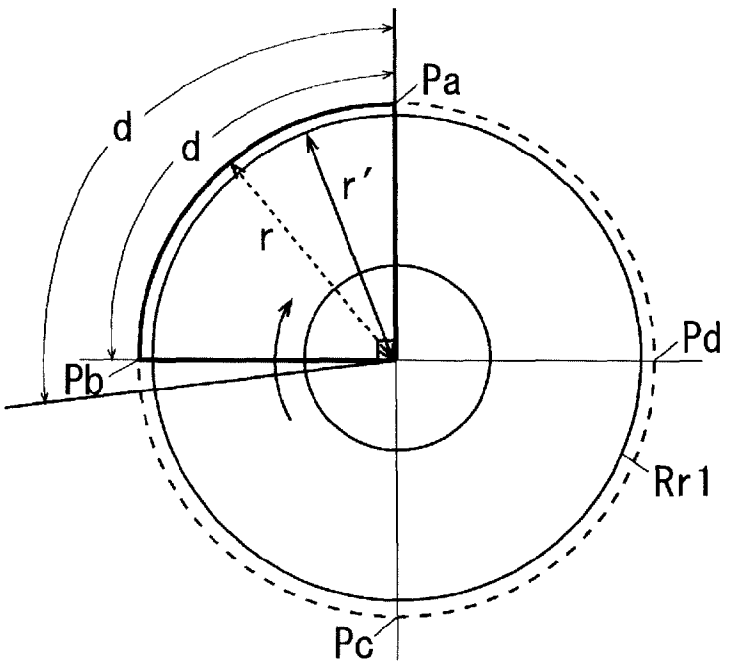
FIG. 15 is a view showing an example of a first zone circumferential length and a medium detection length, in which a driving roller that is worn after operation is indicated by the solid line, and the driving roller in the product shipment is indicated by the broken line.

FIG. 15 is a view showing an example of a first zone circumferential length and a medium detection length, in which the driving roller that is worn after operation is indicated by the solid line, and the driving roller in the product shipment is indicated by the broken line.

The zone circumferential length measuring unit C4B2' in Example 2 has: a medium detection timing determining unit C4B2*a* which, on the basis of on the sense signal of the registration-out sensor 12, determines whether the front end of the sheet S in the medium conveying direction is detected or not, thereby determining whether the time reaches the medium detection timing T4 or not; a medium detection timing measuring timer TM' which measures the medium detection time TM3 that extends from the driving start timing T1 to the medium detection timing T4, for each of the rotation start positions Pa to Pd; and a medium detection timing storing unit C4B2*b* which stores the measured value of the medium detection time TM3 for each of the rotation start positions Pa to Pd.

Specifically, as shown in FIG. 15, the zone circumferential length measuring unit C4B2' approximately calculates following expressions (4-1) to (4-4) to measure the zone circumferential lengths Lab to Lda, in the case where a predicted value of the medium detection time TM3 is set to t=15.71/628.32 [s], and the measured values of the medium detection timing measuring timer TM' with respect to the medium detection times TM3 for the respective rotation start positions Pa to Pd where rotation is started are ta to td.

$$Lab=(t/ta)\times d \quad (4\text{-}1)$$

$$Lbc=(t/tb)\times d \quad (4\text{-}2)$$

$$Lcd=(t/tc)\times d \quad (4\text{-}3)$$

$$Lda=(t/td)\times d \quad (4\text{-}4)$$

(Description of Flowchart of Example 2)

Next, the flow of the process of the image forming apparatus U of Example 2 of the invention will be described with reference to flowcharts.

(Description of Flowchart of Stepping Motor Driving Control Process in Example 2)

Figure 16:
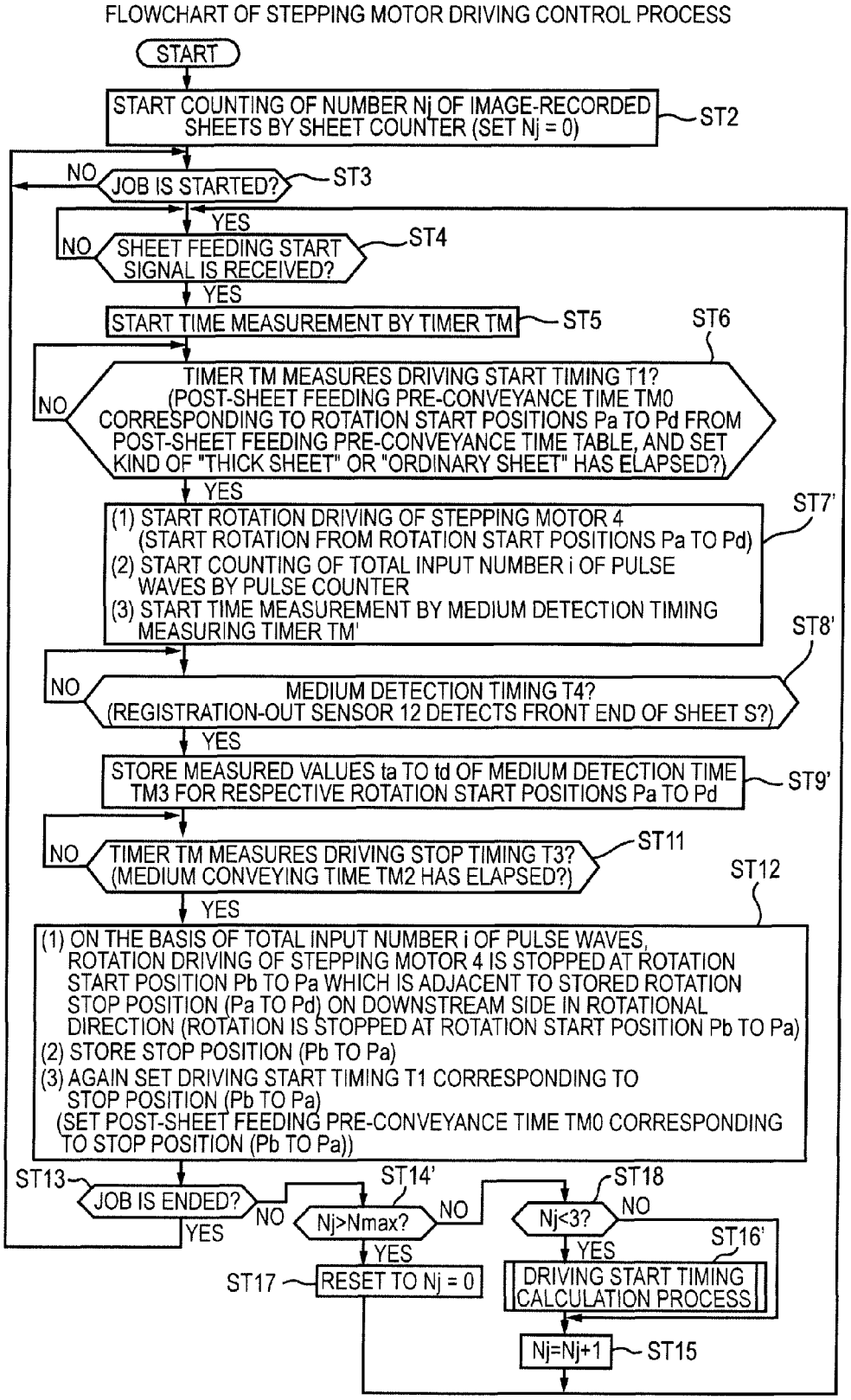
FIG. 16 is a flowchart of the stepping motor driving control process in Example 2 of the invention, and corresponding to FIG. 9 of Example 1.

FIG. 16 is a flowchart of the stepping motor driving control process in Example 2 of the invention, and corresponding to FIG. 9 of Example 1.

Referring to FIG. 16, in the flowchart of the stepping motor driving control process in Example 2, ST1 and ST10 of the flowchart of the stepping motor driving control process in Example 1 are omitted, and following ST7' to ST9', ST14', ST18, and ST16' are performed in place of ST7 to ST9, ST14, and ST16. The other steps ST2 to ST6, ST11 to ST13, ST15, and ST17 are identical with those of Example 1, and hence their detailed description is omitted.

In ST7' of FIG. 16, processes of following (1) to (3) are performed, and the process transfers to ST8'.

(1) The rotation driving of the stepping motor 4 is started. Namely, the rotation of the regi roll Rr is started from the present one of the rotation start positions Pa to Pd which is the stop position.

(2) The counting of the total input number i of pulse waves by the pulse counter is started.

(3) The time measurement by the medium detection timing measuring timer TM' is started.

In ST8', it is determined whether the registration-out sensor 12 detects the front end of the sheet S in the medium conveying direction or not, or namely it is determined whether the time reaches the medium detection timing T4 or not. If yes (Y), the process transfers to ST9', and, if no (N), the process repeats ST8'.

In ST9', the measured values ta to td of the medium detection time TM3 for the respective rotation start positions Pa to Pd are stored by the medium detection timing measuring timer TM'. Then, the process transfers to ST11.

In ST14', it is determined whether the number Nj of the sheets S on which the image is recorded, and indicating the value of the sheet counter exceeds the preset recalculation determination value $N_{max}$ or not. Namely, it is determined whether $Nj>N_{max}$ is held or not. If yes (Y), the process transfers to ST17, and, if no (N), the process proceeds to ST18.

In ST18, it is determined whether the number Nj of the sheets S on which the image is recorded, and indicating the value of the sheet counter is smaller than 3 or not, or namely it is determined whether Nj<3 is held or not. If yes (Y), the process transfers to ST16', and, if no (N), the process transfers to ST15.

In ST16', a driving start timing calculation process shown in FIG. 17 which will be described later is performed, and then the process transfers to ST15.

(Description of Flowchart of Driving Start Timing Calculation Process in Example 2)

Figure 17:
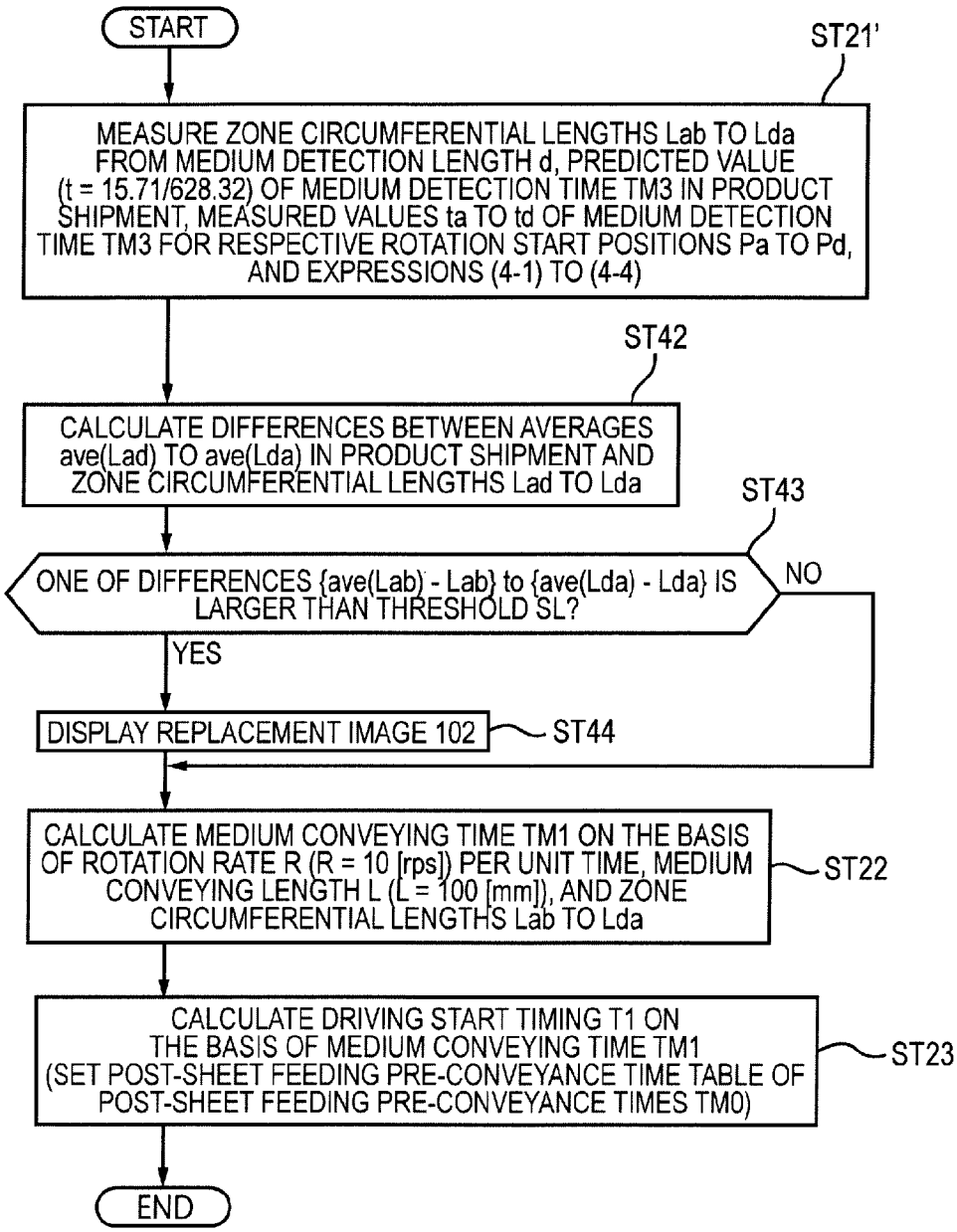
FIG. 17 is a flowchart of a driving start timing calculation process in Example 2 of the invention, corresponding to FIG. 10 of Example 1, and illustrating a subroutine of ST16' of FIG. 16.

FIG. 17 is a flowchart of the driving start timing calculation process in Example 2 of the invention, corresponding to FIG. 10 of Example 1, and illustrating a subroutine of ST16' of FIG. 16.

Referring to FIG. 17, in the flowchart of the driving start timing calculation process in Example 2, ST21' which will be described later, and ST42 to ST44 shown in FIG. 12 are performed in place of ST21 of the driving start timing calculation process in Example 1, and the other steps ST22 and ST23 are identical with those of Example 1. Therefore, their detailed description is omitted.

In ST21' of FIG. 17, the zone circumferential lengths Lab to Lda are measured from the medium detection length d, the predicted value t=15.71/628.32 of the medium detection time TM3 in the product shipment, the measured values ta to td of the medium detection time TM3 for the respective rotation start positions Pa to Pd, and expressions (4-1) to (4-4). Then, the process proceeds to ST22.

(Function of Example 2)

In the thus configured image forming apparatus U of Example 2, as shown in (3) of ST7' to ST9' of FIG. 16, it is determined whether the time reaches the medium detection timing T4 when the front end of the sheet S in the medium conveying direction is detected by the registration-out sensor 12 or not, thereby measuring the medium detection time TM3 which extends from the driving start timing T1 to the medium detection timing T4. In Example 2, as shown in ST13, ST14', ST18, ST16', ST15, and ST17 of FIG. 16, during a period from the start of the job to the recording of the image on four sheets S, the medium detection times TM3 for the respective rotation start positions Pa to Pd are measured. In Example 2, as shown in ST15 of FIG. 16, ST21' of FIG. 17, and above-described expressions (4-1) to (4-4), the zone circumferential lengths Lab to Lda are approximately calculated on the basis of the medium detection times TM3 for the respective measured rotation start positions Pa to Pd.

In the image forming apparatus U of Example 2, as a result, the zone circumferential lengths Lad to Lda are measured on the basis of the detection result of the registration-out sensor 12.

In the image forming apparatus U of Example 2, as shown in ST22 and ST23 of FIG. 17, similarly with the image forming apparatus U of Example 1, the driving start timing TM1 is calculated for each of the rotation start positions Pa to Pd and the post-sheet feeding pre-conveyance time table is set in the driving start timing calculation process, on the basis of the zone circumferential lengths Lad to Lda. Namely, the driving start timing T1 for each of the calculated rotation start positions Pa to Pd is calculated and set.

In the image forming apparatus U of Example 2, as a result, similarly with the image forming apparatus U of Example 1, as compared with the case where the same driving start timing T1 is preset for all of the rotation start positions Pa to Pd, the accuracy of causing the sheet S to reach the transferring region Q3 at the preset medium reach timing T2 is improved.

In the thus configured image forming apparatus U of Example 2, the medium conveying direction from the regi roll Rr to the registration-out sensor 12 is formed so as to linearly extend in the horizontal direction, by the pre-transfer sheet guide SG1 shown in FIG. 13. As a result, in the image forming apparatus U of Example 2, as compared with the case where the medium conveying direction is curvedly extended and the detection of the sheet S is dispersed, the medium detection time TM3 for each of the rotation start positions Pa to Pd is accurately measured, and the circumferential lengths Lab to Lda are accurately measured.

In the thus configured image forming apparatus U of Example 2, the medium detection length d is preset so as to be equal to the averages ave(Lad) to ave(Lda) of the zone circumferential lengths Lad to Lda in the product shipment. As a result, in the image forming apparatus U of Example 2, as compared with the case where the medium detection length d is not set correspondingly with the averages ave(Lad) to ave (Lda), the medium detection time TM3 for each of the rotation start positions Pa to Pd is easily calculated, and the zone circumferential lengths Lad to Lda are easily measured.

Furthermore, the image forming apparatus U of Example 2 achieves similar functions and effects as those of the image forming apparatus U of Example 1.

EXAMPLE 3

Next, Example 3 of the invention will be described. In the description of Example 3, components corresponding to those of Example 1 described above are denoted by the same reference numerals, and their detailed description is omitted.

Example 3 is different from Example 1 in the following points, but configured in a similar manner as Example 1 in the other points.

(Description of Controller C in Example 3)

Figure 18:
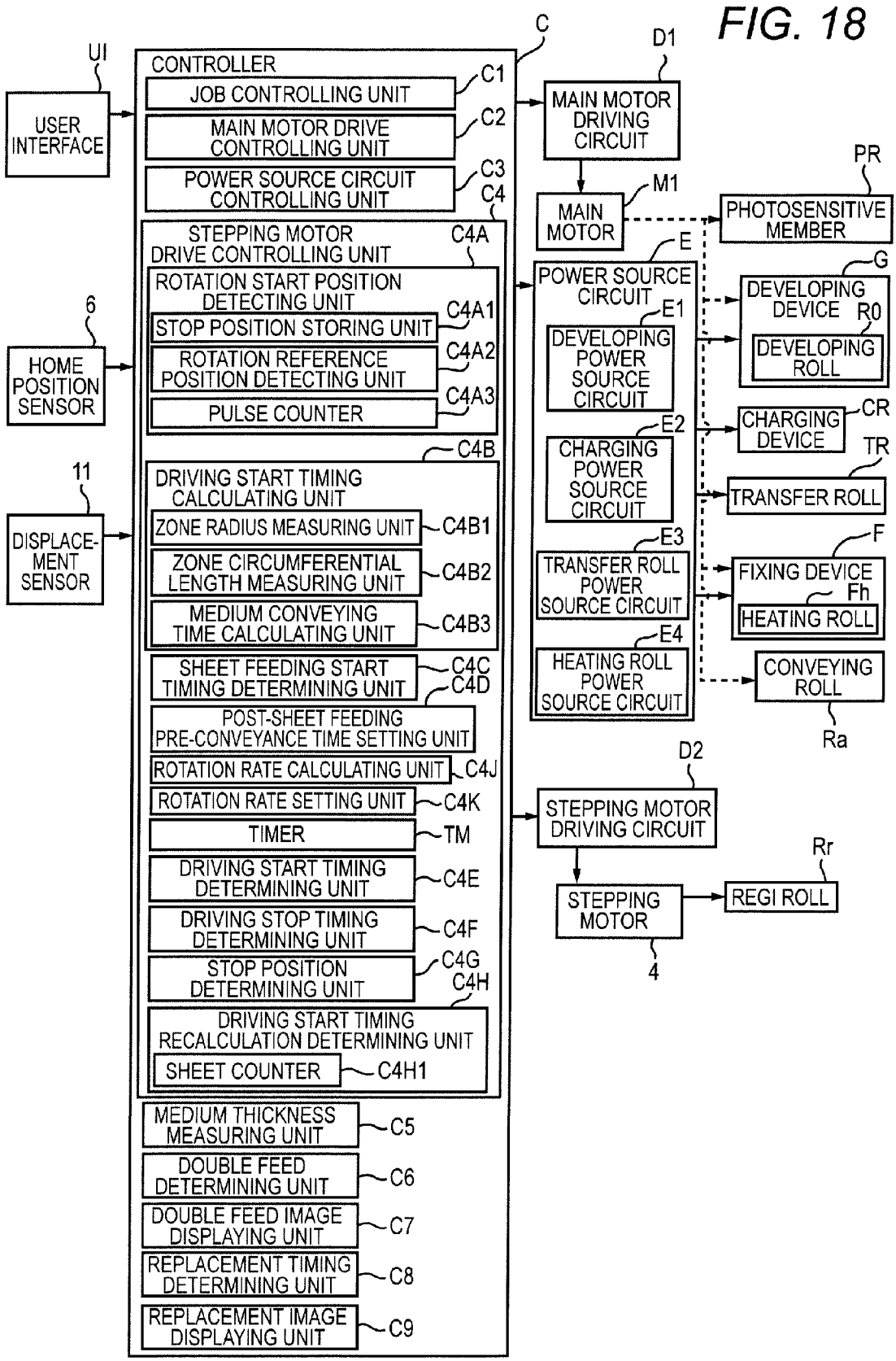
FIG. 18 is a view showing functions of a controller of an image forming apparatus of Example 3 of the invention, in the form of a block diagram, and corresponding to FIG. 3 of Example 1.

FIG. 18 is a view showing functions of a controller of an image forming apparatus of Example 3 of the invention, in the form of a block diagram, and corresponding to FIG. 3 of Example 1.

FIG. 19 is a view showing an example of medium conveying times in Example 3 of the invention, at respective rotation start positions in shipment of a product, and those at respective rotation start positions after operation, and corresponding to FIG. 5 of Example 1.

(Function of Controller C)

Referring to FIG. 18, in the stepping motor drive controlling unit C4 in Example 3, a rotation rate calculating unit C4J and a rotation rate setting unit C4K are newly added.

C4J: Rotation Rate Calculating Unit

As shown in FIG. 19, the rotation rate calculating unit C4J calculates a rotation rate R' of the regi roll Rr per unit time corresponding to the measured circumferential lengths Lab to Lda, on the basis of the averages ave(Lab) to ave(Lda) of the zone circumferential lengths Lad to Lda in the product shipment, and the zone circumferential lengths Lab to Lda which are measured by the zone circumferential length measuring unit C4B2. The rotation rate calculating unit C4J in Example 3 calculates the rotation rate R' of the regi roll Rr per unit time by following expression (5):

$$R' \times (Lab + \ldots + Lda) = R \times (ave(Lab) + \ldots + ave(Lda)) \quad (5)$$

$$R' = \{R \times (ave(Lab) + \ldots + ave(Lda))\} / (Lab + \ldots + Lda)$$

$$= 628.32 / (Lab + Lbc + \ldots + Lda)$$

C4K: Rotation Rate Setting Unit

In the rotation rate setting unit C4K, the rotation rate R' of the regi roll Rr per unit time which is calculated by the rotation rate calculating unit C4J is set as the rotation rate R=R' per unit time for rotating the stepping motor 4.

For example, the case will be considered where, as shown in FIG. 19, the driving roller Rr1 is used, and, in the zones (Pa to Pb), (Pb to Pc), (Pc to Pd), and (Pd to Pa) from the first rotation start position Pa to the second rotation start position Pb, from the second rotation start position Pb to the third rotation start position Pc, from the third rotation start position Pc to the fourth rotation start position Pd, and from the fourth rotation start position Pd to the first rotation start position Pa, the average values (r0+ . . . +r9)/10, (r9+ . . . +r18)/10, (r18+ . . . +r27)/10, and (r27+ . . . +r35+r0)/10 of the zone radii r are 10 [mm], 8.7 [mm], 9.5 [mm], and 9.5 [mm], respectively. At this time, the zone circumferential lengths Lab to Lda of the zones (Pa to Pb), (Pb to Pc), (Pc to Pd), and (Pd to Pa) are 15.71 [mm], 13.67 [mm], 14.92 [mm], and 14.92 [mm], respectively.

In this case, the rotation rate R' of the regi roll Rr per unit time which is calculated by above-described expression (5) is set to 10.6 [mm]. In this case, the remaining medium conveying lengths ΔL for the rotation start positions Pa to Pd and calculated by expressions (1-1) to (1-4) above are 11.41 [mm], 12.19 [mm], 10.94 [mm], and 10.15 [mm], respectively. The remaining rotation angles Δθ for the rotation start positions Pa to Pd and calculated by expressions (2-1) to (2-4) above are 68.8°, 73.5°, 62.7°, and 66.8°, respectively. The medium conveying times TM1 for the rotation start positions Pa to Pd are calculated by the rotation rate R=10.6 [mm] of the regi roll Rr per unit time set by the rotation rate setting unit C4K, expressions (3-1) to (3-4) above, and R=R' are 159.4 [ms], 160.6 [ms], 157.8 [ms], and 158.9 [ms], respectively.

Therefore, the total circumferential length of the driving roller Rr1 after operation of the example is 15.71+13.67+14.92+14.92=59.22 [mm], and hence shorter than that of 62.83 [mm] in the product shipment, and that of 62.36 of the driving roller Rr1 after operation shown in FIG. 5 of Example 1. However, the time differences between the medium conveying times TM1 from the rotation start positions Pa to Pd and the medium conveying time TM1*a*=159.2 [ms] in the product shipment are +0.2 [ms], +1.5 [ms], −1.4 [ms], and −0.3 [ms], respectively. Therefore, it is seen that the time differences are not large as compared with the driving roller Rr1 after operation shown in FIG. 5 in Example 1.

(Description of Flowchart of Example 3)

Next, the flow of the process of the image forming apparatus U of Example 3 of the invention will be described with reference to a flowchart.

(Description of Flowchart of Stepping Motor Driving Control Process in Example 3)

Figure 20:
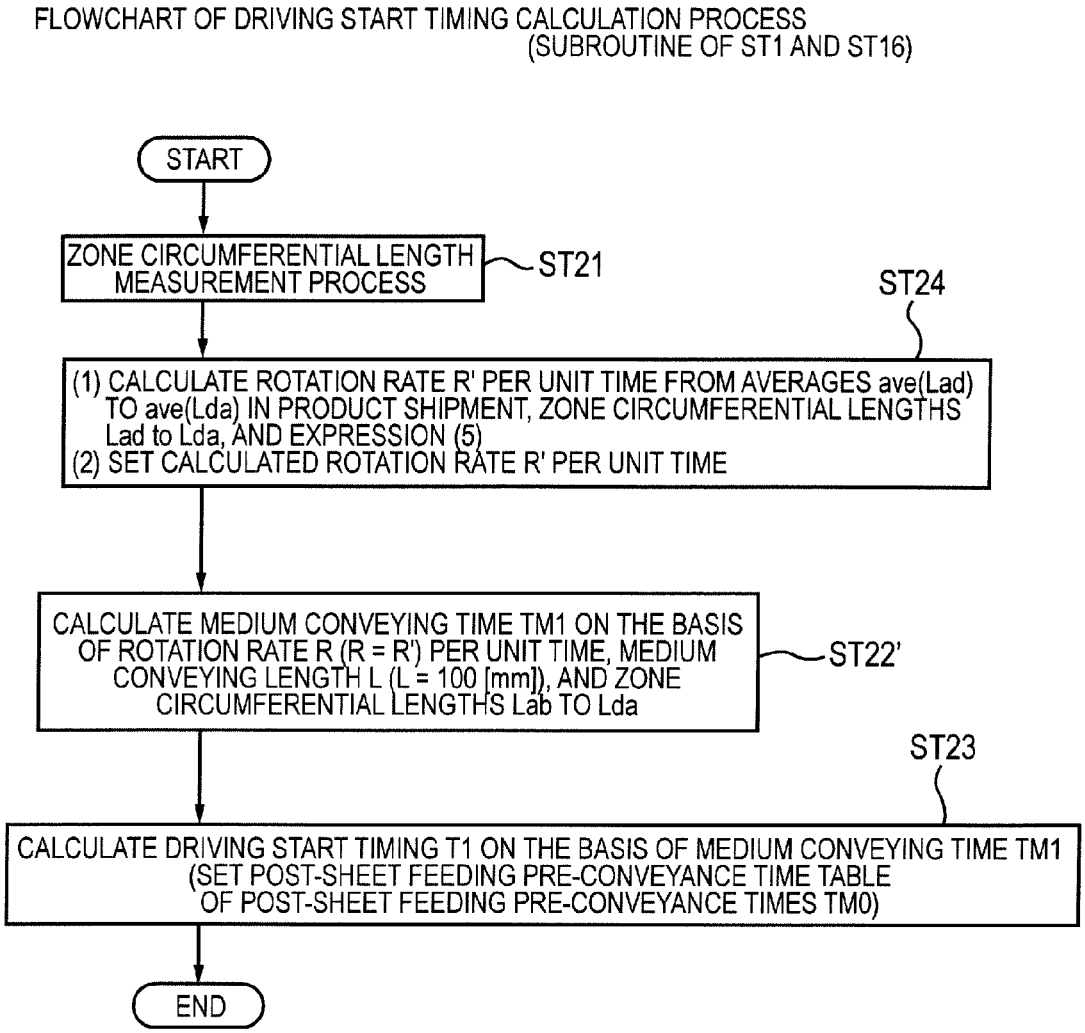
FIG. 20 is a flowchart of a driving start timing calculation process in Example 3 of the invention, corresponding to FIG. 10 of Example 1, and illustrating a subroutine of ST1 and for ST16 of FIG. 9.

FIG. 20 is a flowchart of a driving start timing calculation process in Example 3 of the invention, corresponding to FIG. 10 of Example 1, and illustrating a subroutine of ST1 and ST16 of FIG. 9.

Referring to FIG. 20, in the flowchart of the stepping motor driving control process in Example 3, ST24 and ST22' are performed in place of ST22 of the flowchart of the stepping motor driving control process in Example 1, and the other steps ST21 and ST23 are identical with those of Example 1. Therefore, their detailed description is omitted.

In ST24, processes of following (1) and (2) are performed, and the process transfers to ST22'.

(1) The rotation rate R' of the regi roll Rr per unit time is calculated from the averages ave(Lab) to ave(Lda) of the zone circumferential lengths Lad to Lda in the product shipment shown in FIG. 19, the measured zone circumferential lengths Lab to Lda, and expression (5) above.

(2) The calculated rotation rate R' of the regi roll Rr per unit time is set as the rotation rate R=R' per unit time for rotating the stepping motor 4.

In ST22', the medium conveying times TM1 shown in FIG. 4 is calculated on the basis of expressions (1-1) to (1-4), (2-1) to (2-4), and (3-1) to (3-4) above, the rotation rate R=R' per unit time, the medium conveying length L, and the zone circumferential lengths Lab to Lda. Then, the process transfers to ST23.

(Function of Example 3)

In the thus configured image forming apparatus U of Example 3, the rotation rate R' of the regi roll Rr per unit time which, as shown in ST24 of FIG. 20, is calculated from the averages ave(Lab) to ave(Lda) of the zone circumferential lengths Lad to Lda in the product shipment, the zone circumferential lengths Lab to Lda measured by the zone circumferential length measurement process shown is ST20 of FIG. 20 and ST31 to ST41 of FIG. 11, and expression (5) above is set as the rotation rate R=R' per unit time for rotating the stepping motor 4. As shown in ST22' of FIG. 20, the medium conveying times TM1 shown in FIG. 4 is calculated on the basis of the calculated rotation rate R=R' per unit time, the medium conveying length L, and the zone circumferential lengths Lab to Lda.

As a result, as shown in FIG. 19, even when the total circumferential length is shortened by temporal wear of the driving roller Rr1 after operation or the like, the time difference of the medium conveying time TM1 for each of the calculated rotation start positions Pa to Pd with respect to the medium conveying time TM1*a*=159.2 [ms] in the product shipment does not become large. In an assumed case where the rotation rate R per unit time is not again set, the time difference becomes large. In accordance with this, the driving start timing T1 shown in FIG. 4 is excessively early, and the post-sheet feeding pre-conveyance times TM0 shown in FIG. 5 is excessively short, so that the time reaches the driving start timing T1 before the sheet reaches the regi roll Rr, or the driving start timing t1 before skew correction is sufficiently performed. By contrast, in the image forming apparatus U of Example 3 in which the rotation rate R=R' per unit time is again set, the time difference between the medium conveying time TM1*a* in the product shipment and the calculated medium conveying time TM1 for each of the rotation start positions Pa to Pd is not excessively large, and phenomena such as that the rotation driving of the stepping motor 4 is lately performed are reduced.

Furthermore, the image forming apparatus U of Example 3 achieves similar functions and effects as those of the image forming apparatus U of Example 1.

EXAMPLE 4

Next, Example 4 of the invention will be described. In the description of Example 4, components corresponding to those of Example 2 described above are denoted by the same reference numerals, and their detailed description is omitted.

Example 4 is different from Example 2 in the following points, but configured in a similar manner as Example 2 in the other points.

(Description of Controller C in Example 4)

FIG. 21 is a view showing functions of a controller of an image forming apparatus of Example 4 of the invention, in the form of a block diagram, and corresponding to FIG. 14 of Example 2.

Figure 22A:
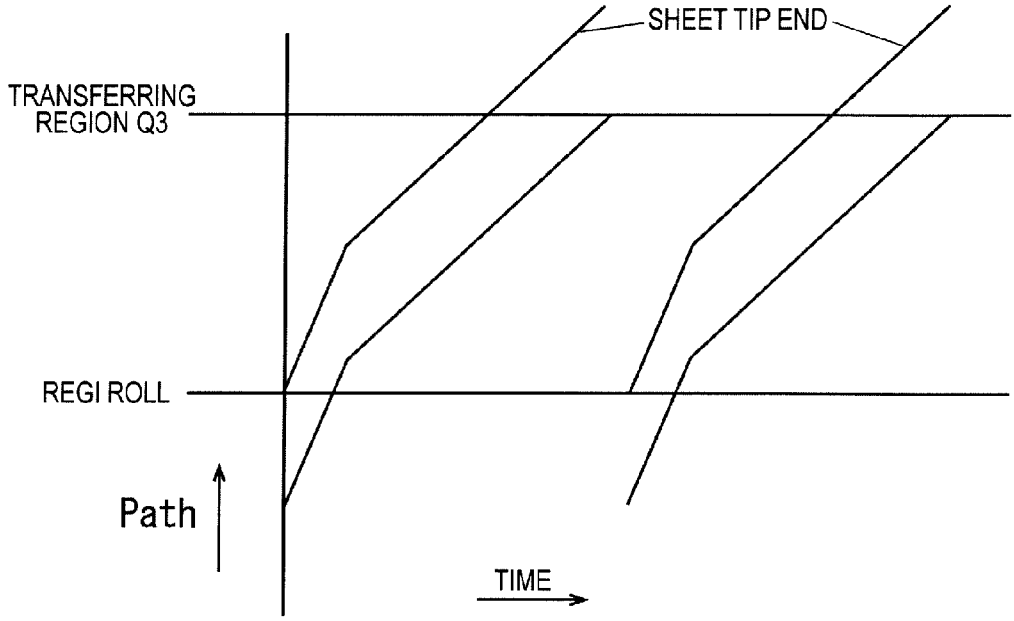
FIGS. 22A and 22B are views of a stepping motor driving control process in Example 4 of the invention, and corresponding to FIG. 4 of Example 1.
Figure 22B:
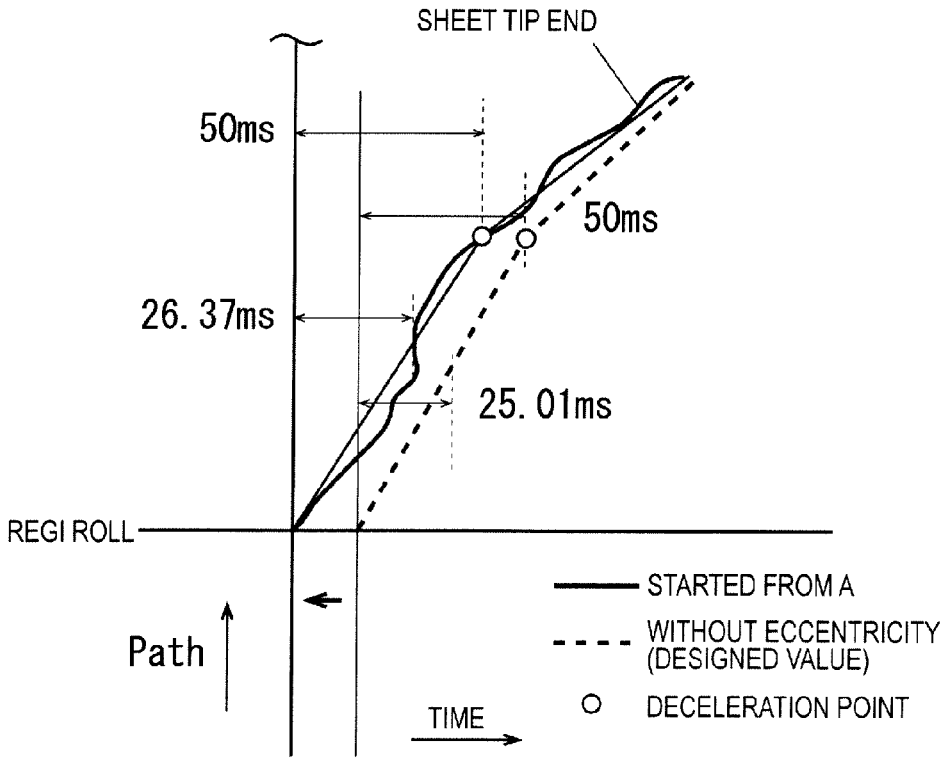

FIGS. 22A and 22B are views of a stepping motor driving control process in Example 4 of the invention, and corresponding to FIG. 4 of Example 1, FIG. 22A is a view in which the ordinate indicates a sheet conveying length, and the abscissa indicates the time, and which is an example of a graph showing the front end of the initial sheet in the medium conveying direction, the rear end of the initial sheet in the medium conveying direction, the front end of the next sheet in the medium conveying direction, and the rear end of the next sheet in the medium conveying direction, and FIG. 22B is an enlarged view of a graph showing the front end of the initial sheet in the medium conveying direction in the view of FIG. 22A illustrating the stepping motor driving control process.

(Function of Controller C)

Referring to FIG. 21, in the stepping motor drive controlling unit C4 in Example 4, a deceleration start timing determining unit C4L which determines whether the time reaches a preset deceleration start timing T5 shown in FIG. 22 when the medium conveying time TM1 has not elapsed from the driving start timing T1 or not is newly added.

As shown in FIGS. 22A and 22B, the stepping motor drive controlling unit C4 in Example 4 rotatingly drives the stepping motor 4 at the driving start timing T1 by a high-speed rotation rate R2 which is higher than a normal rotation rate R1 which is the preset rotation rate R of the medium conveying member per unit time in a normal state, and then decelerates the motor from the high-speed rotation rate R2 to the normal rotation rate R1 at the deceleration start timing T5 when the medium conveying time TM1 has not elapsed. In Example 4, the normal rotation rate R1 is preset to 10 [rps], the high-speed rotation rate R2 is preset to 20 [rps], and the deceleration start timing T5 is preset to a timing when a high-speed rotation time TM4=50 [ms] shown FIG. 22B has elapsed from the driving start timing T1.

As a result, the stepping motor drive controlling unit C4 in Example 4 rotatingly drives the stepping motor 4 at the high-speed rotation rate R2=20 [rps], only during the high-speed rotation time TM4=50 [ms] which extends from the medium conveying time TM1 to the deceleration start timing T5. Namely, the stepping motor 4 performs the rotation driving at the high-speed rotation rate R2=20 [rps] by a degree which corresponds to one rotation of the regi roll Rr from the driving start timing T1.

In Example 4, as shown in following expressions (3-1)' to (3-4)', therefore, the time [ms] for making a rotation of an angle which is obtained by adding 0.5 rotations, i.e., 180° with the remaining rotation angle Δθ is calculated as the medium conveying time TM1 for each of the rotation start positions Pa to Pd.

In the case of the first rotation start position Pa:

$$\begin{aligned} TM1 &= TM4 + \{(180^\circ + \Delta\theta)/(360^\circ \times R1)\} \times 10^3 \\ &= 50 + 10^3 \times (180^\circ + 90^\circ \times \Delta L/Lcd)/(360^\circ \times R1) \\ &= 50 + 10^3 \times (180^\circ + 90^\circ \times \\ &\quad (L - (Lab + \ldots + Lbc\}/Lcd]/(360^\circ \times R1) \end{aligned} \tag{3-1}'$$

In the case of the second rotation start position Pb:

$$\begin{aligned} TM1 &= TM4 + \{(180^\circ + \Delta\theta)/(360^\circ \times R1)\} \times 10^3 \\ &= 50 + 10^3 \times (180^\circ + 90^\circ \times \Delta L/Lda)/(360^\circ \times R1) \\ &= 50 + 10^3 \times (180^\circ + 90^\circ \times \\ &\quad (L - (Lbc + \ldots + Lcd)/Lda)/(360^\circ \times R1) \end{aligned} \tag{3-2}'$$

In the case of the third rotation start position Pc:

$$\begin{aligned} TM1 &= TM4 + \{(180^\circ + \Delta\theta)/(360^\circ \times R1)\} \times 10^3 \\ &= 50 + 10^3 \times (180^\circ + 90^\circ \times \Delta L/Lab)/(360^\circ \times R1) \\ &= 50 + 10^3 \times (180^\circ + 90^\circ \times \\ &\quad (L - (360^\circ \times R1) \end{aligned} \tag{3-1}'$$

In the case of the fourth rotation start position Pd:

$$\begin{aligned} TM1 &= TM4 + \{(180^\circ + \Delta\theta)/(360^\circ \times R)\} \times 10^3 \\ &= 50 + 10^3 \times (180^\circ + 90^\circ \times \Delta L/Lbc)/(360^\circ \times R1) \\ &= 50 + 10^3 \times (180^\circ + 90^\circ \times \\ &\quad (L - (Lda + \ldots + Lab\}/Lbc]/(360^\circ \times R1) \end{aligned} \tag{3-4}'$$

FIG. 23 is a view showing an example of medium conveying times in Example 4 of the invention, at respective rotation start positions in shipment of a product, and those at respective rotation start positions after operation, and corresponding to FIG. 5 of Example 1.

For example, as shown in FIG. 23, the medium conveying time TM1 for the driving roller Rr1 after operation similar to FIG. 5 in Example 1 will be considered. In this case, in Example 4, the zone circumferential lengths Lab to Lda of the driving roller Rr1 in the product shipment are 15.71 [mm], and hence the medium detection time TM3*a* which extends from the medium conveying time TM1 to the detection of the front end of the sheet S in the medium conveying direction by the registration-out sensor 12 shown in FIG. 13 is 25.01 [ms] for all of the rotation start positions Pa to Pd. By contrast, in the driving roller Rr1 after operation, the zone circumferential lengths Lab to Lda are 16.49 [mm], 14.45 [mm], 15.71 [mm], and 15.71 [mm], and hence the measured values ta to td of the medium detection time TM3 for the respective rotation start positions Pa to Pd are 26.37 [ms], 23.01 [ms], 25.01 [ms], and 25.01 [ms].

In Example 4, the medium conveying time TM1*a* in the product shipment is 109.2 [ms]. By contrast, the medium conveying times TM1 which are calculated by expressions (4-1) to (4-4), (1-1) to (1-4), (2-1) to (2-4), and (3-1)' to (3-4)' above, and which are at the respective rotation start positions Pa to Pd after operation are 110.7 [ms], 111.9 [ms], 109.4 [ms], and 109.4 [ms].

In Example 4, namely, it is seen that, as compared with Example 1, the medium detection time TM3*a* in the product shipment, and the medium detection time TM3 after operation are reduced to about one half, and both the medium conveying time TM1*a* in the product shipment and the medium conveying time TM1 after operation for each of the rotation start positions Pa to Pd are shortened by 50 [ms].

(Description of Flowchart of Example 4)

Next, the flow of the process of the image forming apparatus U of Example 4 of the invention will be described with reference to a flowchart.

(Description of Flowchart of Stepping Motor Driving Control Process in Example 4)

Figure 24:
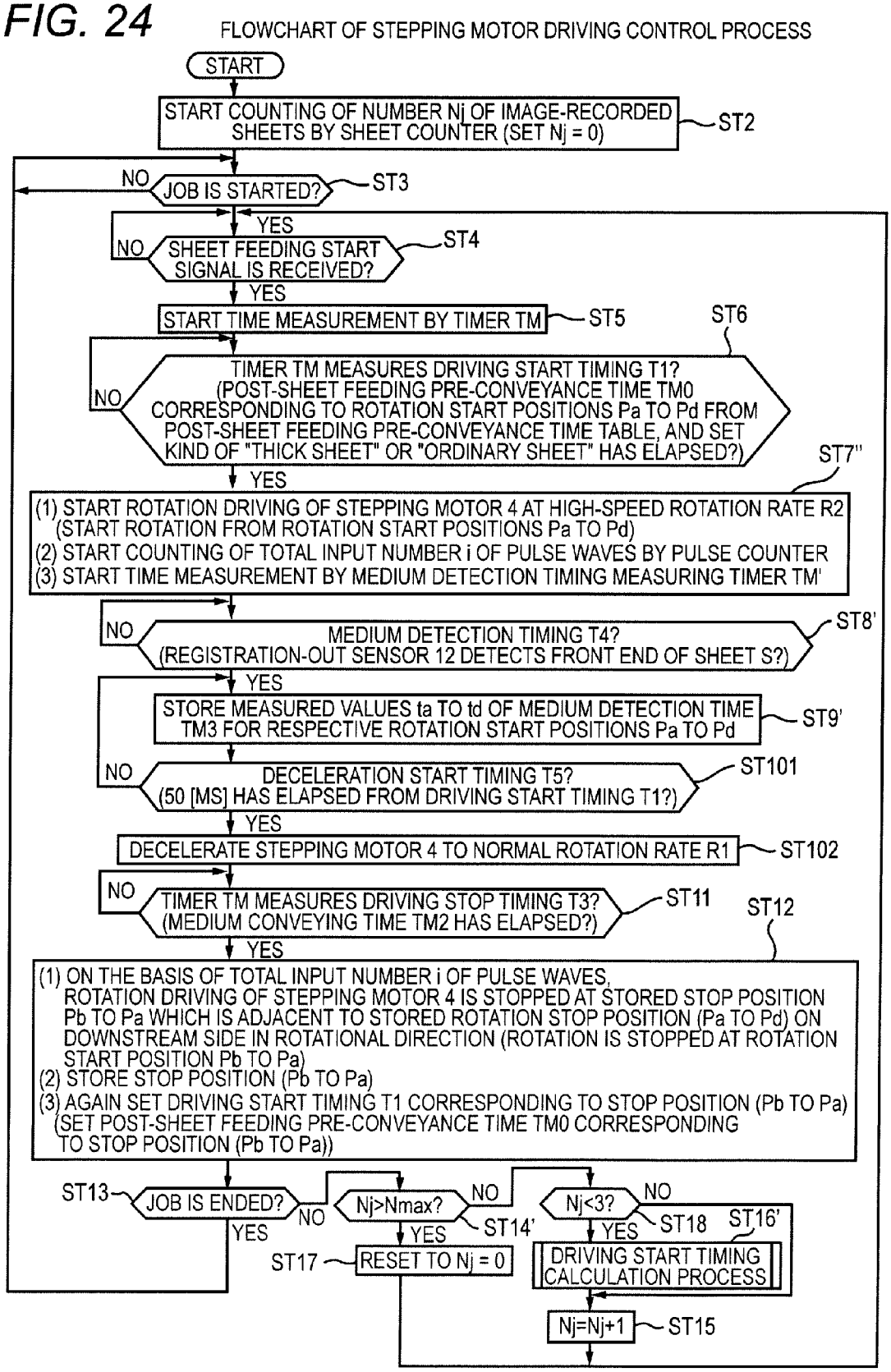
FIG. 24 is a flowchart of the stepping motor driving control process in Example 4 of the invention, and corresponding to FIG. 16 of Example 2.

FIG. 24 is a flowchart of the stepping motor driving control process in Example 4 of the invention, and corresponding to FIG. 16 of Example 2.

Referring to FIG. 24, in the flowchart of the stepping motor driving control process in Example 4, following ST7" is performed in place of ST7' of the flowchart of the stepping motor driving control process in Example 2. In the flowchart of the stepping motor driving control process in Example 4, following ST101 and ST102 are performed between ST9' and ST11 in the flowchart of the stepping motor driving control process in Example 2. The other steps ST2 to ST6, ST8', ST9', ST11 to ST13, ST14', ST15, ST16', ST17, and ST18 are identical with those of Example 2. Therefore, their detailed description is omitted.

In ST7" of FIG. 24, processes of following (1) to (3) are performed, and the process transfers to ST8'.

(1) The rotation driving of the stepping motor 4 is started at the rotation rate R per unit time which is set to the high-speed rotation rate R2=20 [rps]. Namely, the regi roll Rr is started to rotate at the high-speed rotation rate R2 from the present one of the rotation start positions Pa to Pd which is the stop position.

(2) The counting of the total input number i of pulse waves by the pulse counter is started.

(3) The time measurement by the medium detection timing measuring timer TM' is started.

In ST101, it is determined whether the timer TM reaches the deceleration start timing T5 shown in FIG. 22 when the high-speed rotation time TM4=50 [ms] has elapsed from the driving start timing T1 or not. If yes (Y), the process transfers to ST102, and, if no (N), the process repeats ST101.

In ST102, the rotation rate R of the stepping motor 4 per unit time is decelerated to the normal rotation rate R1=10 [rps].

In the flowchart of the driving start timing calculation process in Example 4, in ST21' of the flowchart of the driving start timing calculation process in Example 2 shown FIG. 17, expressions (3-1)' to (3-4)' above are calculated in place of expressions (3-1) to (3-4) above, and therefore its detailed description by illustration is omitted.

(Function of Example 4)

In the thus configured image forming apparatus U of Example 4, as shown in (1) of ST7" of FIG. 24, the rotation of the stepping motor 4 is started at the rotation rate R per unit time which is set to the high-speed rotation rate R2=20 [rps] that is higher than the normal rotation rate R1=10 [rps]. As shown in FIG. 22 and ST101 and ST102 FIG. 24, if it is determined that the time reaches the deceleration start timing T5 when the high-speed rotation time TM4=50 [ms] has elapsed from the driving start timing T1, the rotation rate R of the stepping motor 4 per unit time is decelerated from the high-speed rotation rate R2=20 [rps] to the normal rotation rate R1=10 [rps].

As a result, in the image forming apparatus U in Example 4, as shown in FIGS. 22 and 23, the medium detection time TM3 and the medium conveying time TM1 are shortened as compared with the image forming apparatuses U of Examples 1 and 2.

Furthermore, the image forming apparatus U of Example 4 achieves similar functions and effects as those of the image forming apparatus U of Example 2.

EXAMPLE 5

Next, Example 5 of the invention will be described. In the description of Example 5, components corresponding to those of Example 4 described above are denoted by the same reference numerals, and their detailed description is omitted.

Example 5 is different from Example 4 in the following points, but configured in a similar manner as Example 4 in the other points.

(Description of Controller C in Example 5)

FIG. 25 is a view showing functions of a controller of an image forming apparatus of Example 5 of the invention, in the form of a block diagram, and corresponding to FIG. 21 of Example 4.

Figure 26:
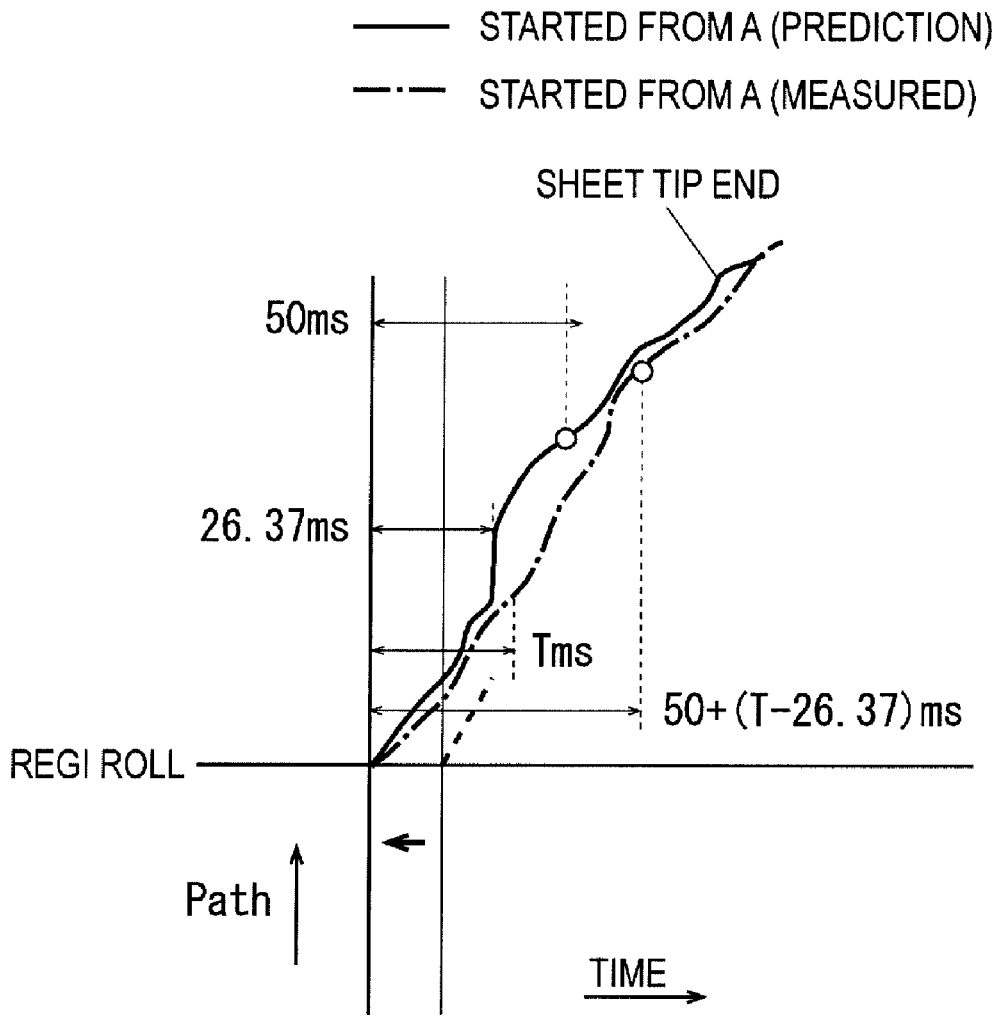
FIG. 26 is a view of a stepping motor driving control process in Example 5 of the invention, and corresponding to FIG. 22B of Example 4, and is an enlarged view of a graph showing the front end of the initial sheet in the medium conveying direction in the view of FIG. 22A illustrating the stepping motor driving control process.

FIGS. 26 is a view of a stepping motor driving control process in Example 5 of the invention, and corresponding to FIG. 22B of Example 4, and is an enlarged view of a graph showing the front end of the initial sheet in the medium conveying direction in the view of FIG. 22A illustrating the stepping motor driving control process.

(Function of Controller C)

Referring to FIG. 25, in the stepping motor drive controlling unit C4 in Example 5, a predicted value calculating unit C4M, a correction time calculating unit C4N, and a deceleration start timing correcting unit C4P are newly added.

C4M: Predicted Value Calculating Unit

The predicted value calculating unit C4M calculates predicted values ta' to td' of the medium detection time TM3 shown in FIG. 26, on the basis of the zone circumferential lengths Lab to Lda measured by the zone circumferential length measuring unit C4B2'. In the predicted value calculating unit C4M in Example 5, the measured values ta to td of the medium detection time TM3 which are stored in the medium detection timing storing unit C4B2*b* when the zone circumferential lengths Lab to Lda are measured by the zone circumferential length measuring unit C4B2' are preset as the predicted values ta' to td'.

Figure 27:
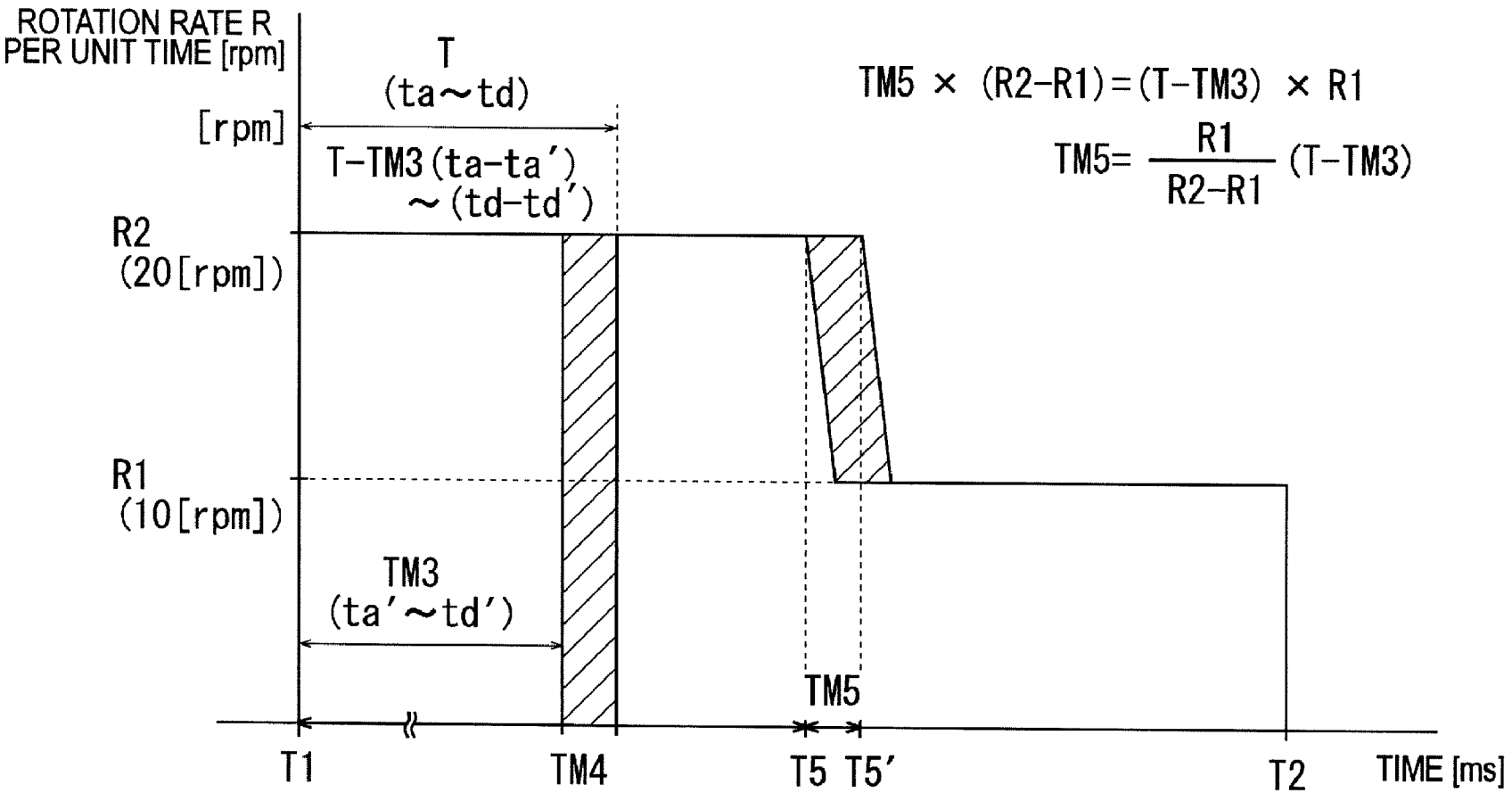
FIG. 27 is a view illustrating a correction time in Example 5 of the invention, and a timing chart in the case where, at a driving start timing, rotation of a regi roll is started by a high-speed rotation rate, and then decelerated to a normal rotation rate at a deceleration start timing.

FIG. 27 is a view illustrating a correction time in Example 5 of the invention, and a timing chart in the case where, at a driving start timing, rotation of a regi roll is started by the high-speed rotation rate, and then decelerated to the normal rotation rate at a deceleration start timing.

C4N: Correction Time Calculating Unit

As shown in FIGS. 26 and 27, the correction time calculating unit C4N calculates a correction time TM5 for correcting the high-speed rotation time TM4=50 [ms], on the basis of the normal rotation rate R1=10 [rps] and high-speed rotation rate R2=2×R1=20 [rps] which are preset, and differences (ta−ta') to (td−td') between the measured values ta to td of the medium detection times TM3 for the respective rotation start positions Pa to Pd which are stored in the medium detection timing storing unit C4B2*b*, and the predicted values ta' to td' of the medium detection times TM3 which are calculated by the predicted value calculating unit C4M. A change of the medium reach timing T2 corresponding to the difference is offset by that of the medium reach timing T2 due to the speed difference (R2−R1) between the rotation rates R1, R2, and the correction time TM5.

In Example 5, the correction times TM5 for the respective rotation start positions Pa to Pd are calculated by following expressions (6-1) to (6-4).

In the case of the first rotation start position Pa:

$$\begin{aligned} TM5 &= \{R1/(R2-R1)\}\times(ta-ta') \\ &= \{R1/(2\times R1-R1)\}\times(ta-ta') \\ &= ta-ta' \end{aligned} \tag{6-1}$$

In the case of the second rotation start position Pb:

$$TM5 = \{R1/(R2-R1)\} \times (tb - tb') \quad (6\text{-}2)$$
$$= \{R1/(2 \times R1 - R1)\} \times (tb - tb')$$
$$= tb - tb'$$

In the case of the third rotation start position Pc:

$$TM5 = \{R1/(R2-R1)\} \times (tc - tc') \quad (6\text{-}3)$$
$$= \{R1/(2 \times R1 - R1)\} \times (tc - tc')$$
$$= tc - tc'$$

In the case of the fourth rotation start position Pd:

$$TM5 = \{R1/(R2-R1)\} \times (td - td') \quad (6\text{-}4)$$
$$= \{R1/(2 \times R1 - R1)\} \times (td - td')$$
$$= td - td'$$

C4P: Deceleration Start Timing Correcting Unit

As shown in FIG. 27, the deceleration start timing correcting unit C4P corrects the deceleration start timing T5 when the high-speed rotation time TM4=50 [ms] has elapsed from the driving start timing T1, on the basis of the correction times TM5 for the respective rotation start positions Pa to Pd which are calculated by the correction time calculating unit C4N. In the case where the differences (ta−ta') to (td−td') of expressions (6-1) to (6-4) above are x [ms], for example, the deceleration start timing correcting unit C4P in Example 5 lengthens the medium conveying time when the regi roll is rotated at the high-speed rotation rate R2, by x [ms], and shortens the medium conveying time when the regi roll is rotated at the normal rotation rate R1, by x [ms]. In Example 5, in the case where the detection of the front end of the sheet S in the medium conveying direction by the registration-out sensor 12 shown in FIG. 13 is delayed from the predicted values ta' to td' by x [ms], namely, the time when the regi roll is rotated at the high-speed rotation rate R2 is prolonged by x [ms] as compared with Example 4, so that the sheet S is conveyed at the high-speed rotation rate R2 which is higher by a degree corresponding to the time that is late for the medium reach timing T2 in the case where the regi roll is continued to be rotated at the normal rotation rate R1.

FIG. 28 is a view illustrating correction of the deceleration start timing for each rotation start position.

As shown in FIG. 28, for example, the medium detection time TM3 with respect to the driving roller Rr1 after operation which is similar to Example 4 shown in FIG. 23 will be considered. Namely, the case where the zone circumferential lengths Lab to Lda of the driving roller Rr1 after operation in Example 5 are 16.49 [mm], 14.45 [mm], 15.71 [mm], and 15.71 [mm] will be considered. At this time, the predicted values ta' to td' of the medium detection time TM3 for the respective rotation start positions Pa to Pd are 26.37 [ms], 23.01 [ms], 25.01 [ms], and 25.01 [ms]. In the case where the measured values ta to td of the medium detection time TM3 for the respective rotation start positions Pa to Pd are indicated by T [ms], therefore, the differences x for the respective zone circumferential lengths Lab to Lda are (T−26.37) [ms], (T−23.01) [ms], (T−25.01) [ms], and (T−25.01) [ms]. Therefore, the corrected deceleration start timing T5' shown in FIG. 27 for the respective rotation start positions Pa to Pd are corrected to timings when 50+x=50+(T−26.37) [ms], 50+x=50+(T−23.01) [ms], 50+x=50+(T−25.01) [ms], and 50+x=50+(T−25.01) [ms] have elapsed from the driving start timing T1.

(Description of Flowchart of Example 5)

Next, the flow of the process of the image forming apparatus U of Example 5 of the invention will be described with reference to a flowchart.

(Description of Flowchart of Stepping Motor Driving Control Process in Example 5)

Figure 29:
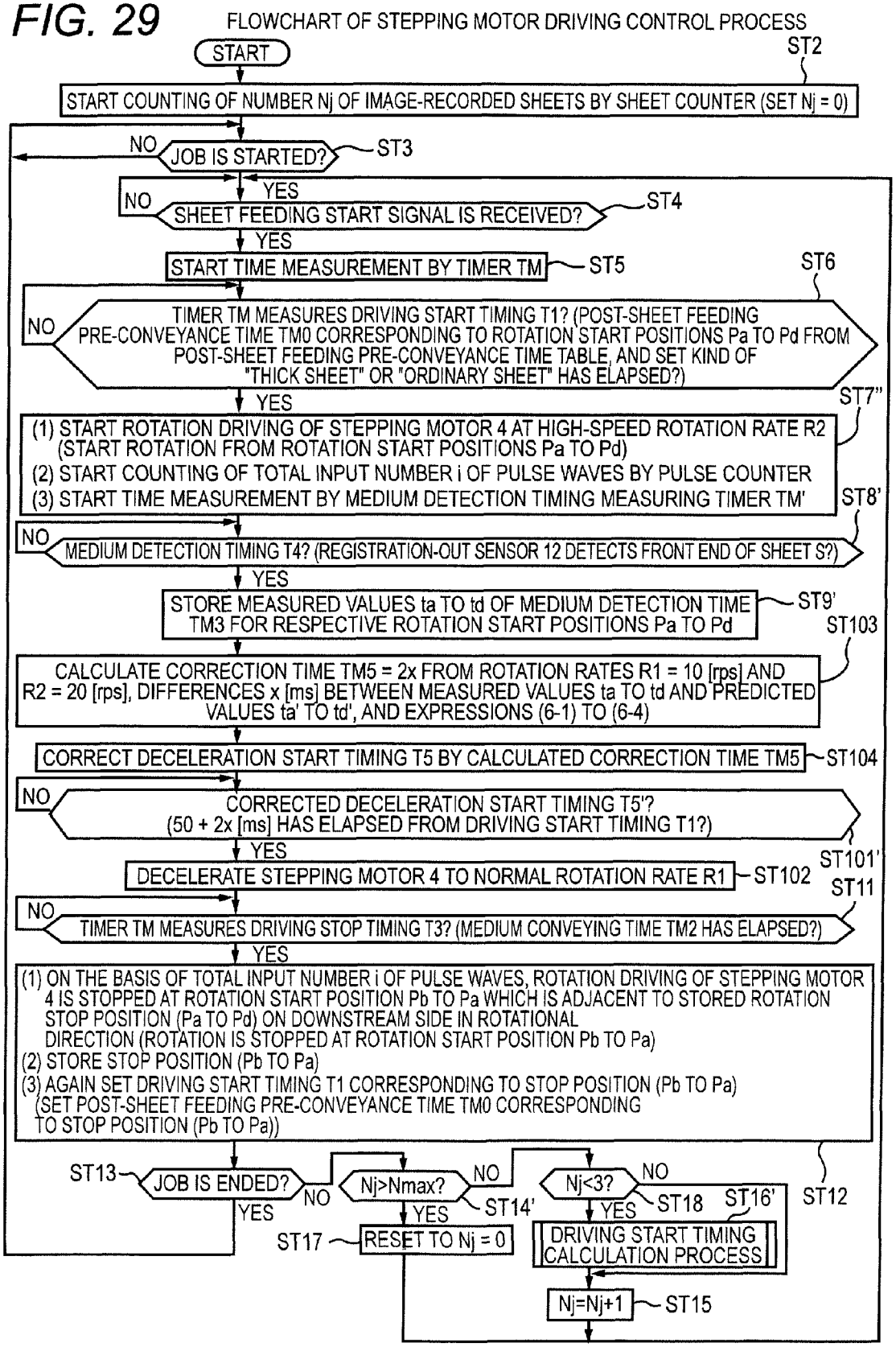
FIG. 29 is a flowchart of a stepping motor driving control process in Example 5 of the invention, and corresponding to FIG. 24 of Example 4.

FIG. 29 is a flowchart of the stepping motor driving control process in Example 5 of the invention, and corresponding to FIG. 24 of Example 4.

Referring to FIG. 29, in the flowchart of the stepping motor driving control process in Example 5, following ST103, ST104, and ST10' are performed between ST9' and ST102 in the flowchart of the stepping motor driving control process in Example 4. The other steps ST2 to ST6, ST7", ST8', ST9', ST102, ST11 to ST13, ST14', ST15, ST16', ST17, and ST18 are identical with those of Example 4. Therefore, their detailed description is omitted.

In ST103 of FIG. 29, the correction time TM5=2x shown in FIG. 27 is calculated from the normal rotation rate R1=10 [rps] and high-speed rotation rate R2=2×R1=20 [rps] which are preset, the differences x between the measured values ta to td of the medium detection time TM3 for the respective rotation start positions Pa to Pd, and the predicted values ta' to td' of the medium detection time TM3 calculated by the predicted value calculating unit C4M, and expressions (6-1) to (6-4). Then, the process transfers to ST104.

In ST104, the preset deceleration start timing T5 is corrected by the calculated correction time TM5. Then, the process transfers to ST101'.

In ST101', it is determined whether the timer TM reaches the corrected deceleration start timing T5' shown in FIG. 27 when 50+2x [ms] has elapsed from the driving start timing T1 or not. If yes (Y), the process transfers to ST102, and, if no (N), the process repeats ST101'.

(Function of Example 5)

In the thus configured image forming apparatus U of Example 5, there is a possibility that, in the rollers Rr1, Rr2 after operation, their outer circumferential faces become slippery, or so-called slippage easily occurs because of temporal wear or the like as compared with the case of the product shipment. Therefore, there is a possibility that, for example, the rollers Rr1, Rr2 idly rotate at the start of conveyance of the sheet S, or slip over the surface of the sheet S occurs during conveyance of the sheet S. In this case, the possibility that the measured values ta to td show the above-described differences×as compared with the predicted values ta' to td', and also the medium reach timing T2 is delayed in accordance with the differences x is high.

In Example 5, as shown in ST103 and ST104 of FIG. 29, however, the correction time TM5=2x shown in FIG. 27 is calculated from the preset rotation rates R1, R2, the differences x between the measured values ta to td of the medium detection time TM3 for the respective rotation start positions Pa to Pd, and the predicted values ta' to td', and expressions (6-1) to (6-4), and the preset deceleration start timing T5 is corrected. As shown in ST101' and ST102 of FIG. 29, if it is determined that the time reaches the deceleration start timing T5' when 50+2x [ms] has elapsed from the driving start timing T1, the rotation rate R of the stepping motor 4 per unit time is reduced from the high-speed rotation rate R2=20 [rps] to the normal rotation rate R1=10 [rps].

In the image forming apparatus U of Example 5, therefore, even in the case where, by slippage of the rollers Rr1, Rr2 or the like, the measured values ta to td are changed as compared with the predicted values ta' to td', and the medium detection time TM3 is changed by the difference x, the deceleration start timing T5 is corrected in accordance with the difference x. As a result, in the image forming apparatus U of Example 5, the accuracy of causing the sheet S to reach the transferring region Q3 at the preset medium reach timing T2 is further improved as compared with the case where the deceleration start timing T5 is not corrected.

Furthermore, the image forming apparatus U of Example 5 achieves similar functions and effects as those of the image forming apparatus U of Example 4.

EXAMPLE 6

Next, Example 6 of the invention will be described. In the description of Example 6, components corresponding to those of Example 1 described above are denoted by the same reference numerals, and their detailed description is omitted.

Example 6 is different from Example 1 in the following points, but configured in a similar manner as Example 1 in the other points.

(Description of Controller C in Example 6)

FIG. 30 is a view showing functions of a controller of an image forming apparatus of Example 6 of the invention, in the form of a block diagram, and corresponding to FIG. 3 of Example 1.

(Function of Controller C)

Referring to FIG. 30, in the controller C in Example 6, a visible-image forming apparatus controlling unit C10 is newly added. The stepping motor drive controlling unit C4 in Example 6 has a medium reach timing calculating unit C4B', a medium conveying time setting unit C4D', a driving start timing determining unit C4E', and a medium reach timing recalculation determining unit C4H', in place of the driving start timing calculating unit C4B, the post-sheet feeding pre-conveyance time setting unit C4D, the driving start timing determining unit C4E, and the driving start timing recalculation determining unit C4H in Example 1.

C4B': Medium Reach Timing Calculating Unit

The medium reach timing calculating unit C4B' has the zone radius measuring unit C4B1, the zone circumferential length measuring unit C4B2, and the medium conveying time calculating unit C4B3 in Example 1, and calculates the medium reach timing T2 when the medium conveying time TM1 calculated by the medium conveying time calculating unit C4B3 has elapsed from the driving start timing T1 shown in FIG. 4.

FIG. 31 is a view showing a sheet feeding conveyance time table in Example 6 of the invention, and corresponding to FIG. 6 of Example 1.

C4D': Medium Conveying Time Setting Unit

The medium conveying time setting unit C4D' sets the medium conveying time TM1 calculated by the medium conveying time calculating unit C4B3, as the timing when the toner image on the surface of the photosensitive member PR reaches the transferring region Q3. Specifically, the medium conveying time setting unit C4D' in Example 6 sets the sheet feeding conveyance time table shown in FIG. 31.

Referring to FIG. 31, in the sheet feeding conveyance time table in Example 6, 160.2 [ms] is preset in the case of "thick sheet", and 159.2 [ms] is preset in the case of "ordinary sheet", as the medium conveying time TM1*a* in the product shipment which is a set reference value. In the medium conveying time setting unit C4D' in Example 6, in the case where the zone circumferential lengths Lab to Lda shown in FIG. 5 are measured, the medium conveying time TM1 in the case where the rotation driving is started from the first rotation start position Pa is set as 161.7 [ms] in the case of "thick sheet", and 160.7 [ms] in the case of "ordinary sheet". Furthermore, the medium conveying time TM1 in the case where the rotation driving is started from the second rotation start position Pb is set as 162.9 [ms] in the case of "thick sheet", and 161.9 [ms] in the case of "ordinary sheet". Moreover, the medium conveying time TM1 in the case where the rotation driving is started from the rotation start position Pc or Pd is set as 160.4 [ms] in the case of "thick sheet", and 159.4 [ms] in the case of "ordinary sheet".

C4E': Driving Start Timing Determining Unit

The driving start timing determining unit C4E' in Example 6 determines whether the time reaches the preset driving start timing T1 or not.

C4H': Medium Reach Timing Recalculation Determining Unit

The medium reach timing recalculation determining unit C4H' in Example 6 has the sheet counter C4H1 in Example 1, and determines whether the value of the sheet number Nj exceeds a preset recalculation determination value $N_{max}$ or not, thereby determining whether the medium reach timing T2 is to be recalculated or not.

C10: Visible-Image Forming Apparatus Controlling Unit

Based on the sheet feeding conveyance time table which is set by the medium conveying time setting unit C4D', the visible-image forming apparatus controlling unit C10 controls the visible-image forming apparatus U3 so that the timing when the toner image on the surface of the photosensitive member PR reaches the transferring region Q3 coincides with the medium reach timing T2 calculated by the medium reach timing calculating unit C4B'. The visible-image forming apparatus controlling unit C10 in Example 6 controls the timing when the exposing device ROS starts the exposure scan of the laser beam L, thereby controlling the timing when an electrostatic latent image is formed on the surface of the photosensitive member PR.

(Description of Flowchart of Example 6)

Next, the flow of the process of the image forming apparatus U of Example 6 of the invention will be described with reference to flowcharts. In the control of the exposing device ROS, only the timing when writing of an electrostatic latent image is started is controlled in accordance with the calculation result of the medium reaching timing T2. Therefore, its detailed description by illustration is omitted.

(Description of Flowchart of Stepping Motor Driving Control Process in Example 6)

Figure 32:
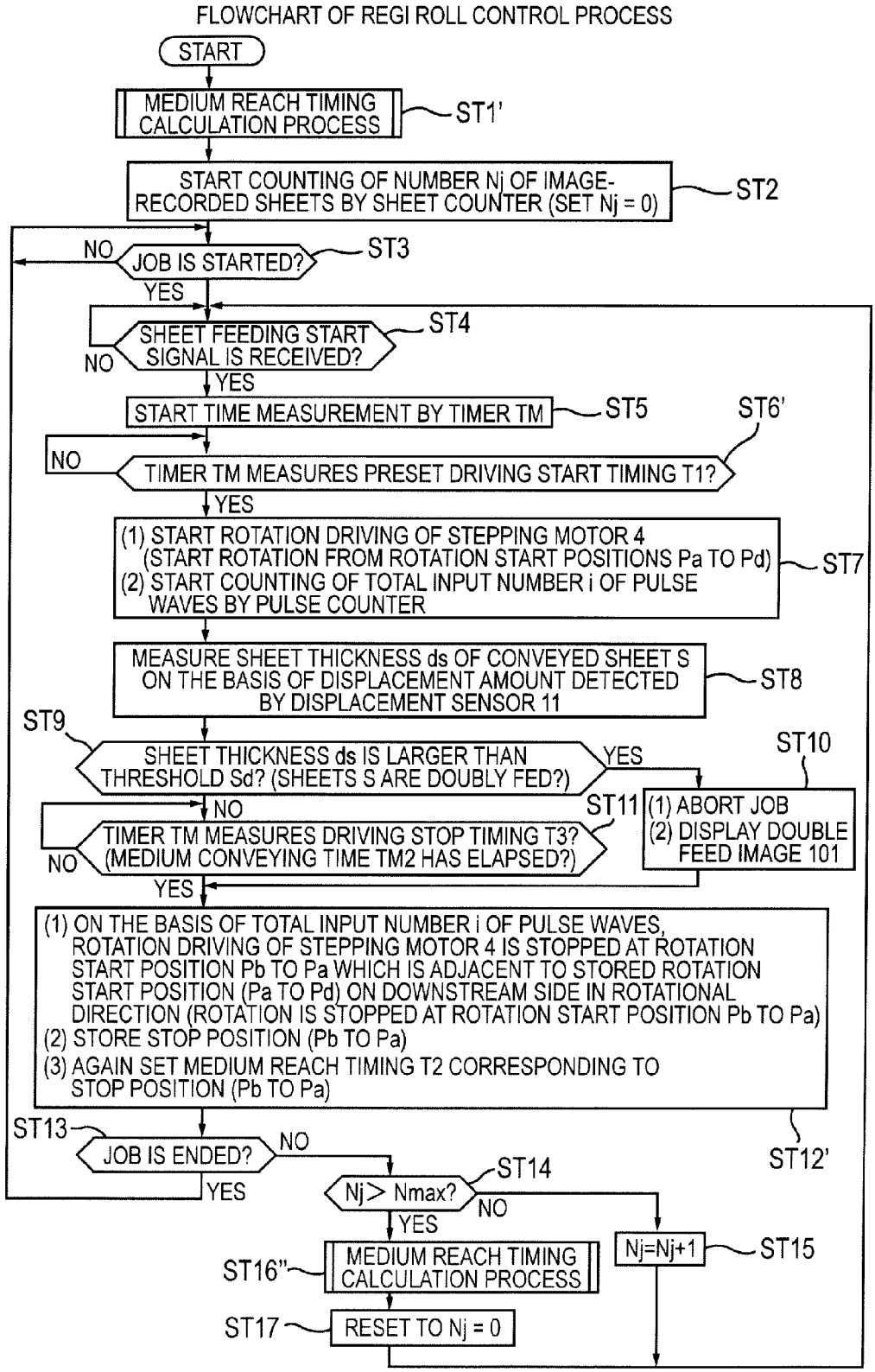
FIG. 32 is a flowchart of a stepping motor driving control process in Example 6 of the invention and corresponding to FIG. 9 of Example 1.

FIG. 32 is a flowchart of a stepping motor driving control process in Example 6 of the invention and corresponding to FIG. 9 of Example 1.

Referring to FIG. 32, in the flowchart of the stepping motor driving control process in Example 6, following ST1', ST6', ST12', and ST16" are performed in place of ST1, ST6, ST12, and ST16 in the flowchart of the stepping motor driving control process in Example 1. The other steps ST2 to ST5, ST7 to ST11, ST13 to ST15, ST17, and ST18 are identical with those of Example 1. Therefore, their detailed description is omitted.

In ST1' of FIG. 32, a medium reach timing calculation process shown in FIG. 33 which will be described later is performed, and then the process transfers to ST2.

In ST6', it is determined whether the timer TM measures the preset driving start timing T1 shown in FIG. 4 or not. If yes (Y), the process transfers to ST7, and, if no (N), the process repeats ST6'.

In ST12', processes of following (1) to (3) are performed, and the process transfers to ST13.

(1) On the basis of the total input number i of pulse waves which is the value of the pulse counter, the rotation driving of the stepping motor 4 is stopped at the stored stop position, i.e., the rotation start position Pb to Pa which is adjacent to the present one of the rotation start positions Pa to Pd on the downstream side in the rotational direction.

(2) The next one of the rotation start positions Pb to Pa which is the stop position is stored.

(3) The medium reach timing T2 corresponding to the stop position (Pb to Pa) is again set.

In ST16", the medium reach timing calculation process is performed, and then the process transfers to ST17.

(Description of Flowchart of Medium Reach Timing Calculation Process in Example 6)

Figure 33:
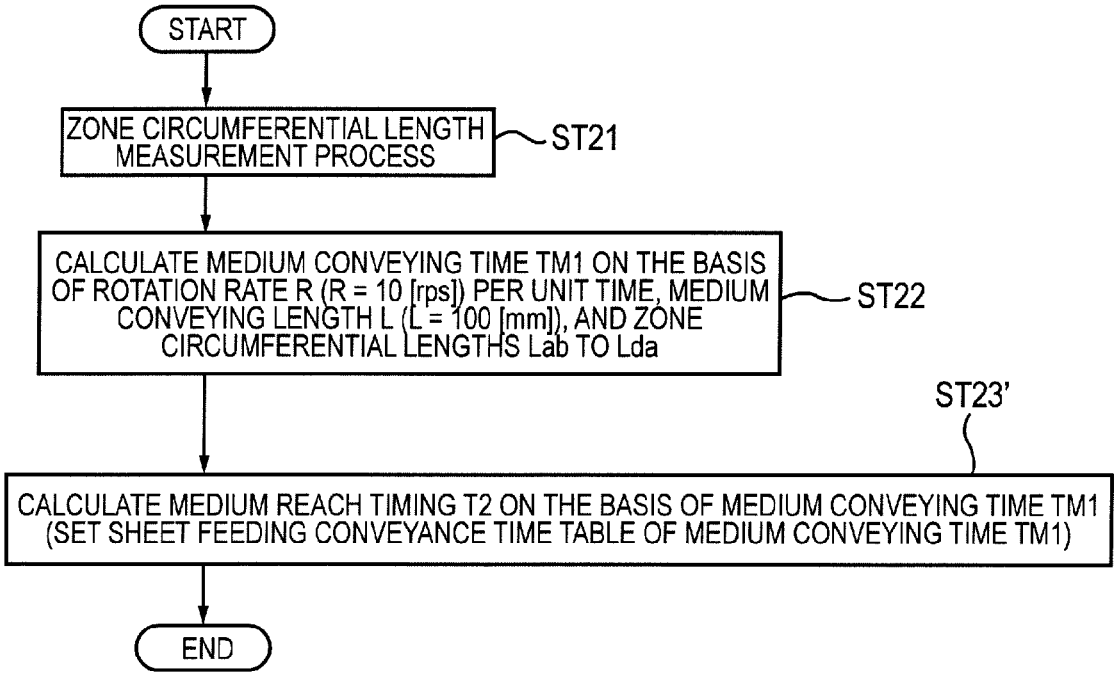
FIG. 33 is a flowchart of a medium reach timing calculation process in Example 6 of the invention, corresponding to FIG. 10 of Example 1, and illustrating a subroutine of ST1' and ST16" of FIG. 32.

FIG. 33 is a flowchart of the medium reach timing calculation process in Example 6 of the invention, corresponding to FIG. 10 of Example 1, and illustrating a subroutine of ST1' and ST16" of FIG. 32.

Referring to FIG. 33, in the flowchart of the medium reach timing calculation process in Example 6, following ST23' is performed in place of ST23 of the flowchart of the driving start timing calculation process in Example 1. The other steps ST21 and ST22 are identical with those of Example 1, and therefore their detailed description is omitted.

In ST23' of FIG. 33, the medium reach timing T2 is calculated on the basis of the calculated medium conveying time TM1. Namely, the sheet feeding conveyance time table of the medium conveying time TM1 shown in FIG. 31 is set. Then, the medium reach timing calculation process is ended, and the process returns to ST1' or ST16" of FIG. 32.

(Function of Example 6)

In the thus configured image forming apparatus U of Example 6, as shown in ST1' and ST16" of FIG. 32, and ST21, ST22, and ST23' of FIG. 33, the medium reach timing calculation process of calculating the medium reach timing T2 when the sheet S conveyed from the regi roll Rr reaches the transferring region Q3 is performed.

In the medium reach timing calculation process in Example 6, as shown in ST21 and ST22 of FIG. 33, and ST31 to ST41 of FIG. 11, the zone circumferential lengths Lab to Lda are measured, the medium conveying times TM1 corresponding to the zone circumferential lengths Lab to Lda are calculated for the respective rotation start positions Pa to Pd. As shown in ST23' of FIG. 33, the medium reach timings T2 when the calculated medium conveying times TM1 have elapsed from the preset medium conveying time T1 are calculated for the respective rotation start positions Pa to Pd.

In Example 6, as shown in ST12' of FIG. 32, the timing when the exposing device ROS starts the writing of an electrostatic latent image is controlled in accordance with the medium reach timing T2 which is calculated for each of the rotation start positions Pa to Pd. Namely, in the image forming apparatus U where there is a possibility that the zone circumferential lengths Lab to Lda between the rotation start positions Pa to Pd are different, and the rotation angle from the regi roll Rr to the transferring region, i.e., the conveying distance is varied depending the rotation start positions Pa to Pd, the medium reach timing T2 which corresponds to the measurement results of the zone circumferential lengths Lab to Lda is calculated for each of the rotation start positions Pa to Pd, and the timing when the toner image on the surface of the photosensitive member PR reaches the transferring region Q3 in accordance with the calculated medium reach timing T2 is adjusted by the control of the exposing device ROS.

As a result, the image forming apparatus U of Example 6, as compared with the case where the medium reach timing T2 is not calculated for each of the rotation start positions Pa to Pd, the accuracy of the operation of making the timing when the sheet S reaches the transferring region Q3, coincident with that when the toner image on the surface of the photosensitive member PR reaches the transferring region Q3 is further improved.

Furthermore, the image forming apparatus U of Example 6 achieves similar functions and effects as those of the image forming apparatus U of Example 1.

EXAMPLE 7

Next, Example 7 of the invention will be described. In the description of Example 7, components corresponding to those of Example 1 described above are denoted by the same reference numerals, and their detailed description is omitted.

Example 7 is different from Example 1 in the following points, but configured in a similar manner as Example 1 in the other points.

(Description of Controller C in Example 7)

FIG. 34 is a view showing functions of a controller of an image forming apparatus of Example 7 of the invention, in the form of a block diagram, and corresponding to FIG. 3 of Example 1.

(Function of Controller C)

Referring to FIG. 34, the stepping motor drive controlling unit C4 in Example 7 has a driving start timing determining unit C4E' which is similar to the driving start timing determining unit C4E' in Example 6, in place of the driving start timing determining unit C4E in Example 1. Furthermore, the stepping motor drive controlling unit C4 has a rotation rate calculating unit C4J', a rotation rate setting unit C4K', and a rotation rate recalculation determining unit C4H", in place of the driving start timing calculating unit C4B, the post-sheet feeding pre-conveyance time setting unit C4D, and the driving start timing recalculation determining unit C4H in Example 1.

C4J': Rotation Rate Calculating Unit

The rotation rate calculating unit C4J' has the zone radius measuring unit C4B1, and the zone circumferential length measuring unit C4B2 in Example 1, and calculates a rotation rate R" of the regi roll Rr per unit time causing the sheet S to reach the transferring region Q3 at the preset medium reach timing T2, on the basis of the preset medium conveying time TM1, the preset medium conveying length L, and the zone circumferential lengths Lab to Lda which are calculated by the zone circumferential length measuring unit C4B2.

The rotation rate calculating unit C4J' in Example 7 calculates the rotation rate R" causing the sheet S to reach the transferring region Q3 at the medium reach timing T2 when the medium conveying time TM1*a* has elapsed from the preset driving start timing T1 shown in FIG. 4, on the basis of the preset medium conveying time TM1*a*, the medium conveying length L, and the zone circumferential lengths Lab to Lda. Specifically, the rotation rate calculating unit C4J' first calculates the remaining medium conveying length $\Delta L$ and the remaining rotation angle $\Delta\theta$ after 1.5 rotations from each of the rotation start positions Pa to Pd, by expressions (1-1) to (1-4) and (2-1) to (2-4) above. By following expressions (3-1)" to (3-4)" in which expressions (3-1) to (3-4) above are deformed, and into which TM1=TM1*a* is substituted, the rotation rate R" [rps] for making a rotation of an angle which is obtained by adding 1.5 rotations, i.e., 540° with a remaining rotation angle is calculated for each of the rotation start positions Pa to Pd.

In the case of the first rotation start position Pa:

$$R'' = \{(540° + \Delta\theta)/(360° \times TM1a)\} \times 10^3 \quad (3\text{-}1)''$$
$$= 10^3 \times (540° + 90° \times \Delta L/Lcd)/(360° \times TM1a)$$
$$= 10^3 \times [540° + 90° \times \{L - (Lab + \ldots + Lbc\}/Lcd]/(360° \times TM1a)$$

In the case of the second rotation start position Pb:

$$R'' = \{(540° + \Delta\theta)/(360° \times TM1a)\} \times 10^3 \quad (3\text{-}2)''$$
$$= 10^3 \times (540° + 90° \times \Delta L/Lda)/(360° \times TM1a)$$
$$= 10^3 \times [540° + 90° \times \{L - (Lbc + \ldots + Lcd)/Lda\}/(360° \times TM1a)$$

In the case of the third rotation start position Pc:

$$R'' = \{(540° + \Delta\theta)/(360° \times TM1a)\} \times 10^3 \quad (3\text{-}3)''$$
$$= 10^3 \times (540° + 90° \times \Delta L/Lab)/(360° \times TM1a)$$
$$= 10^3 \times [540° + 90° \times \{L - (Lcd + \ldots + Lda\}/Lab]/(360° \times TM1a)$$

In the case of the fourth rotation start position Pd:

$$R'' = \{(540° + \Delta\theta)/(360° \times TM1a)\} \times 10^3 \quad (3\text{-}4)''$$
$$= 10^3 \times (540° + 90° \times \Delta L/Lbc)/(360° \times TM1a)$$
$$= 10^3 \times [540° + 90° \times \{L - (Lda + \ldots + Lab\}/Lbc]/(360° \times TM1a)$$

FIG. 35 is a view showing an example of medium conveying times in Example 7 of the invention, at respective rotation start positions in shipment of a product, and rotation rates at respective rotation start positions after operation, and corresponding to FIG. 5 of Example 1.

C4K': Rotation Rate Setting Unit

In the rotation rate setting unit C4K', the rotation rate R" of the regi roll Rr per unit time which is calculated by the rotation rate calculating unit C4J' is set as the rotation rate R=R" per unit time for rotating the stepping motor 4.

As shown in FIG. 35, for example, the rotation rate R" for the driving roller Rr1 after operation similar to FIG. 5 of Example 1 will be considered. In this case, in the driving roller Rr1 in the product shipment in Example 7, the zone circumferential lengths Lab to Lda are 15.71 [mm], the medium conveying time TM1*a* is 159.2 [ms], and the rotation rate R is 10 [rps].

By contrast, the case where, in the driving roller Rr1 after operation, the zone circumferential lengths Lab to Lda are 16.49 [mm], 14.45 [mm], 15.71 [mm], and 15.71 [mm] will be considered. In this case, by expressions (1-1) to (1-4) and (2-1) to (2-4), the calculated medium conveying lengths ΔL are 6.69 [mm], 7.48 [mm], 5.75 [mm], and 5.75 [mm], and the remaining rotation angles Δθ are 38.4°, 42.9°, 34.0°, and 33.9°. The rotation rates R" for the respective rotation start positions Pa to Pd calculated by expressions (3-1)" to (3-4)" above are 10.09 [rps], 10.17 [rps], 10.02 [rps], and 10.01 [rps]. Therefore, it is seen that the rotation rates R" are higher than the rotation rate R=10 [rps] in the product shipment.

In the stepping motor drive controlling unit C4 in Example 7, the input number of pulse waves per unit time to the stepping motor 4 is controlled in accordance with the rotation rate R" which is set by the rotation rate setting unit C4K', whereby the rotation rate R=R" of the regi roll Rr is controlled.

C4H": Rotation Rate Recalculation Determining Unit

The rotation rate recalculation determining unit C4H" in Example 7 has the sheet counter C4H1 in Example 1, and determines whether the value of the sheet number Nj exceeds a preset recalculation determination value $N_{max}$ or not, thereby determining whether the rotation rate R" is to be recalculated or not.

(Description of Flowchart of Example 7)

Next, the flow of the process of the image forming apparatus U of Example 7 of the invention will be described with reference to flowcharts.

(Description of Flowchart of Stepping Motor Driving Control Process in Example 7)

Figure 36:
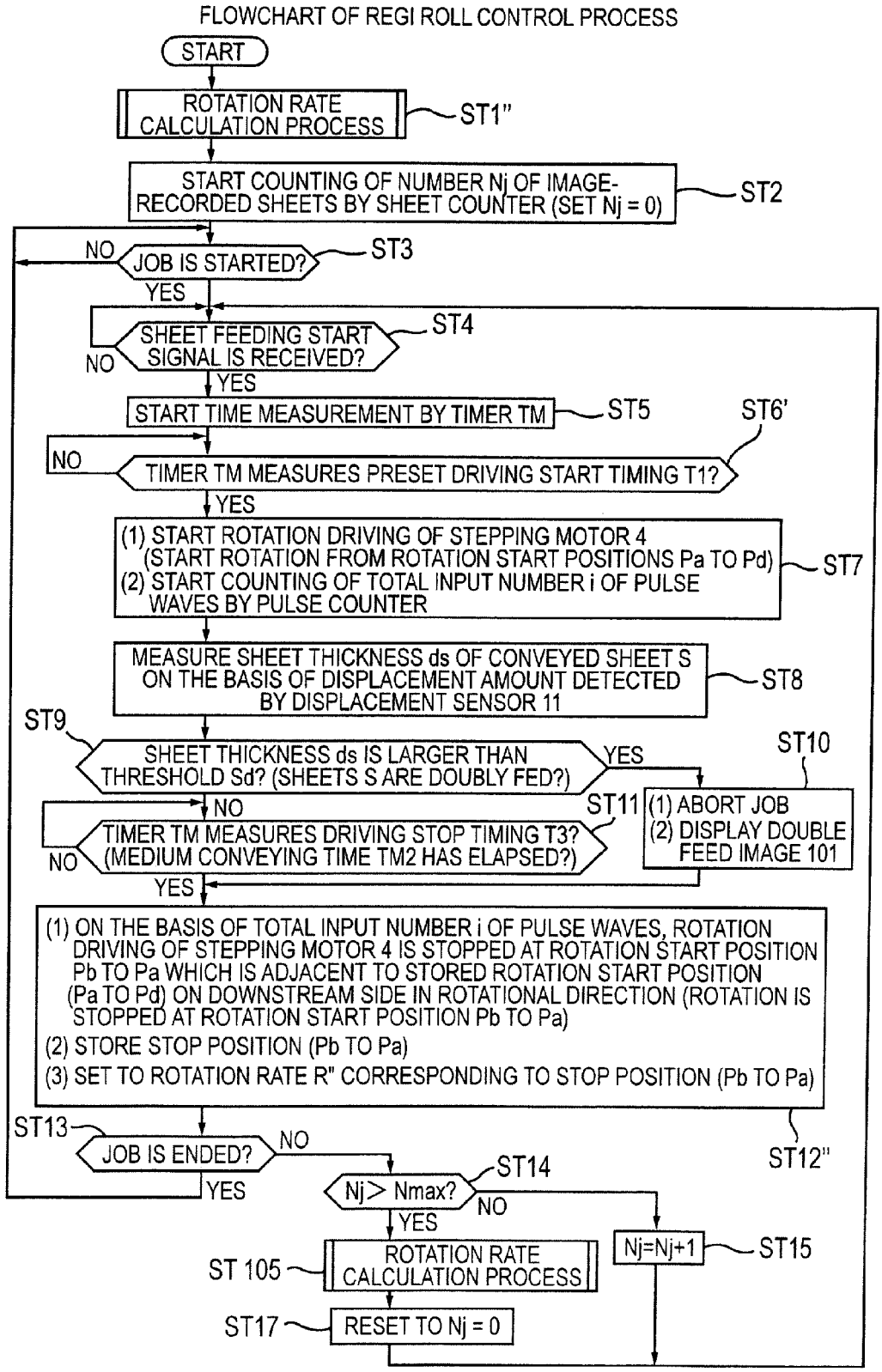
FIG. 36 is a flowchart of a stepping motor driving control process in Example 7 of the invention, and corresponding to FIG. 9 of Example 1.

FIG. 36 is a flowchart of a stepping motor driving control process in Example 7 of the invention, and corresponding to FIG. 9 of Example 1.

Referring to FIG. 36, in the flowchart of the stepping motor driving control process in Example 7, a process similar to ST6' of FIG. 32 of Example 6 is performed in place of ST6 of the flowchart of the stepping motor driving control process in Example 1. In the flowchart of the stepping motor driving control process in Example 7, following ST1", ST12", and ST105 are performed in place of ST1, ST12, and ST16 of the flowchart of the stepping motor driving control process in Example 1. The other steps ST2 to ST5, ST7 to ST15, ST17, and ST18 are identical with those of Example 1. Therefore, their detailed description is omitted.

In ST1" of FIG. 36, a rotation rate calculation process shown in FIG. 37 which will be described later is performed, and then the process transfers to ST2.

In ST12", processes of following (1) to (3) are performed, and the process transfers to ST13.

(1) On the basis of the total input number i of pulse waves which is the value of the pulse counter, the rotation driving of the stepping motor 4 is stopped at the stored stop position, i.e., the rotation start position Pb to Pa which is adjacent to the present one of the rotation start positions Pa to Pd on the downstream side in the rotational direction.

(2) The next one of the rotation start positions Pb to Pa which is the stop position is stored.

(3) The rotation rate R=R" corresponding to the stop position (Pb to Pa) is set.

In ST105, the rotation rate calculation process is performed, and then the process transfers to ST17.

(Description of Flowchart of Rotation Rate Calculation Process in Example 7)

Figure 37:
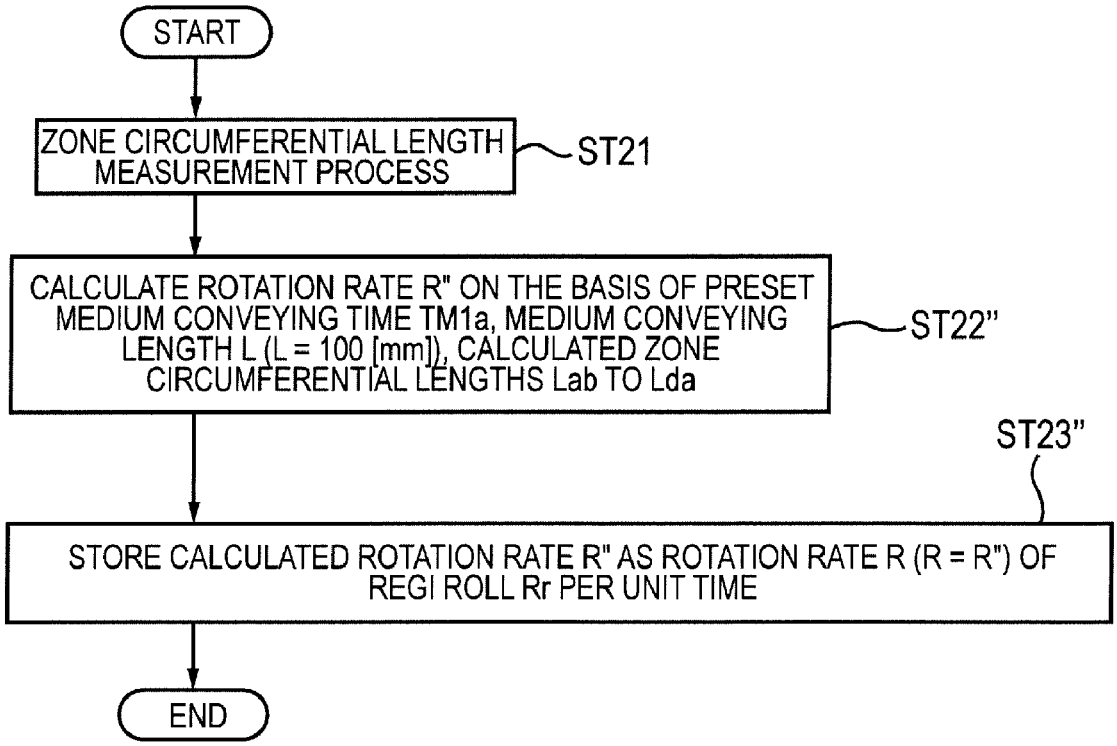
FIG. 37 is a flowchart of a rotation rate calculation process in Example 7 of the invention, corresponding to FIG. 10 of Example 1, and illustrating a subroutine of ST1" and ST105 of FIG. 36.

FIG. 37 is a flowchart of the rotation rate calculation process in Example 7 of the invention, corresponding to FIG. 10 of Example 1, and illustrating a subroutine of ST1" and ST105 of FIG. 36.

Referring to FIG. 37, in the flowchart of the rotation rate calculation process in Example 7, following ST22" and ST23" are performed in place of ST22 and ST23 of the flowchart of the driving start timing calculation process in Example 1. The other step ST21 is identical with that of Example 1, and therefore its detailed description is omitted.

In ST22" of FIG. 37, the rotation rate R" [rps] of the regi roll Rr per unit time is calculated for each of the rotation start positions Pa to Pd, from the preset medium conveying time TM1, the preset medium conveying length L, the calculated zone circumferential lengths Lab to Lda, and expressions (1-1) to (1-4), (2-1) to (2-4), and (3-1)" to (3-4)". Then, the process transfers to ST23".

In ST23", the calculated rotation rate R" of the regi roll Rr per unit time is temporarily stored as the rotation rate R=R" per unit time for rotation driving of the stepping motor 4. Then, the rotation rate calculation process is ended, and the process returns to ST1" or ST105 of FIG. 37.

(Function of Example 7)

In the thus configured image forming apparatus U of Example 7, as shown in ST1" and ST105 of FIG. 36, and ST21, ST22", and ST23" of FIG. 37, the rotation rate calculation process of calculating the rotation rates R" for causing the sheet S conveyed from the regi roll Rr to reach the transferring region Q3 until the preset medium reach timing T2 shown in FIG. 4 is performed.

In the rotation rate calculation process in Example 7, as shown in ST21 and ST22" of FIG. 37 and ST31 to ST41 of FIG. 11, the zone circumferential lengths Lab to Lda are measured, and the rotation rates R" corresponding to the zone circumferential lengths Lab to Lda are calculated for the respective rotation start positions Pa to Pd. As shown in ST12' of FIG. 36, and ST23" of FIG. 37, the calculated rotation rate R" is set for each of the rotation start positions Pa to Pd, as the rotation rate R=R" per unit time for rotating the stepping motor 4. Namely, in the image forming apparatus U where there is a possibility that the zone circumferential lengths Lab to Lda between the rotation start positions Pa to Pd are different, and the rotation angle from the regi roll Rr to the transferring region, i.e., the conveying distance is varied depending the rotation start positions Pa to Pd, the rotation rate R" which corresponds to the measurement results of the zone circumferential lengths Lab to Lda is calculated for each of the rotation start positions Pa to Pd, and set for each of the rotation start positions Pa to Pd, as the rotation rate R=R" per unit time for rotating the stepping motor 4.

As a result, the image forming apparatus U of Example 7, as compared with the case where the rotation rate R" is not calculated for each of the rotation start positions Pa to Pd, the accuracy of the operation of making the timing when the sheet S reaches the transferring region Q3, coincident with that when the toner image on the surface of the photosensitive member PR reaches the transferring region Q3 is further improved.

Furthermore, the image forming apparatus U of Example 7 achieves similar functions and effects as those of the image forming apparatus U of Example 1.

EXAMPLE 8

Next, Example 8 of the invention will be described. In the description of Example 8, components corresponding to those of Example 4 described above are denoted by the same reference numerals, and their detailed description is omitted.

Example 8 is different from Example 4 in the following points, but configured in a similar manner as Example 4 in the other points.

(Description of Controller C in Example 8)

Figure 38:
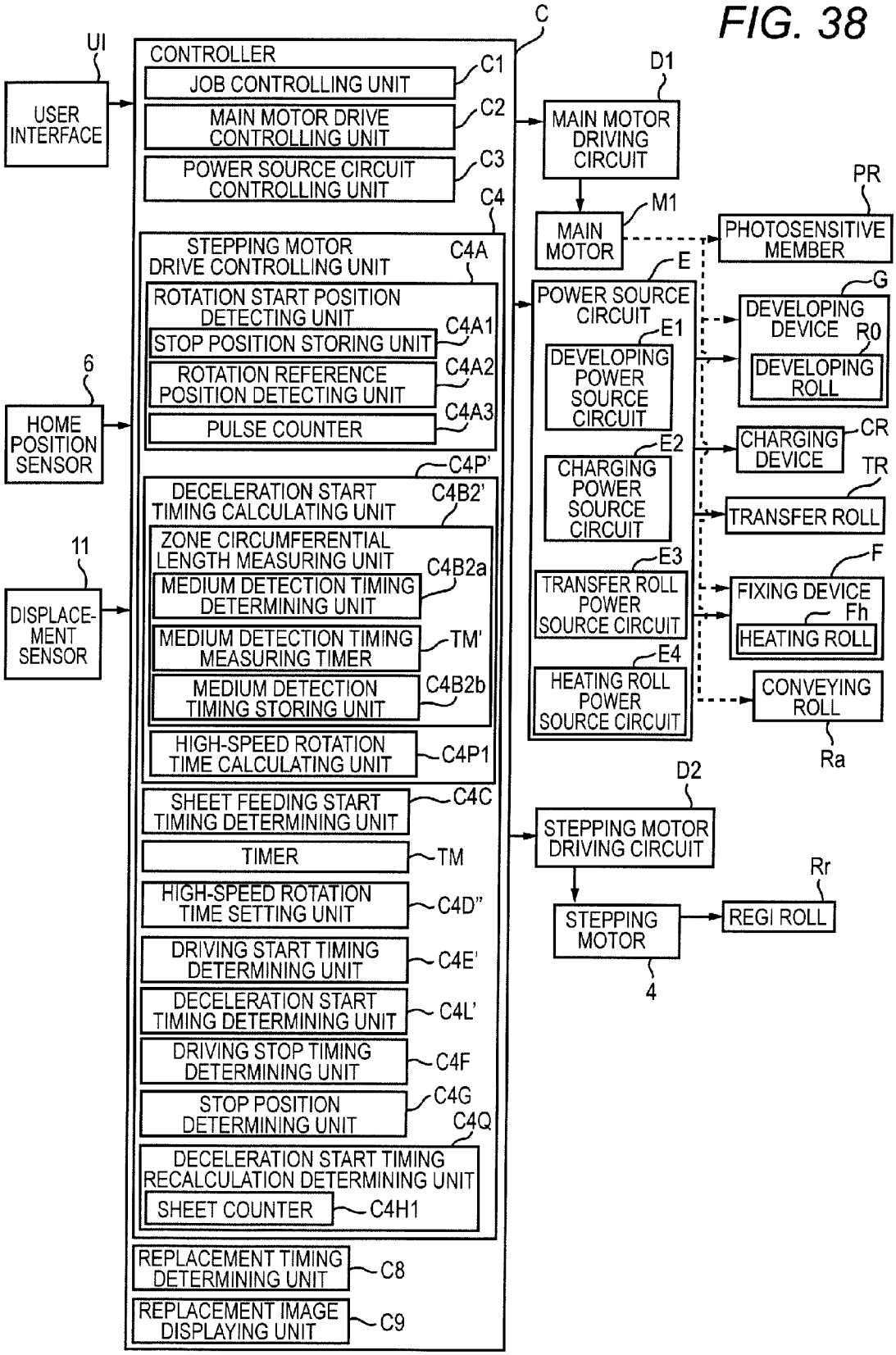
FIG. 38 is a view showing functions of a controller of an image forming apparatus of Example 8 of the invention, in the form of a block diagram, and corresponding to FIG. 21 of Example 4.

FIG. 38 is a view showing functions of a controller of an image forming apparatus of Example 8 of the invention, in the form of a block diagram, and corresponding to FIG. 21 of Example 4.

(Function of Controller C)

Referring to FIG. 38, the stepping motor drive controlling unit C4 in Example 8 has a driving start timing determining unit C4E' which is similar to the driving start timing determining unit C4E' in Examples 6 and 7, in place of the driving start timing determining unit C4E in Example 4. Furthermore, the stepping motor drive controlling unit C4 has a deceleration start timing calculating unit C4P', a high-speed rotation time setting unit C4D", a deceleration start timing determining unit C4L', and a deceleration start timing recalculation determining unit C4Q, in place of the driving start timing calculating unit C4B, the post-sheet feeding pre-conveyance time setting unit C4D, the deceleration start timing determining unit C4L, and the driving start timing recalculation determining unit C4H in Example 4.

C4P': Deceleration Start Timing Calculating Unit

The deceleration start timing calculating unit C4P' has the zone circumferential length measuring unit C4B2' in Example 4, and a high-speed rotation time calculating unit C4P1, and calculates a deceleration start timing T5" for causing the sheet S to reach the transferring region Q3 at the preset medium reach timing T2.

Figure 39:
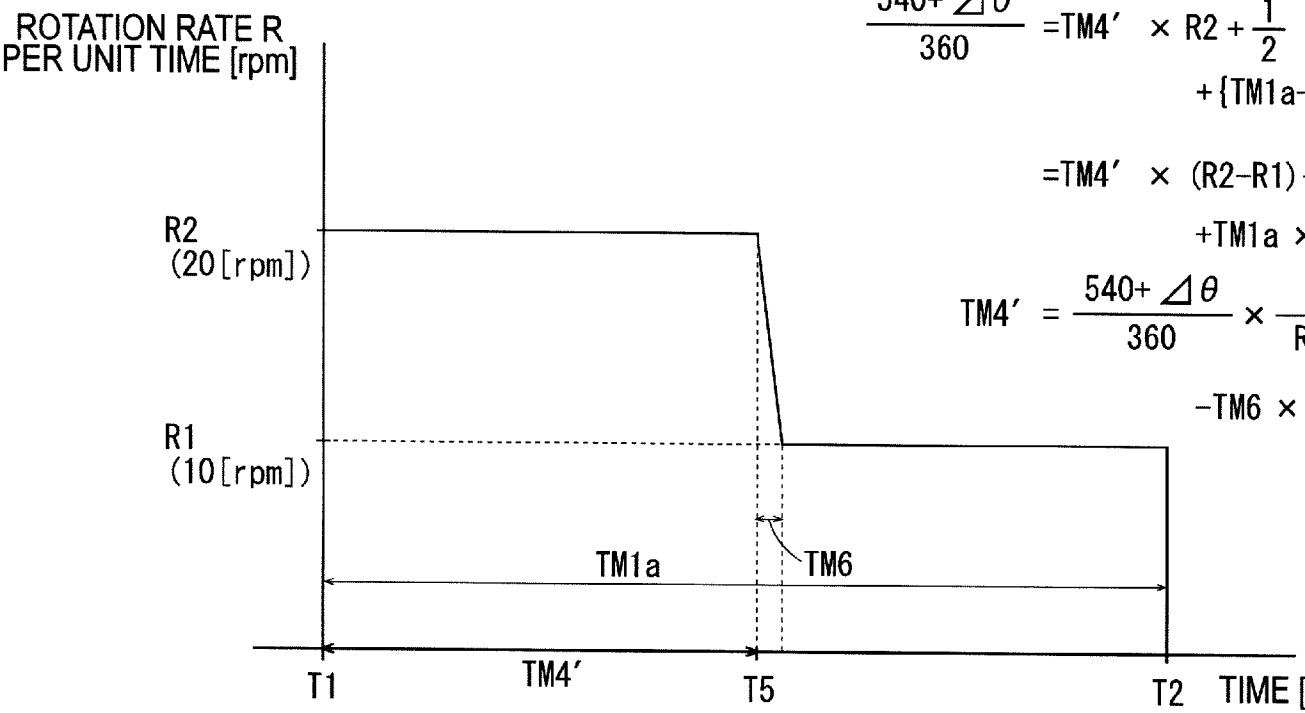
FIG. 39 is a view illustrating a high-speed rotation time in Example 8 of the invention, and corresponding to FIG. 27 of Example 5, and a timing chart in the case where, at a driving start timing, rotation of a regi roll is started by a high-speed rotation rate, and then decelerated to a normal rotation rate at a deceleration start timing.

FIG. 39 is a view illustrating a high-speed rotation time in Example 8 of the invention, and corresponding to FIG. 27 of Example 5, and a timing chart in the case where, at a driving start timing, rotation of a regi roll is started by a high-speed rotation rate, and then decelerated to a normal rotation rate at a deceleration start timing.

C4P1: High-Speed Rotation Time Calculating Unit

The high-speed rotation time calculating unit C4P 1 calculates a high-speed rotation time TM4' which extends from the driving start timing T1 to the deceleration start timing T5, and in which the stepping motor 4 is rotatingly driven at the high-speed rotation rate R2, on the basis of the normal rotation rate R1 and high-speed rotation rate R2 which are preset, the preset medium conveying time TM1, the preset medium conveying length L, and the zone circumferential lengths which are measured by the zone circumferential length measuring unit C4B2'.

The high-speed rotation time calculating unit C4P1 in Example 8 calculates the high-speed rotation time TM4' on the basis of the normal rotation rate R1=10 [rps], the high-speed rotation rate R2=2×R1=20 [rps], the preset medium conveying time TM1*a*=109.2 [ms], the medium conveying length L=100 [mm], and the zone circumferential lengths Lab to Lda. Specifically, the high-speed rotation time calculating unit C4P1 first calculates the remaining medium conveying length ΔL and the remaining rotation angle Δθ after 1.5 rotations from each of the rotation start positions Pa to Pd, by expressions (1-1) to (1-4) and (2-1) to (2-4) above. As shown in FIG. 39, from relationships among the time, the rotation rate, and the rotation angle, following expression (7) is held. By following expressions (7-1) to (7-4) in which the unit of the high-speed rotation time TM4' is converted from seconds [s] to milliseconds [ms], therefore, the high-speed rotation time TM4' [ms] is calculated. In Example 8, a deceleration execution time TM6 shown in FIG. 39 and for decelerating the high-speed rotation rate R2 to the normal rotation rate R1 is approximated to 0 [ms].

$$(540^\circ + \Delta\theta) = TM4' \times R2 \times 360^\circ + (1/2) \times TM6 \times (R2 + R1) \times 360^\circ + \{TM1a - (TM4' + TM6)\} \times R1 \times 360^\circ \quad (7)$$

In the case of the first rotation start position Pa:

$$\begin{aligned} TM4' &= [\{(540^\circ + \Delta\theta/360^\circ\} \times \{1/(R2 - R1)\}] \times 10^3 - TM1a \times \{R1/(R2 - R1)\} \\ &= [\{(540^\circ + \Delta\theta)/360^\circ\} \times \{1/(2 \times R1 - R1)\} \times 10^3] - TM1a \times \{R1/(2 \times R1 - R1)\} \\ &= \{(540^\circ + \Delta\theta)/(360^\circ \times R1)\} \times 10^3 - TM1a \\ &= 10^3 \times (540^\circ + 90^\circ \times \Delta L/Lcd)/(360^\circ \times R1) - 109.2 \\ &= 10^3 \times [540^\circ + 90^\circ \times \{L - (Lab + \ldots + Lbc\})/Lcd]/(360^\circ \times R1) - 109.2 \end{aligned} \quad (7\text{-}1)$$

In the case of the second rotation start position Pb:

$$\begin{aligned} TM4' &= \{(540^\circ + \Delta\theta)/(360^\circ \times R1)\} \times 10^3 - TM1a \\ &= 10^3 \times (540^\circ + 90^\circ \times \Delta L/Lda)/(360^\circ \times R1) - 109.2 \\ &= 10^3 \times [540^\circ + 90^\circ \times \{L - (Lbc + \ldots + Lcd\})/Lda]/(360^\circ \times R1) - 109.2 \end{aligned} \quad (7\text{-}2)$$

In the case of the third rotation start position Pc:

$$\begin{aligned} TM4' &= \{(540^\circ + \Delta\theta)/(360^\circ \times R1)\} \times 10^3 - TM1a \\ &= 10^3 \times (540^\circ + 90^\circ \times \Delta L/Lab)/(360^\circ \times R1) - 109.2 \\ &= 10^3 \times [540^\circ + 90^\circ \times \{L - (Lcd + \ldots + Lda\})/Lab]/(360^\circ \times R1) - 109.2 \end{aligned} \quad (7\text{-}3)$$

In the case of the fourth rotation start position Pd:

$$\begin{aligned} TM4' &= \{(540^\circ + \Delta\theta)/(360^\circ \times R1)\} \times 10^3 - TM1a \\ &= 10^3 \times (540^\circ + 90^\circ \times \Delta L/Lbc)/(360^\circ \times R1) - 109.2 \\ &= 10^3 \times [540^\circ + 90^\circ \times \{L - (Lda + \ldots + Lab\})/Lbc]/(360^\circ \times R1) - 109.2 \end{aligned} \quad (7\text{-}4)$$

Therefore, the deceleration start timing calculating unit C4P' in Example 8 calculates the deceleration start timing T5" when the high-speed rotation time TM4' calculated by the high-speed rotation time calculating unit C4P1 has elapsed from the driving start timing T1 determined by the driving start timing determining unit C4E'.

FIG. 40 is a view showing an example of medium conveying times in Example 8 of the invention, at respective rotation start positions in shipment of a product, and high-speed rotation times at respective rotation start positions after operation, and corresponding to FIG. 23 of Example 4.

As shown in FIG. 40, for example, the medium conveying time TM1 with respect to the driving roller Rr1 after operation which is similar to FIG. 23 of Example 4 will be considered. In this case, in the driving roller Rr1 in the product shipment in Example 8, the zone circumferential lengths Lab to Lda are 15.71 [mm], the medium conveying time TM1*a* in the product shipment is 109.2 [ms], and the high-speed rotation time TM4 is 50 [ms].

By contrast, the case where, in the driving roller Rr1 after operation, the zone circumferential lengths Lab to Lda are 16.49 [mm], 14.45 [mm], 15.71 [mm], and 15.71 [mm] will be considered. In this case, by expressions (1-1) to (1-4) and (2-1) to (2-4) above, the calculated medium conveying lengths ΔL are 6.69 [mm], 7.48 [mm], 5.75 [mm], and 5.75 [mm], and the remaining rotation angles Δθ are 38.4°, 42.9°, 34.0°, and 33.9°. The high-speed rotation times TM4' for the respective rotation start positions Pa to Pd calculated by expressions (7-1) to (7-4) above are 51.47 [ms], 52.72 [ms], 50.24 [ms], and 50.22 [ms]. Therefore, it is seen that the high-speed rotation times TM4' are longer than the high-speed rotation time TM4=50 [ms].

FIG. 41 is a view showing a high-speed rotation time table in Example 8 of the invention, and corresponding to FIG. 40.

C4D": High-Speed Rotation Time Setting Unit

The high-speed rotation time setting unit C4D" sets the high-speed rotation times TM4' calculated by the high-speed rotation time calculating unit C4P1. The high-speed rotation time setting unit C4D" in Example 8 sets the high-speed rotation time table shown in FIG. 41.

Referring to FIG. 41, in the high-speed rotation time table in Example 8, 50.5 [ms] is preset in the case of "thick sheet", and 50 [ms] is set in the case of "ordinary sheet", as the high-speed rotation time TM4 in the product shipment which is a set reference value. In the case where the zone circumferential lengths Lab to Lda shown in FIG. 40 are measured, in the high-speed rotation time setting unit C4D" in Example 8, the high-speed rotation time TM4' in the case where the rotation driving is started from the first rotation start position Pa is set to 51.97 [ms] in the case of "thick sheet", and to 51.47 [ms] in the case of "ordinary sheet". The high-speed rotation time TM4' in the case where the rotation driving is started from the second rotation start position Pb is set to 52.72 [ms] in the case of "thick sheet", and to 53.22 [ms] in the case of "ordinary sheet". The high-speed rotation time TM4' in the case where the rotation driving is started from the third rotation start position Pc is set to 50.74 [ms] in the case of "thick sheet", and to 50.24 [ms] in the case of "ordinary sheet". The high-speed rotation time TM4' in the case where the rotation driving is started from the fourth rotation start position Pd is set to 50.72 [ms] in the case of "thick sheet", and to 50.22 [ms] in the case of "ordinary sheet".

C4L': Deceleration Start Timing Determining Unit

The deceleration start timing determining unit C4L' determines whether or not the time reaches the deceleration start timing T5 when the high-speed rotation time TM4 for each of the rotation start positions Pa to Pd which is shown in FIG. 39, and which is set by the high-speed rotation time setting unit C4D" has elapsed from the preset driving start timing T1.

If the deceleration start timing determining unit C4L' determines that the time reaches the deceleration start timing T5, the stepping motor drive controlling unit C4 in Example 8 controls the input number of pulse waves per unit time to the stepping motor 4 to decelerate the rotation rate R of the regi roll Rr per unit time from the high-speed rotation rate R2=2×R1=20 [rps] to the normal rotation rate R1=10 [rps].

C4Q: Deceleration Start Timing Recalculation Determining Unit

The deceleration start timing recalculation determining unit C4Q in Example 8 has the sheet counter C4H1 in Example 1, and determines whether the value of the sheet number Nj exceeds the preset recalculation determination value $N_{max}$ or not, thereby determining whether the high-speed rotation time TM4' is to be recalculated or not.

(Description of Flowchart of Example 8)

Next, the flow of the process of the image forming apparatus U of Example 8 of the invention will be described with reference to flowcharts.

(Description of Flowchart of Stepping Motor Driving Control Process in Example 8)

Figure 42:
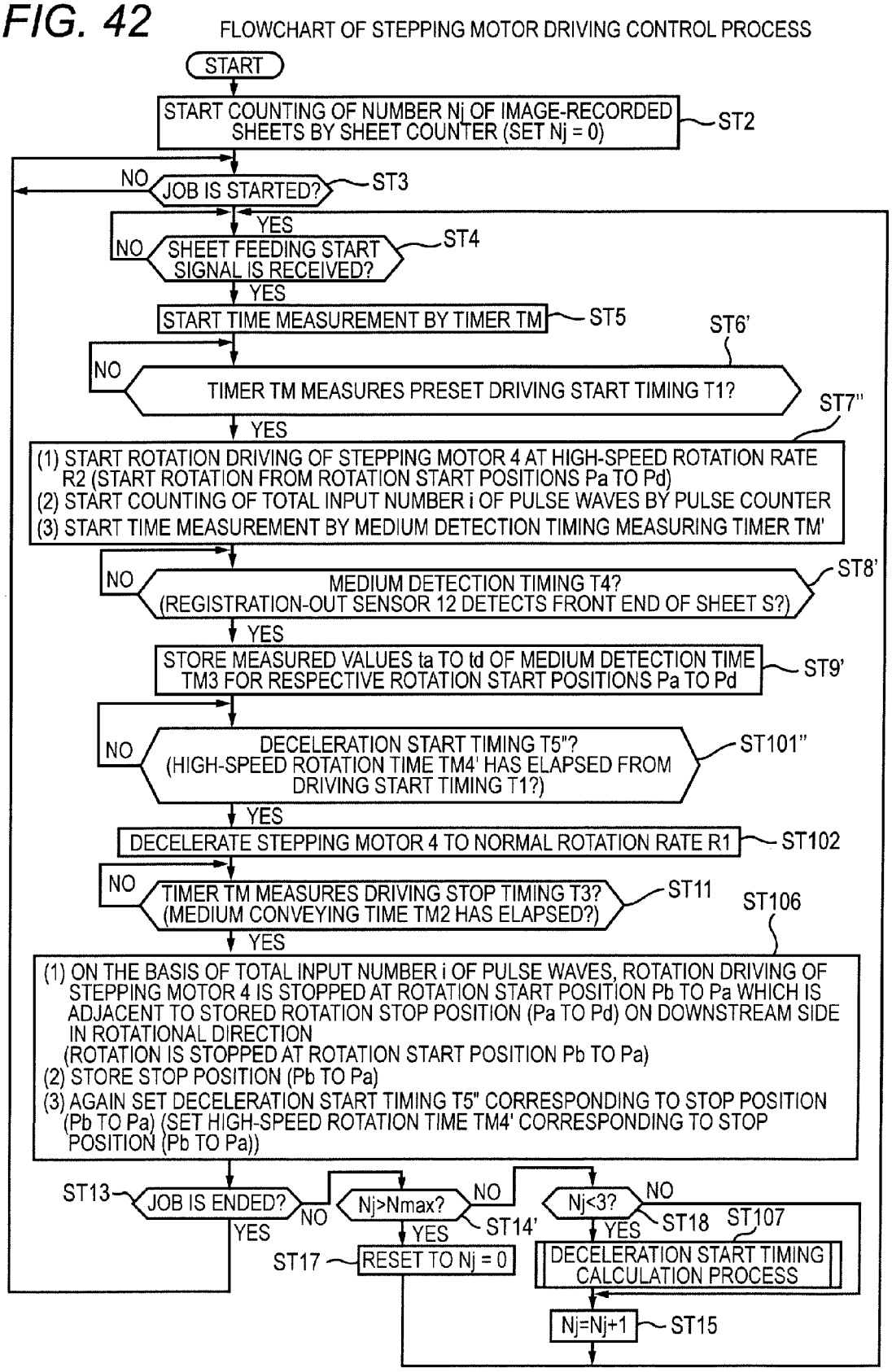
FIG. 42 is a flowchart of a stepping motor driving control process in Example 8 of the invention and corresponding to FIG. 24 of Example 4.

FIG. 42 is a flowchart of the stepping motor driving control process in Example 8 of the invention and corresponding to FIG. 24 of Example 4.

Referring to FIG. 42, in the flowchart of the stepping motor driving control process in Example 8, a process which is similar to ST6' of FIG. 32 in Example 6 is performed in place of ST6 of the stepping motor driving control process in Example 4. In the flowchart of the stepping motor driving control process in Example 8, following ST101", ST106, and ST107 are performed in place of ST101, ST12, and ST16' of the flowchart of the stepping motor driving control process in Example 4. The other steps ST2 to ST6, ST7", ST8', ST9', ST102, ST11, ST13, ST14', ST15, ST17, and ST18 are identical with those of Example 4. Therefore, their detailed description is omitted.

In ST101" of FIG. 42, it is determined whether the timer reaches the deceleration start timing T5" shown in FIG. 39 when the high-speed rotation time TM4' has elapsed from the driving start timing T1 or not. If yes (Y), the process transfers to ST102, and, if no (N), the process repeats ST101".

In ST106, processes of following (1) to (3) are performed, and the process transfers to ST13.

(1) On the basis of the total input number i of pulse waves which is the value of the pulse counter, the rotation driving of the stepping motor 4 is stopped at the stored stop position, i.e., the rotation start position Pb to Pa which is adjacent to the present one of the rotation start positions Pa to Pd on the downstream side in the rotational direction.

(2) The next one of the rotation start positions Pb to Pa which is the stop position is stored.

(3) The high-speed rotation time TM4' corresponding to the stop position (Pb to Pa) is again set. Namely, the deceleration start timing T5" corresponding to the stop position (Pb to Pa) is again set.

In ST107, a deceleration start timing calculation process of FIG. 43 which will be described later is performed. Then, the process transfers to ST15.

(Description of Flowchart of Deceleration Start Timing Calculation Process in Example 8)

Figure 43:
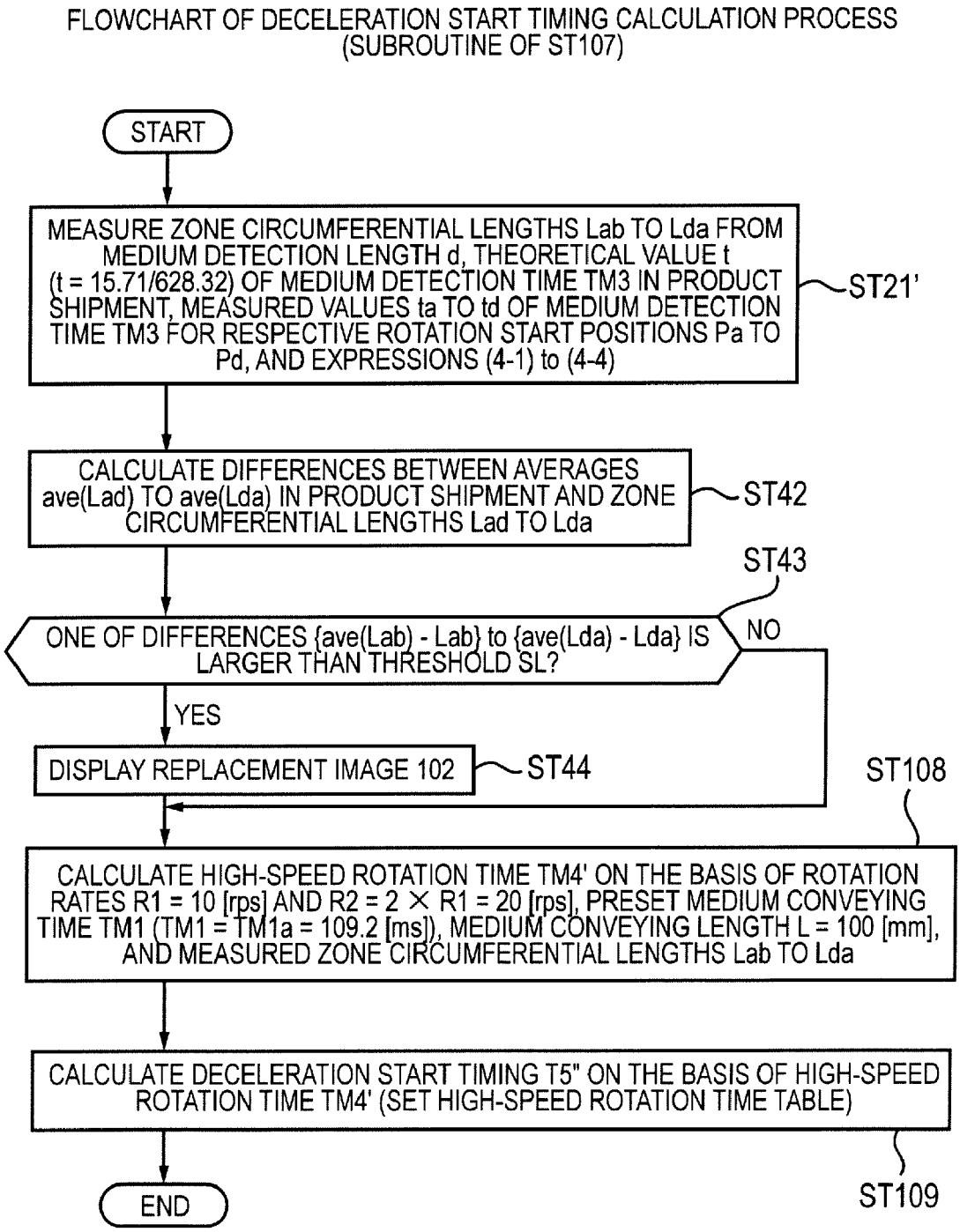
FIG. 43 is a flowchart of a deceleration start timing calculation process in Example 8 of the invention, corresponding to FIG. 17 of Example 2, and illustrating a subroutine of ST107 of FIG. 42.

FIG. 43 is a flowchart of the deceleration start timing calculation process in Example 8 of the invention, corresponding to FIG. 17 of Example 2, and illustrating a subroutine of ST107 of FIG. 42.

Referring to FIG. 43, in the flowchart of the deceleration start timing calculation process in Example 8, following ST108 and ST109 are performed in place of ST22 and ST23 of the driving start timing calculation process in Example 2, and the other steps ST21' and ST42 to ST44 are identical with those of Example 1. Therefore, their detailed description is omitted.

In ST108 of FIG. 43, the high-speed rotation time TM4' [ms] is calculated from the normal rotation rate R1=10 [rps], the high-speed rotation rate R2=2×R1=20 [rps], the medium conveying time TM1*a*=109.2 [ms] in the product shipment, the medium conveying length L=100 [mm], the measured zone circumferential lengths Lab to Lda, and expressions (1-1) to (1-4), (2-1) to (2-4), and (7-1) to (7-4). Then, the process transfers to ST109.

In ST109, the deceleration start timing T5" is calculated on the basis of the measured high-speed rotation time TM4' [ms], or namely the high-speed rotation time table of the high-speed rotation time TM4' shown in FIG. 41 is set. Then, the deceleration start timing calculation process is ended, and the process returns to ST107 of FIG. 42.

(Function of Example 8)

In the thus configured image forming apparatus U of Example 8, as shown in ST107 of FIG. 42, and ST21', ST108, and ST109 of FIG. 43, the deceleration start timing calculation process of calculating the deceleration start timing T5" for causing the sheet S conveyed from the regi roll Rr to reach the transferring region Q3 until the preset medium reach timing T2 which is shown in FIG. 39 is performed.

In the deceleration start timing calculation process in Example 8, as shown in ST21' and ST108 of FIG. 43, the zone circumferential lengths Lab to Lda are measured, and the high-speed rotation times TM4' [ms] corresponding to the zone circumferential lengths Lab to Lda are calculated for the respective rotation start positions Pa to Pd. As shown in ST109 of FIG. 43, the high-speed rotation time table shown in FIG. 41 is set on the basis of the calculated high-speed rotation times TM4' [ms] for the rotation start positions Pa to Pd.

In the image forming apparatus U of Example 8, as shown in ST106 of FIG. 42, therefore, the zone circumferential lengths Lab to Lda are measured, and the deceleration start timing T5" for each of the zone circumferential lengths Lab to Lda is calculated and set for each of the rotation start positions Pa to Pd. Namely, in the image forming apparatus U where there is a possibility that the zone circumferential lengths Lab to Lda between the rotation start positions Pa to Pd are different, and the rotation angle from the regi roll Rr to the transferring region, i.e., the conveying distance is varied depending on the rotation start positions Pa to Pd, the deceleration start timing T5" which corresponds to the measurement results of the zone circumferential lengths Lab to Lda is calculated and set for each of the rotation start positions Pa to Pd.

In the image forming apparatus U of Example 8, as shown in ST101" and ST102 of FIG. 42, if it is determined that the time reaches the deceleration start timing T5", the rotation rate R of the regi roll Rr per unit time is decelerated from the high-speed rotation rate R2=2×R1=20 [rps] to the normal rotation rate R1=10 [rps].

As a result, in the image forming apparatus U of Example 8, as compared with the case where the deceleration start timing T5" is not calculated for the rotation start positions Pa to Pd, the accuracy of the operation of making the timing when the sheet S reaches the transferring region Q3, coincident with that when the toner image on the surface of the photosensitive member PR reaches the transferring region Q3 is improved.

Furthermore, the image forming apparatus U of Example 8 achieves similar functions and effects as those of the image forming apparatus U of Example 4.

(Modifications)

Although, in the above, the examples of the invention have been described in detail, the invention is not restricted to the examples. Various modifications are enabled within the scope of the spirit of the invention set forth in the claims. Modifications (H01) to (H010) of the invention will be exemplified.

(H01) Although, in the examples, the multi-function apparatus has been described as an example of the image forming apparatus U, the invention is not restricted to this. The invention may be applied also to a copier, a FAX, and the like. The invention is not restricted to an electrophotographic image forming apparatus, and may be applied to an image forming apparatus of an arbitrary image forming system, such as a printer of the inkjet recording system, the thermal head system, or the lithography system. The invention is not restricted to a monochromatic image forming apparatus, and may be configured by an image forming apparatus of the multi-color development system.

(H02) Although, in the examples, the regi roll Rr has been described as an example of the medium conveying member, the invention is not restricted to this. For example, the medium conveying member may be configured by the conveying rolls Ra or the like.

(H03) In the examples, as an example of the medium conveying member, the regi roll Rr having the driving roller Rr1 which rotatingly drives, and the driven roller Rr2 which is opposed to and contacted with the driving roller Rr1 to be followingly driven has been described. The invention is not restricted to this. For example, the invention is applicable also to the case where the driving roller Rr1 is replaced with an endless belt which rotatingly drives.

(H04) Although, in the examples, the transferring region Q3 has been described as an example of the conveyance destination, the invention is not restricted to this. For example, the fixing device F, the discharging unit TRh, the post-processing device which is not shown, or the like may be configured as the conveyance destination.

(H05) Although, in the examples, the stepping motor 4 shown in FIG. 2B has been described as an example of the driving source, the invention is not restricted to this. For example, another motor which can start the rotation driving at the rotation start positions Pa to Pd, and which can change the rotation rate R per unit time may be used as the driving source.

(H06) In the examples, the driving gear train 5 having the roller gear 2 and the motor gear 3 has been described as an example of the driving transmission system. However, the driving gear train 5 is not restricted to the configuration having two gears, and may be configured by three or more gears.

(H07) In the examples, in the post-sheet feeding pre-conveyance time table shown in FIG. 6, the sheet feeding conveyance time table shown in FIG. 31, and the high-speed rotation time table shown in FIG. 41, set values are disposed only in the cases of "thick sheet" and "ordinary sheet". However, the invention is not restricted to this. In the case where preset thicknesses of the sheet S are x [mm], y [mm], and z [mm] and the relationship of $x<y<z$ is established, for example, plural kinds of "thick sheet" or "thick sheet (x mm or more)", "thick sheet (y mm or more)", and "thick sheet (z mm or more)" may be set, or sheet kinds such as "OHP sheet" and "coated sheet" may be used as the set values.

(H08) Although, in the examples, the sampling of the zone radius r is performed in 36 zones including the rotation start positions Pa to Pd, the invention is not restricted to this. For example, 35 or less zones, or 37 or more zones may be used.

(H09) In the examples, the rotation start positions Pa to Pd are configured by the four different positions, or the first rotation start position Pa, the second rotation start position Pb, the third rotation start position Pc, and the fourth rotation start position Pc. However, the invention is not restricted to this. For example, the rotation start positions may be configured by two or three different positions, or five or more different positions. In this case, in accordance with the number of the rotation start positions, the expressions for the respective rotation start positions Pa to Pd, such as expressions (1-1) to (1-4) must be increased or decreased, and the numerals and the like must be changed.

(H010) In the examples, the medium conveying length L=100 [mm] shown in FIG. 2A is a value which is obtained by addition of 1.5 rotations of the driving roller Rr1 of the regi roll Rr and the remaining medium conveying length ΔL. However, the invention is not restricted to this, and the length may be set to an arbitrary value. For example, the medium conveying length L may be preset to an integer multiple of 62.83 [mm] which is the total circumferential length of the driving roller Rr1 in the product shipment. In this case, the angle of 540° for 1.5 rotations in expressions (1-1) to (1-4) and the like must be changed in accordance with the number of revolutions.

What is claimed is:

1. A medium conveying apparatus comprising:

a medium conveying member that conveys a medium;

a rotation start position detecting unit that detects a plurality of rotation start positions that are preset in accordance with a central angle of the medium conveying member that is equally divided along a rotational direction of the medium conveying member;

a driving start timing determining unit that determines whether a time reaches a driving start timing when rotation driving by the medium conveying member is started or not; and a medium conveying member controlling unit that controls the rotation driving of the medium conveying member, in case the driving start timing determining unit determines that the time reaches the driving start timing and the rotation driving is started from one of the rotation start positions, the rotation driving at another one of the rotation start positions that is different from the rotation start position where the rotation driving is started, and stops the rotation driving of the medium conveying member based on a result of the detection by the rotation start position detecting unit.

2. The medium conveying apparatus according to claim 1, wherein, after the medium is conveyed to the medium conveying member, the medium conveying member controlling unit starts the rotation driving of the medium conveying member at the driving start timing to start conveyance of the medium, and the apparatus further comprises:

a zone circumferential length measuring unit that measures zone circumferential lengths between adjacent ones of the rotation start positions;

a medium conveying time calculating unit that calculates a medium conveying time when the medium is conveyed from the medium conveying member to a preset conveyance destination, based on a preset rotation rate of the medium conveying member per unit time, a medium conveying length from the medium conveying member to the conveyance destination, and zone circumferential lengths corresponding to a central angle from the rotation start position where the rotation driving is started, to the rotation start positions; and a driving start timing calculating unit that calculates the driving start timing for causing the medium to reach the conveyance destination at a preset medium reach timing, based on the medium conveying time calculated by the medium conveying time calculating unit.

3. The medium conveying apparatus according to claim 1, wherein, after the medium is conveyed to the medium conveying member, the medium conveying member controlling unit starts the rotation driving of the medium conveying member at the preset driving start timing to start conveyance of the medium, and the apparatus further comprises:

a zone circumferential length measuring unit that measures zone circumferential lengths between adjacent ones of the rotation start positions;

a medium conveying time calculating unit that calculates a medium conveying time when the medium is conveyed from the medium conveying member to a preset conveyance destination, based on a preset rotation rate of the medium conveying member per unit time, a medium conveying length from the medium conveying member to the conveyance destination, and zone circumferential lengths corresponding to a central angle from the rotation start position where the rotation driving is started, to the rotation start positions; and a medium reach timing calculating unit that calculates a medium reach timing when the medium reaches the conveyance destination, based on the driving start timing, and the medium conveying time calculated by the medium conveying time calculating unit.

4. The medium conveying apparatus according to claim 1, wherein, after the medium is conveyed to the medium conveying member, the medium conveying member controlling unit starts the rotation driving of the medium conveying member at the preset driving start timing by a high-speed rotation rate that is larger than a normal rotation rate that is a rotation rate per unit time of the medium conveying member in a normal state, to start conveyance of the medium, and decelerates from the high-speed rotation rate to the normal rotation rate, at a deceleration start timing when the medium conveying time at which the medium is conveyed from the medium conveying member to a preset conveyance destination has not elapsed, and the apparatus further comprises:

a zone circumferential length measuring unit that measures zone circumferential lengths between adjacent ones of the rotation start positions; and a deceleration start timing calculating unit that calculates the deceleration start timing for causing the medium to reach the conveyance destination at a medium reach timing when the medium conveying time has elapsed from the driving start timing, based on the normal rotation rate and high-speed rotation rate which are preset, the preset medium conveying time, a medium conveying length from the medium conveying member to the conveyance destination, and zone circumferential lengths corresponding to a central angle from the rotation start position where the rotation driving is started, to the rotation start positions.

5. The medium conveying apparatus according to claim 2, wherein the apparatus further comprises a rotation rate calculating unit that calculates a rotation rate of the medium conveying member per unit time, the rotation rate corresponding to the zone circumferential lengths measured by the zone circumferential length measuring unit, based on the measured zone circumferential lengths, and an average of the previously measured zone circumferential lengths in product shipment.

6. The medium conveying apparatus according to claim 1, wherein, after the medium is conveyed to the medium conveying member, the medium conveying member controlling unit starts the rotation driving of the medium conveying member at the preset driving start timing to start conveyance of the medium, and the apparatus further comprises:

a zone circumferential length measuring unit that measures zone circumferential lengths between adjacent ones of the rotation start positions; and a rotation rate calculating unit that calculates a rotation rate of the medium conveying member per unit time, the rotation rate causing the medium to reach a preset conveyance destination at a medium reach timing when the medium conveying time has elapsed from the driving start timing, based on a preset medium conveying time when the medium is conveyed from the medium conveying member to the conveyance destination, a preset medium conveying length from the medium conveying member to the conveyance destination, and zone circumferential lengths corresponding to a central angle from the rotation start position where the rotation driving is started, to the rotation start positions.

7. The medium conveying apparatus according to claim 2, wherein the apparatus further comprises a medium detecting member that is placed between the medium conveying member and the conveyance destination, and that detects a front end of the medium in a medium conveying direction, and the zone circumferential length measuring unit measures zone circumferential lengths corresponding to a central angle from the rotation start position where the rotation driving is started, to the rotation start positions, based on a rotation rate of the medium conveying member per unit time, a medium detection length from the medium conveying member to the medium detecting member, and a medium detection time which extends from the driving start timing to a medium detection timing when the medium detecting member detects the front end of the medium in the medium conveying direction.

8. The medium conveying apparatus according to claim 7, wherein the medium detecting member is placed at a preset medium detection position where the medium detection length equals to an average of zone circumferential lengths between adjacent ones of the rotation start positions, in product shipment.

9. The medium conveying apparatus according to claim 7, wherein the medium detecting member is placed at a medium detection position where the medium conveying direction from the medium conveying member to the medium detecting member linearly extends.

10. The medium conveying apparatus according to claim 7, wherein, after the medium is conveyed to the medium conveying member, the medium conveying member controlling unit starts the rotation driving of the medium conveying member at the driving start timing by a high-speed rotation rate that is larger than a normal rotation rate that is a rotation rate per unit time of the medium conveying member in a normal state, to start conveyance of the medium, and decelerates from the high-speed rotation rate to the normal rotation rate, at a deceleration start timing when a preset high-speed rotation time has elapsed from the driving start timing, and when the medium conveying time at which the medium is conveyed from the medium conveying member to a preset conveyance destination has not elapsed, thereby causing the medium to reach the conveyance destination at a medium reach timing when the medium conveying time has elapsed from the driving start timing, and the apparatus further comprises:

a predicted value calculating unit that calculates a predicted value of the medium detection time on a basis of the zone circumferential length measured by the zone circumferential length measuring unit;

a correction time calculating unit that calculates a correction time for correcting a length of the high-speed rotation time, based on the normal rotation rate and high-speed rotation rate which are preset, and a difference between a measured value of the medium detection time measured by a result of the detection by the medium detecting member, and the predicted value of the medium detection time calculated by the predicted value calculating unit, the correction time offsetting a change of the medium reach timing corresponding to the difference by a change of the medium reach timing due to a speed difference between the normal rotation rate and the high-speed rotation rate, and the correction time; and a deceleration start timing correcting unit that corrects the preset deceleration start timing, based on the correction time calculated by the correction time calculating unit.

11. The medium conveying apparatus according to claim 2, wherein the medium conveying member has a driving roller that rotatingly drives, and a driven roller that is opposed to and contacted with the driving roller to be followingly driven, the rollers conveying the medium while nipping the medium, the apparatus further comprises:

a displacement amount detecting member that detects a displacement amount of a rotation center of the driven roller; and a zone radius measuring unit that measures zone radii corresponding to the rotation start positions of the driving roller, based on a rotation rate of the medium conveying member per unit time, and a result of detection by the displacement amount detecting member, and a zone circumferential length measuring unit measures the zone circumferential lengths between adjacent ones of the rotation start positions, based on zone radii of adjacent rotation start positions.

12. The medium conveying apparatus according to claim 11, wherein the apparatus further comprises:

a medium thickness measuring unit that measures a thickness of the medium, based on a result of detection by the displacement amount detecting member before conveyance of the medium, and a result of detection by the displacement amount detecting member during conveyance of the medium;

a double feed determining unit that determines whether the thickness of the medium measured by the medium thickness measuring unit exceeds a preset threshold or not, thereby determining whether a plurality of media are simultaneously conveyed or not; and a double feed image displaying unit that, in case the double feed determining unit determines that a plurality of media are simultaneously conveyed, displays a double feed image notifying that a plurality of media are simultaneously conveyed.

13. The medium conveying apparatus according to claim 1, wherein the apparatus further comprises:

a replacement timing determining unit that determines whether a difference between an average of zone circumferential lengths between adjacent ones of the rotation start positions in product shipment, and zone circumferential lengths between adjacent ones of the rotation start positions measured by the zone circumferential length measuring unit exceeds a preset threshold or not, thereby determining whether the time reaches a replacement timing when the medium conveying member is to be replaced because of wear of the medium conveying member or not; and a replacement image displaying unit that, in case the replacement timing determining unit determines that the time reaches the replacement timing, displays a replacement image notifying that the time reaches the replacement timing.

14. The medium conveying apparatus according to claim 1, wherein the apparatus further comprises:

a driving source that rotatingly drives the medium conveying member; and a driving transmission system that transmits rotation driving of the driving source to the medium conveying member, and that causes the medium conveying member to make one rotation in accordance with preset integer operations of rotation driving of the driving source.

15. The medium conveying apparatus according to claim 1, wherein the driving source rotatingly drives the medium conveying member, and changes a rotation rate of the medium conveying member in accordance with a number of rectangular waves of a rectangular signal, the rectangular waves being input during a unit time, the medium conveying member controlling unit controls the input number of the rectangular waves per unit time to the driving source, thereby controlling rotation driving of the medium conveying member, and the rotation start position detecting unit detects the rotation start positions on a basis of a total input number of the rectangular waves to the driving source.

16. An image forming apparatus comprising:

an image recording apparatus that records an image on a medium;

a fixing device that fixes the image on a surface of the medium; and the medium conveying apparatus according to claim 1, the medium conveying apparatus conveying the medium.

* * * * *